US009070980B2

(12) United States Patent
Asanuma et al.

(10) Patent No.: US 9,070,980 B2
(45) Date of Patent: Jun. 30, 2015

(54) SMALL ANTENNA APPARATUS OPERABLE IN MULTIPLE BANDS INCLUDING LOW-BAND FREQUENCY AND HIGH-BAND FREQUENCY AND INCREASING BANDWIDTH INCLUDING HIGH-BAND FREQUENCY

(75) Inventors: Kenichi Asanuma, Kyoto (JP); Atsushi Yamamoto, Kyoto (JP); Tsutomu Sakata, Osaka (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 220 days.

(21) Appl. No.: 13/883,871

(22) PCT Filed: Aug. 31, 2012

(86) PCT No.: PCT/JP2012/005537

§ 371 (c)(1),
(2), (4) Date: May 7, 2013

(87) PCT Pub. No.: WO2013/051188

PCT Pub. Date: Apr. 11, 2013

(65) Prior Publication Data

US 2013/0234902 A1 Sep. 12, 2013

(30) Foreign Application Priority Data

Oct. 6, 2011 (JP) ..... 2011-221692

(51) Int. Cl.
*H01Q 9/00* (2006.01)
*H01Q 1/52* (2006.01)
(Continued)

(52) U.S. Cl.
CPC . *H01Q 1/52* (2013.01); *H01Q 7/00* (2013.01); *H01Q 9/30* (2013.01); *H01Q 5/321* (2015.01)

(58) Field of Classification Search
USPC ..... 343/749, 866, 867, 788
See application file for complete search history.

(56) References Cited

U.S. PATENT DOCUMENTS 6,529,170 B1 3/2003 Nishizawa et al.
7,355,270 B2 4/2008 Hasebe et al.
(Continued)

FOREIGN PATENT DOCUMENTS

CN 1349674 5/2002
CN 1655185 8/2005
(Continued)

OTHER PUBLICATIONS

International Search Report issued Oct. 9, 2012 in International (PCT) Application No. PCT/JP2012/005537.
(Continued)

*Primary Examiner* — Tan Ho
(74) *Attorney, Agent, or Firm* — Wenderoth, Lind & Ponack, L.L.P.

(57) ABSTRACT

A radiator is provided with a looped radiation conductor, a capacitor, an inductor, a feed point on the radiation conductor, and a dielectric block provided in a portion where the radiation conductor and the ground conductor are close to each other. At a low-band resonance frequency, a current flows through a path extending along an inner perimeter of the loop of the radiation conductor and including the inductor and the capacitor. At a high-band resonance frequency, a current flows through a path including a section extending along an outer perimeter of the loop of the radiation conductor, including the capacitor but not including the inductor, and extending between the feed point and the inductor, and a parallel resonant circuit is formed from: a capacitance between the radiation conductor and the ground conductor between which the dielectric block is provided; and an inductance of the radiation conductor.

15 Claims, 41 Drawing Sheets

(51) Int. Cl.

| | |
|---|---|
| ***H01Q 7/00*** | (2006.01) |
| ***H01Q 9/30*** | (2006.01) |
| ***H01Q 5/321*** | (2015.01) |

(56) References Cited

U.S. PATENT DOCUMENTS

| | | | | |
|---|---|---|---|---|
| 7,545,327 | B2 | 6/2009 | Iellici et al. | |
| 7,705,786 | B2 | 4/2010 | Iellici et al. | |
| 7,755,546 | B2 | 7/2010 | Ishimiya | |
| 8,094,080 | B2 * | 1/2012 | Komura | 343/702 |
| 8,098,211 | B2 | 1/2012 | Onaka et al. | |
| 2003/0034917 | A1 | 2/2003 | Nishizawa et al. | |
| 2004/0001029 | A1 | 1/2004 | Parsche et al. | |
| 2005/0173532 | A1 | 8/2005 | Hasebe et al. | |
| 2006/0158379 | A1 | 7/2006 | Ishimiya | |
| 2006/0244668 | A1 | 11/2006 | Iellici et al. | |
| 2007/0120740 | A1 | 5/2007 | Iellici et al. | |
| 2007/0268191 | A1 * | 11/2007 | Ishizuka et al. | 343/702 |
| 2008/0316111 | A1 | 12/2008 | Aoyama et al. | |
| 2009/0040114 | A1 | 2/2009 | Okamura et al. | |
| 2009/0213014 | A1 | 8/2009 | Iellici et al. | |
| 2009/0256771 | A1 | 10/2009 | Onaka et al. | |
| 2009/0295653 | A1 | 12/2009 | Komura | |
| 2010/0060524 | A9 | 3/2010 | Okamura et al. | |
| 2012/0001815 | A1 * | 1/2012 | Wong et al. | 343/749 |
| 2013/0135164 | A1 * | 5/2013 | Asanuma et al. | 343/749 |
| 2013/0229320 | A1 * | 9/2013 | Asanuma et al. | 343/788 |
| 2014/0002320 | A1 * | 1/2014 | Asanuma et al. | 343/749 |
| 2015/0035712 | A1 * | 2/2015 | Wong et al. | 343/749 |

FOREIGN PATENT DOCUMENTS

| | | |
|---|---|---|
| CN | 1808768 | 7/2006 |
| CN | 1809947 | 7/2006 |
| CN | 1894825 | 1/2007 |
| CN | 101316004 | 12/2008 |
| CN | 101569057 | 10/2009 |
| CN | 101641827 | 2/2010 |
| JP | 2001-185938 | 7/2001 |
| JP | 2002-158529 | 5/2002 |
| JP | 2005-228785 | 8/2005 |
| JP | 2007-514357 | 5/2007 |
| JP | 2009-111999 | 5/2009 |
| JP | 2009-206847 | 9/2009 |
| JP | 2009-239463 | 10/2009 |
| JP | 2010-41359 | 2/2010 |
| JP | 4432254 | 3/2010 |
| WO | 2010/137061 | 12/2010 |

OTHER PUBLICATIONS

International Search Report issued Oct. 9, 2012 in International (PCT) Application No. PCT/JP2012/005535.

International Preliminary Report on Patentability and Written Opinion of the International Searching Authority issued Apr. 17, 2014 in International (PCT) Application No. PCT/JP2012/005537.

International Preliminary Report on Patentability and Written Opinion of the International Searching Authority issued Apr. 17, 2014 in International (PCT) Application No. PCT/JP2012/005535.

Office Action issued Feb. 17, 2015 in Chinese Application No. 201280003496.7, with English translation.

Office Action issued Feb. 27, 2015 in Chinese Application No. 201280003573.9, with English translation.

* cited by examiner

SMALL ANTENNA APPARATUS OPERABLE IN MULTIPLE BANDS INCLUDING LOW-BAND FREQUENCY AND HIGH-BAND FREQUENCY AND INCREASING BANDWIDTH INCLUDING HIGH-BAND FREQUENCY

TECHNICAL FIELD

The present disclosure relates to an antenna apparatus mainly for use in mobile communication such as mobile phones, and relates to a wireless communication apparatus provided with the antenna apparatus.

BACKGROUND ART

The size and thickness of portable wireless communication apparatuses, such as mobile phones, have been rapidly reduced. In addition, the portable wireless communication apparatuses have been transformed from apparatuses to be used only as conventional telephones, to data terminals for transmitting and receiving electronic mails and for browsing web pages of WWW (World Wide Web), etc. Further, since the amount of information to be handled has increased from that of conventional audio and text information to that of pictures and videos, a further improvement in communication quality is required. In such circumstances, there are proposed a multiband antenna apparatus and a compact antenna apparatus, supporting a plurality of wireless communication schemes. Further, there is proposed an array antenna apparatus capable of reducing electromagnetic coupling among antenna apparatuses each corresponding to the above mentioned one, and thus, performing high-speed wireless communication.

According to an invention of Patent Literature 1, a two-frequency antenna is characterized by having: a feeder, an inner radiation element connected to the feeder, and an outer radiation element, all of which are printed on a first surface of a dielectric board; an inductor formed in a gap between the inner radiation element and the outer radiation element printed on the first surface of the dielectric board to connect the two radiation elements; a feeder, an inner radiation element connected to the feeder, and an outer radiation element, all of which are printed on a second surface of the dielectric board; and an inductor formed in a gap between the inner radiation element and the outer radiation element printed on the second surface of the dielectric board to connect the two radiation elements. The two-frequency antenna of Patent Literature 1 is operable in multiple bands by forming a parallel resonant circuit from the inductor provided between the radiation elements and a capacitance between the radiation elements.

An invention of Patent Literature 2 is characterized by forming a looped radiation element, and bringing its open end close to a feeding portion to form a capacitance, thus a fundamental mode and its harmonic modes occur. By integrally forming a looped radiation element on a dielectric or magnetic block, it is possible to operate in multiple bands, while having a small size.

CITATION LIST

Patent Literature

PATENT LITERATURE 1: Japanese Patent Laid-open Publication No. 2001-185938

PATENT LITERATURE 2: Japanese Patent No. 4432254

SUMMARY OF INVENTION

Technical Problem

In recent years, there has been an increasing need to increase the data transmission rate on mobile phones, and thus, a next generation mobile phone standard, 3G-LTE (3rd Generation Partnership Project Long Term Evolution) has been studied. According to 3G-LTE, as a new technology for an increased the wireless transmission rate, it is determined to use a MIMO (Multiple Input Multiple Output) antenna apparatus using a plurality of antennas to simultaneously transmit or receive radio signals of a plurality of channels by spatial division multiplexing. The MIMO antenna apparatus uses a plurality of antennas at each of a transmitter and a receiver, and spatially multiplexes data streams, thus increasing a transmission rate. Since the MIMO antenna apparatus uses the plurality of antennas so as to simultaneously operate at the same frequency, electromagnetic coupling among the antennas becomes very strong under circumstances where the antennas are disposed close to each other within a small-sized mobile phone. When the electromagnetic coupling among the antennas becomes strong, the radiation efficiency of the antennas degrades. Therefore, received radio waves are weakened, resulting in a reduced transmission rate. Hence, it is necessary to provide a technique for reducing electromagnetic coupling among the antennas, by reducing the antennas' size to substantially increase the distance among the antennas. In addition, in order to implement spatial division multiplexing, it is necessary for the MIMO antenna apparatus to simultaneously transmit or receive a plurality of radio signals having a low correlation therebetween, by using different radiation patterns, polarization characteristics, or the like.

According to the two-frequency antenna of Patent Literature 1, if decreasing the low-band operating frequency, the size of the radiation elements should be increased. In addition, no contribution to radiation is made by slits between the inner radiation elements and the outer radiation elements.

The multiband antenna of Patent Literature 2 achieves the reduction of the antenna's size by providing a loop element on a dielectric or magnetic block. However, since the antenna's impedance decreases due to the dielectric or magnetic block, the radiation characteristics degrades in resonance frequency bands for the fundamental mode and its harmonic modes.

In addition, according to the configuration of the multiband antenna of Patent Literature 2, it is not possible to adjust only the low-band operating frequency. Therefore, it is desired to provide an antenna apparatus capable of easily adjusting its resonance frequency, and capable of achieving both multiband operation and size reduction.

In addition, according to the configuration of the multiband antenna of Patent Literature 2, it is not possible to increase the bandwidth of only the high operating frequency band. Therefore, it is desired to provide an antenna apparatus capable of easily increasing the bandwidth, and capable of achieving both multiband operation and size reduction.

The present disclosure solves the above-described problems, and provides an antenna apparatus capable of achieving both multiband operation and size reduction, and also provides a wireless communication apparatus provided with such an antenna apparatus.

Solution to Problem

According to an aspect of the present disclosure, an antenna apparatus is provided with at least one radiator and a ground conductor. Each radiator is provided with: a looped radiation conductor having an inner perimeter and an outer perimeter, the radiation conductor being provided with respect to a ground conductor such that a part of the radiation conductor is close to and electromagnetically coupled to the ground conductor; at least one capacitor inserted at a position along a loop of the radiation conductor; at least one inductor inserted at a position along the loop of the radiation conductor, the position of the inductor being different from the position of the capacitor; a feed point provided at a position on the radiation conductor, the position of the feed point being close to the ground conductor; and a dielectric block provided between the radiation conductor and the ground conductor, the dielectric block being provided in a portion where the radiation conductor and the ground conductor are close to each other, and the dielectric block provided along at least a part of the loop of the radiation conductor between the feed point and the capacitor. Each radiator is excited at a first frequency and at a second frequency higher than the first frequency. When each radiator is excited at the first frequency, a first current flows along a first path, the first path extending along the inner perimeter of the loop of the radiation conductor and including the inductor and the capacitor. When each radiator is excited at the second frequency, a second current flows through a second path including a section, the section extending along the outer perimeter of the loop of the radiation conductor, and the section including the capacitor but not including the inductor, and the section extending between the feed point and the inductor. When each radiator is excited at the second frequency, a parallel resonant circuit is formed from: a capacitance between the radiation conductor and the ground conductor which are close to each other and between which the dielectric block is provided; and an inductance of the radiation conductor. Each radiator is configured such that the loop of the radiation conductor, the inductor, and the capacitor resonate at the first frequency, and a portion of the loop of the radiation conductor included in the second path, the capacitor, and the parallel resonant circuit resonate at the second frequency.

Advantageous Effects of Invention

According to the antenna apparatus of the present disclosure, it is possible to provide an antenna apparatus operable in multiple bands, while having a simple and small configuration.

In addition, according to the antenna apparatus of the present disclosure, it is possible to increase the bandwidth of the operating band including the high-band resonance frequency.

DESCRIPTION OF EMBODIMENTS

Antenna apparatuses and wireless communication apparatuses according to embodiments will be described below with reference to the drawings. Like components are denoted by the same reference signs.

First Embodiment

Figure 1:
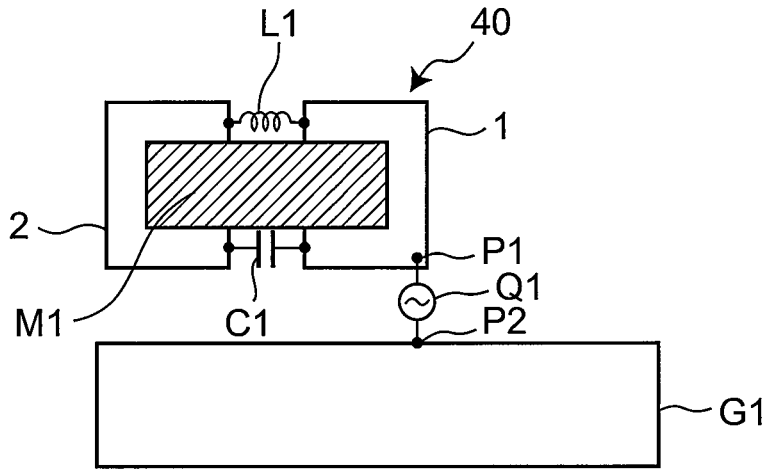
FIG. 1 is a schematic diagram showing an antenna apparatus according to a first embodiment.

FIG. 1 is a schematic diagram showing an antenna apparatus according to a first embodiment. The antenna apparatus of the present embodiment is characterized in that the antenna apparatus operates at dual bands, including a low-band resonance frequency f1 and a high-band resonance frequency f2, using a single radiator 40, and that the low-band resonance frequency f1 is being shifted to a lower frequency due to a magnetic block M1.

Referring to FIG. 1, the radiator 40 is provided with: a first radiation conductor 1 having a certain width and a certain electrical length; a second radiation conductor 2 having a certain width and a certain electrical length; a capacitor C1 connecting the radiation conductors 1 and 2 to each other at a position; and an inductor L1 connecting the radiation conductors 1 and 2 to each other at another position different from that of the capacitor C1. In the radiator 40, the radiation conductors 1 and 2, the capacitor C1, and the inductor L1 form a loop surrounding a central portion. In other words, the capacitor C1 is inserted at a position along the looped radiation conductor, and the inductor L1 is inserted at another position different from the position where the capacitor C1 is inserted. In addition, the radiator 40 is provided with the magnetic block M1 at at least a part of the inside of the looped radiation conductor. The looped radiation conductor has a width, and thus, has an inner perimeter close to the magnetic block M1, and an outer perimeter remote from the magnetic block M1. A signal source Q1 generates a radio frequency signal of the low-band resonance frequency f1 and a radio frequency signal of the high-band resonance frequency f2. The signal source Q1 is connected to a feed point P1 on the radiation conductor 1, and is connected to a connecting point P2 on a ground conductor G1 provided close to the radiator 40. The signal source Q1 schematically shows a wireless communication circuit connected to the antenna apparatus of FIG. 1, and excites the radiator 40 at one of the low-band resonance frequency f1 and the high-band resonance frequency f2. If necessary, a matching circuit (not shown) may be further connected between the antenna apparatus and the wireless communication circuit. In the radiator 40, a current path for the case where the radiator 40 is excited at the low-band resonance frequency f1 is different from a current path for the case where the radiator 40 is excited at the high-band resonance frequency f2, and thus, it is possible to effectively achieve dual-band operation.

As the magnetic block M1, it is possible to use a block made of material such as ferrite, nickel, or manganese suitable for radio frequencies, and having a relative permeability of, for example, about 5 to 60, but the magnetic block M1 is not limited to this example. In addition, as the magnetic block M1, it is possible to use a block having a thickness of about 0.5 to 2 mm. The frequency characteristics of the antenna apparatus are not much affected by the differences in size of the magnetic block M1, but mainly affected by the relative permeability of the magnetic block M1, as will be described later.

Figure 2:
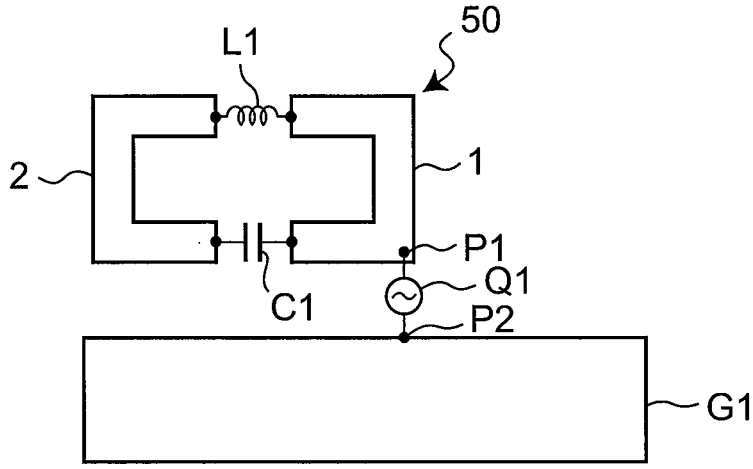
FIG. 2 is a schematic diagram showing an antenna apparatus according to a comparison example of the first embodiment.

FIG. 2 is a schematic diagram showing an antenna apparatus according to a comparison example of the first embodiment. The applicant of the present application proposed, in the International Application No. PCT/JP2012/000500, an antenna apparatus characterized by a single radiator operable in dual bands, and FIG. 2 shows that antenna apparatus. A radiator 50 of FIG. 2 has the same configuration as that of the radiator 40 of FIG. 1, except that the magnetic block M1 is removed. In the radiator 50, a current path for the case where the radiator 50 is excited at the low-band resonance frequency f1 is different from a current path for the case where the radiator 50 is excited at the high-band resonance frequency f2, and thus, it is possible to effectively achieve dual-band operation.

Figure 3:
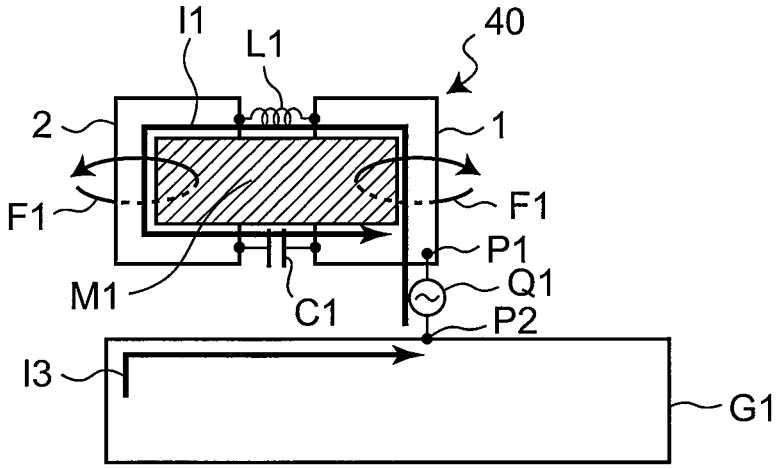
FIG. 3 is a diagram showing a current path for the case where the antenna apparatus of FIG. 1 operates at a low-band resonance frequency f1.

FIG. 3 is a diagram showing a current path for the case where the antenna apparatus of FIG. 1 operates at the low-band resonance frequency f1. By nature, a current having a low frequency component can pass through an inductor (low impedance), but is difficult to pass through a capacitor (high impedance). Hence, a current I1, for the case where the antenna apparatus operates at the low-band resonance frequency f1, flows along a path extending along the inner perimeter of the looped radiation conductor and including the inductor L1. Specifically, the current I1 flows through a portion of the radiation conductor 1 from the feed point P1 to a point connected to the inductor L1, passes through the inductor L1, and flows through a portion of the radiation conductor 2 from a point connected to the inductor L1, to a point connected to the capacitor C1. Further, due to the voltage difference across both ends of the capacitor, a current flows through a portion of the radiation conductor 1 from a point connected to the capacitor C1, to the feed point P1, and is connected to the current I1. Hence, it can be considered that the current I1 substantially also passes through the capacitor C1. The current I1 flows strongly along an edge of the inner perimeter of the looped radiation conductor, close to the magnetic block M1. Magnetic flux F1 produced by the current I1 passes through the magnetic block M1, and thus, the inductance of the looped radiation conductor increases. As a result, there is an effect that when the antenna apparatus operates at the low-band resonance frequency f1, an electrical length of the looped radiation conductor increases, and thus, the low-band resonance frequency f1 is shifted to the lower frequency, compared to the case without the magnetic block M1 (FIG. 2). In other words, it is substantially equivalent to the size reduction of the antenna apparatus. The larger the relative permeability of the magnetic block M1 is, the stronger the magnetic flux F1 is. Therefore, the larger the relative permeability of the magnetic block M1 is, the longer the electrical length of the looped radiation conductor is, and the more the low-band resonance frequency is shifted to the lower frequency.

In addition, when the antenna apparatus operates at the low-band resonance frequency f1, a current I3 flows along a portion of the ground conductor G1, the portion being close to the radiator 40, and flows toward the connecting point P2.

The radiator 40 is configured such that when the antenna apparatus operates at the low-band resonance frequency f1, the current I1 flows along the current path as shown in FIG. 3, and the looped radiation conductor, the inductor L1, and the capacitor C1 resonate at the low-band resonance frequency f1. Specifically, the radiator 40 is configured such that, taking into account the increased electrical length of the looped radiation conductor due to the magnetic block M1, the sum of the electrical length of the portion of the radiation conductor 1 from the feed point P1 to the point connected to the inductor L1, an electrical length of the portion of the radiation conductor 1 from the feed point P1 to the point connected to the capacitor C1, an electrical length of the inductor L1, an electrical length of the capacitor C1, and an electrical length of the portion of the radiation conductor 2 from the point connected to the inductor L1 to the point connected to the capacitor C1 is equal to an electrical length at which the antenna apparatus resonates at the low-band resonance frequency f1. The electrical length at which the antenna apparatus resonates is, for example, 0.2 to 0.25 times of an operating wavelength λ1 of the low-band resonance frequency f1. When the antenna apparatus operates at the low-band resonance frequency f1, the current I1 flows along the current path as shown in FIG. 3, and accordingly, the radiator 40 operates in a loop antenna mode, i.e., a magnetic current mode. Since the radiator 40 operates in the loop antenna mode, it is possible to achieve a long resonant length while maintaining a small size, thus achieving good characteristics even when the antenna apparatus operates at the low-band resonance frequency f1. In addition, when the radiator 40 operates in the loop antenna mode, the radiator 40 has a high Q value. The larger the diameter of the looped radiation conductor is, the more the radiation efficiency of the antenna apparatus improves.

Figure 4:
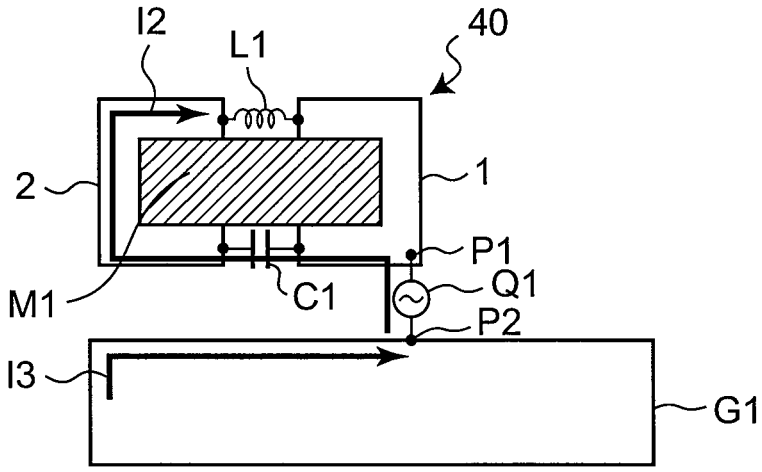
FIG. 4 is a diagram showing a current path for the case where the antenna apparatus of FIG. 1 operates at a high-band resonance frequency f2.

FIG. 4 is a diagram showing a current path for the case where the antenna apparatus of FIG. 1 operates at the high-band resonance frequency f2. By nature, a current having a high frequency component can pass through a capacitor (low impedance), but is difficult to pass through an inductor (high impedance). Hence, a current I2, for the case where the antenna apparatus operates at the high-band resonance frequency f2, flows along a path including a section, the section extending along the outer perimeter of the looped radiation conductor, and the section including the capacitor C1 but not including the inductor L1, and the section extending between the feed point P1 and the inductor L1. Specifically, the current I2 flows through a portion of the radiation conductor 1 from the feed point P1 to a point connected to the capacitor C1, passes through the capacitor C1, and flows through a portion of the radiation conductor 2 from a point connected to the capacitor C1, to a certain position (e.g., a point connected to the inductor L1). At this time, the current I2 strongly flows through the outer perimeter of the looped radiation conductor, and thus, is not strongly affected by the magnetic block M1. In general, magnetic materials such as ferrite cause losses in a high-frequency range. However, according to the antenna apparatus of the present embodiment, since the magnetic block M1 is provided only the inside of the looped radiation conductor, there is an effect that when the antenna apparatus operates at the high-band resonance frequency f2, it is possible to minimize the influence on the antenna characteristics.

In addition, when the antenna apparatus operates at the high-band resonance frequency f2, a current I3 flows along a portion of the ground conductor G1, the portion being close to the radiator 40, and flows toward the connecting point P2 (i.e., in the opposite direction to that of the current I2).

The radiator 40 is configured such that when the antenna apparatus operates at the high-band resonance frequency f2, the current I2 flows along the current path as shown in FIG. 4, and the portion of the looped radiation conductor, through which the current I2 flows, and the capacitor C1 resonate at the high-band resonance frequency f2. Specifically, the radiator 40 is configured such that the sum of an electrical length of the portion of the radiation conductor 1 from the feed point P1 to the point connected to the capacitor C1, an electrical length of the capacitor C1, and an electrical length of the portion of the radiation conductor 2 through which the current I2 flows (e.g., an electrical length of the portion of the radiation conductor 2 from the point connected to the capacitor C1 to the point connected to the inductor L1) is equal to an electrical length at which the antenna apparatus resonates at the high-band resonance frequency f2. The electrical length at which the antenna apparatus resonates is, for example, 0.25 times of an operating wavelength λ2 of the high-band resonance frequency f2. When the antenna apparatus operates at the high-band resonance frequency f2, the current I2 flows along the current path as shown in FIG. 4, and accordingly, the radiator 40 operates in a monopole antenna mode, i.e., an electric current mode.

As described above, the antenna apparatus of the present embodiment forms a current path passing through the inductor L1, when operating at the low-band resonance frequency f1, and forms a current path passing through the capacitor C1, when operating at the high-band resonance frequency f2, and thus, the antenna apparatus effectively achieves dual-band operation. The radiator 40 forms a looped current path, and thus, operates in a magnetic current mode, and resonates at the low-band resonance frequency f1. On the other hand, the radiator 40 forms a non-looped current path (monopole antenna mode), and thus, operates in an electric current mode, and resonates at the high-band resonance frequency f2. Further, since the antenna apparatus of the present embodiment is provided with the magnetic block M1, it is possible to easily adjust only the low-band resonance frequency so as to be shifted to the lower frequency. Since the low-band resonance frequency is being shifted to the lower frequency, it is possible to achieve substantial size reduction.

According to the prior art, when an antenna apparatus operates at the low-band resonance frequency f1 (operating wavelength λ1), an antenna element length of about (λ1)/4 is required. On the other hand, the antenna apparatus of FIG. 2 forms the looped current path, and accordingly, the lengths in the horizontal and vertical directions of the radiator 50 can be reduced to about (λ1)/15, and under ideal conditions, the lengths can be reduced to about (λ1)/25. Since the antenna apparatus of the present embodiment is provided with the magnetic block M1, it is possible to achieve further size reduction than that of the antenna apparatus of FIG. 2.

Now, a matching effect brought about by the inductor L1 and the capacitor C1 of the antenna apparatus of FIG. 1 will be described. The low-band resonance frequency f1 and the high-band resonance frequency f2 can be adjusted using a matching effect brought about by the inductor L1 and the capacitor C1 (particularly, a matching effect brought about by the capacitor C1). When the antenna apparatus operates at the low-band resonance frequency f1, the current flowing through the portion of the radiation conductor 2 from the point connected to the inductor L1 to the point connected to the capacitor C1, and the current flowing through the portion of the radiation conductor 1 from the point connected to the capacitor C1 to the feed point P1 are connected to the current flowing through the portion of the radiation conductor 1 from the feed point P1 to the point connected to the inductor L1, and accordingly, the looped current path is formed. Since the voltage difference appears across both ends of the capacitor C1 (on the side of the radiation conductor 1 and the side of the radiation conductor 2), there is an effect of controlling the reactance component of the input impedance of the antenna apparatus by the capacitance of the capacitor C1. The larger the capacitance of the capacitor C1, the lower the resonance frequency of the radiator 40. On the other hand, when the antenna apparatus operates at the high-band resonance frequency f2, the current flows through the portion of the radiation conductor 1 from the feed point P1 to the point connected to the capacitor C1, passes through the capacitor C1, and flows through the portion of the radiation conductor 2 from the point connected to the capacitor C1 to the point connected to the inductor L1. Since the capacitor C1 passes a high frequency component, reduction in the capacitance of the capacitor C1 results in a shortened electrical length, and thus, the resonance frequency of the radiator 40 shifts to a higher frequency. Since the voltage at the feed point P1 is the minimum in the radiator 40, the resonance frequency of the radiator 40 can be decreased by increasing a distance of the capacitor C1 from the feed point P1.

The antenna apparatus of the present embodiment can use 800 MHz band frequencies as the low-band resonance frequency f1, and use 2000 MHz band frequencies as the high-band resonance frequency f2, as will be described in implementation examples which will be described later. However, the frequencies are not limited thereto.

Each of the radiation conductors 1 and 2 is not limited to be shaped in a strip as shown in FIG. 1, etc., and may have any shape, as long as a certain electrical length can be obtained between the capacitor C1 and the inductor L1.

The radiation efficiency of the antenna apparatus is improved by forming a large loop in the radiator 40.

Since the antenna apparatus of the present embodiment is provided with the radiator 40 operable in one of the loop antenna mode and the monopole antenna mode according to the operating frequency, it is possible to effectively achieve dual-band operation, and achieve the size reduction of the antenna apparatus. Further, since the antenna apparatus of the present embodiment is provided with the magnetic block M1, it is possible to easily adjust only the low-band resonance frequency so as to be shifted to the lower frequency.

Figure 5:
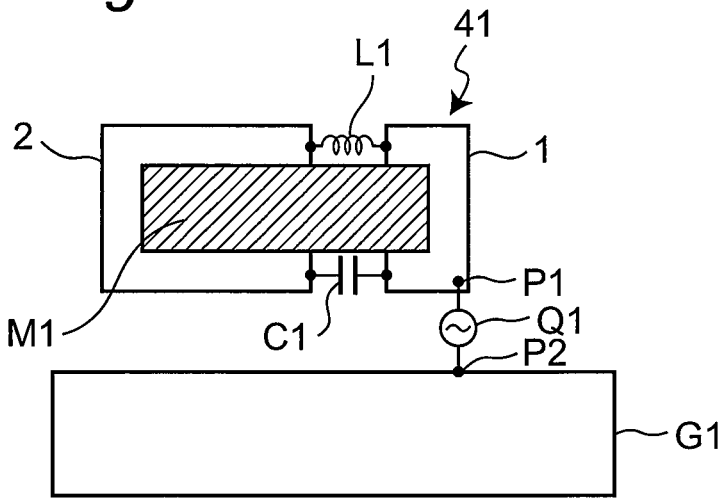
FIG. 5 is a schematic diagram showing an antenna apparatus according to a first modified embodiment of the first embodiment.
Figure 6:
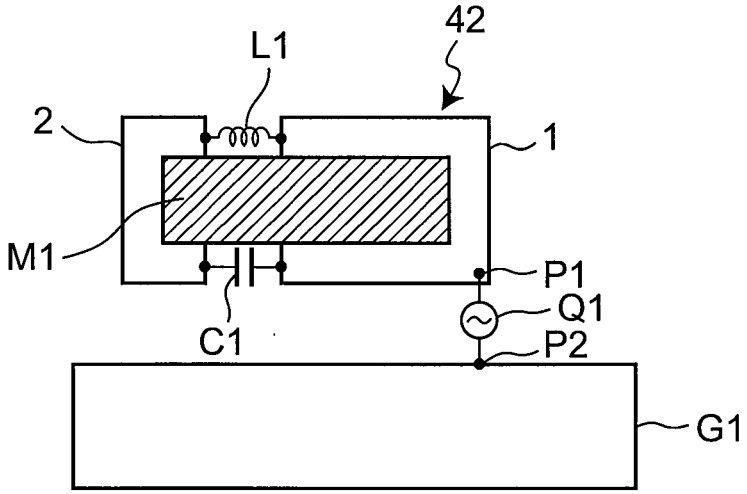
FIG. 6 is a schematic diagram showing an antenna apparatus according to a second modified embodiment of the first embodiment.

FIG. 5 is a schematic diagram showing an antenna apparatus according to a first modified embodiment of the first embodiment. FIG. 6 is a schematic diagram showing an antenna apparatus according to a second modified embodiment of the first embodiment. A method for adjusting the resonance frequency of the antenna apparatus can be summarized as follows. In order to reduce the low-band resonance frequency f1, for example, it is effective to increase the capacitance of the capacitor C1, increase the inductance of the inductor L1, increase the electrical length of the radiation conductor 1, increase the electrical length of the radiation conductor 2, etc. In order to reduce the high-band resonance frequency f2, for example, it is effective to increase the electrical length of the radiation conductor 2, provide the capacitor C1 at a position remote from the feed point P1, etc. FIG. 5 shows an antenna apparatus configured to reduce the low-band resonance frequency f1. The antenna apparatus of FIG. 5 has a reduced low-band resonance frequency f1 due to an increased electrical length of a radiation conductor 2. FIG. 6 shows an antenna apparatus configured to reduce the high-band resonance frequency f2. The antenna apparatus of FIG. 6 has a reduced high-band resonance frequency f2 due to an increased distance between a capacitor C1 and a feed point P1.

In order to surely change the operation of the antenna apparatus between the magnetic current mode and the electric current mode, it is necessary to provide a clear difference between the respective electrical lengths of the current paths for the cases where the antenna apparatus operates at the low-band resonance frequency f1 and the high-band resonance frequency f2. To this end, it is preferred that the electrical length of the radiation conductor 2 be longer than that of the radiation conductor 1. In addition, by reducing the electrical lengths on the radiation conductor 1 from the feed point P1 to the inductor L1 and from the feed point P1 to the capacitor C1, a current tends to flow from the feed point P1 to the inductor L1 when the antenna apparatus operates at the low-band resonance frequency f1, and a current tends to flow from the feed point P1 to the capacitor C1 when the antenna apparatus operates at the high-band resonance frequency f2, and thus, any current is less like to flow in unwanted directions.

Figure 7:
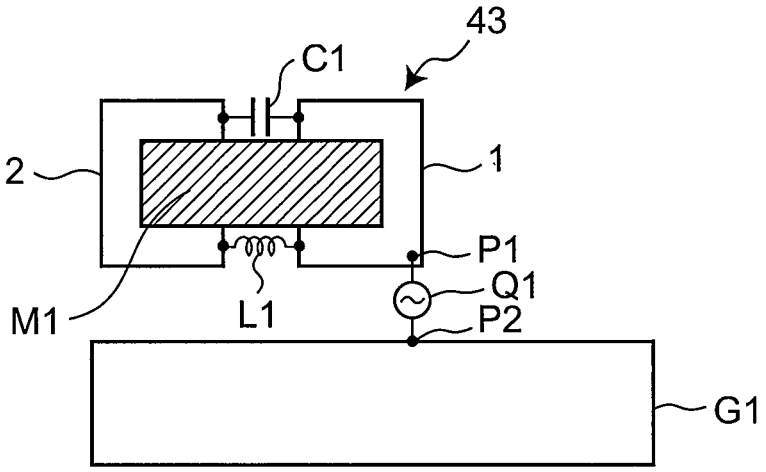
FIG. 7 is a schematic diagram showing an antenna apparatus according to a third modified embodiment of the first embodiment.

FIG. 7 is a schematic diagram showing an antenna apparatus according to a third modified embodiment of the first embodiment. According to the antenna apparatus of FIG. 1, the capacitor C1 is closer to the feed point P1 than the inductor L1. On the other hand, according to the antenna apparatus of FIG. 7, an inductor L1 is provided closer to a feed point P1 than a capacitor C1. Since the antenna apparatus of FIG. 7 is also provided with the radiator 43 operable in one of the loop antenna mode and the monopole antenna mode according to the operating frequency, it is possible to effectively achieve dual-band operation, and achieve the size reduction of the antenna apparatus. Further, since the antenna apparatus of FIG. 7 is also provided with the magnetic block M1, it is possible to easily adjust only the low-band resonance frequency so as to be shifted to the lower frequency.

Figure 8:
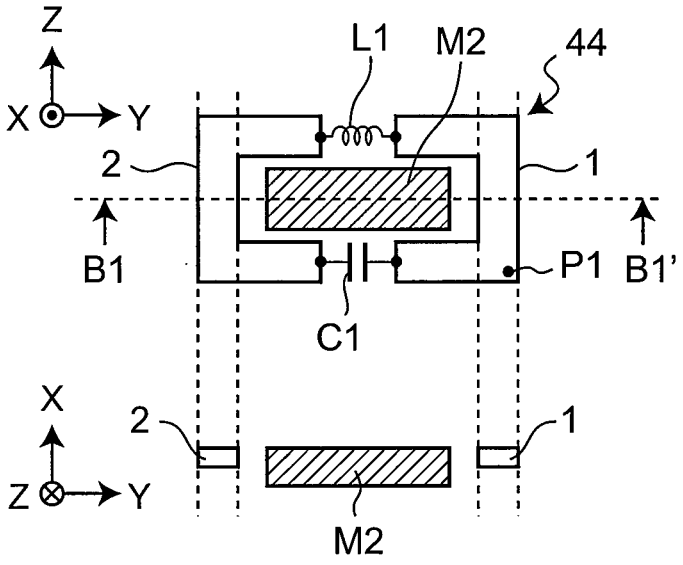
FIG. 8 is a schematic diagram showing a radiator 44 of an antenna apparatus according to a fourth modified embodiment of the first embodiment.

FIG. 8 is a schematic diagram showing a radiator 44 of an antenna apparatus according to a fourth modified embodiment of the first embodiment. The upper part of FIG. 8 shows a plan view of the radiator 44, and the lower part shows a cross-sectional view along line B1-B1' of the upper-part drawing. The antenna apparatus of FIG. 1 is provided with the magnetic block M1 in the entire inside of the looped radiation conductor. On the other hand, the radiator 44 of the antenna apparatus of FIG. 8 is provided with a magnetic block M2 only in a part of the inside of a looped radiation conductor. The magnetic block is not necessarily in contact with the inner perimeter of the looped radiation conductor, and may be provided only in a part of the inside of the looped radiation conductor, as long as the magnetic flux F1 shown in FIG. 3 passes through the magnetic block. Thus, it is possible to reduce the usage of magnetic material.

Figure 9:
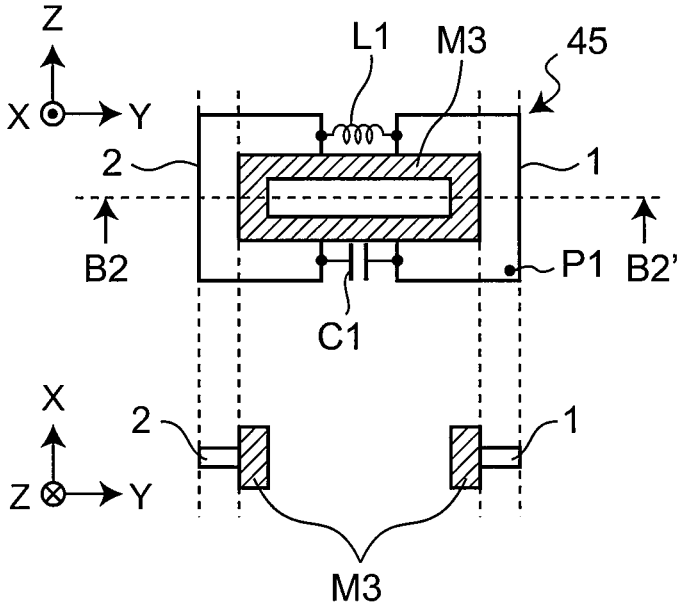
FIG. 9 is a schematic diagram showing a radiator 45 of an antenna apparatus according to a fifth modified embodiment of the first embodiment.

FIG. 9 is a schematic diagram showing a radiator 45 of an antenna apparatus according to a fifth modified embodiment of the first embodiment. The upper part of FIG. 9 shows a plan view of the radiator 45, and the lower part shows a cross-sectional view along line B2-B2' of the upper-part drawing. The radiator 45 of the antenna apparatus of FIG. 9 is provided with a magnetic block M3 having a central hollow portion. As described above, when the antenna apparatus operates at the low-band resonance frequency f1, the current strongly flows along the edge of the inner perimeter of the looped radiation conductor. By providing the magnetic block M3 so as to be close to the edge portion, magnetic flux is concentrated, and thus, the inductance of the looped radiation conductor is effectively increased. Therefore, according to the antenna apparatus of FIG. 9, while reducing the usage of magnetic material, when the antenna apparatus operates at the low-band resonance frequency f1, the electrical length of the looped radiation conductor effectively increases, and thus, the low-band resonance frequency is effectively shifted to the lower frequency.

Figure 10:
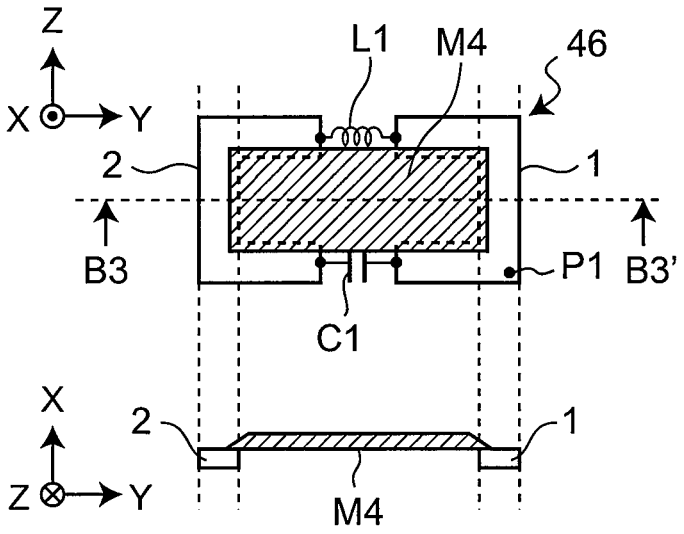
FIG. 10 is a schematic diagram showing a radiator 46 of an antenna apparatus according to a sixth modified embodiment of the first embodiment.

FIG. 10 is a schematic diagram showing a radiator 46 of an antenna apparatus according to a sixth modified embodiment of the first embodiment. The upper part of FIG. 10 shows a plan view of the radiator 46, and the lower part shows a cross-sectional view along line B3-B3' of the upper-part drawing. The radiator 46 of the antenna apparatus of FIG. 10 is provided with a magnetic block M4 made of a ferrite sheet. When a path of a current I2 for the case where the antenna apparatus operates at the high-band resonance frequency f2 is known in advance from an electromagnetic field analysis or the like, the magnetic block M4 can be provided so as to avoid the path of the current I2. The magnetic block M4 may overlap radiation conductors 1 and 2 as long as the magnetic block M4 does not overlap the path of the current I2. For example, a sheet magnetic block M4 may be attached on planar radiation conductors 1 and 2. Such a configuration provides a special advantageous effect of easy manufacturing. Further, even when the antenna apparatus operates at the high-band resonance frequency f2, the current I2 is not strongly affected by the magnetic block M4.

Figure 11:
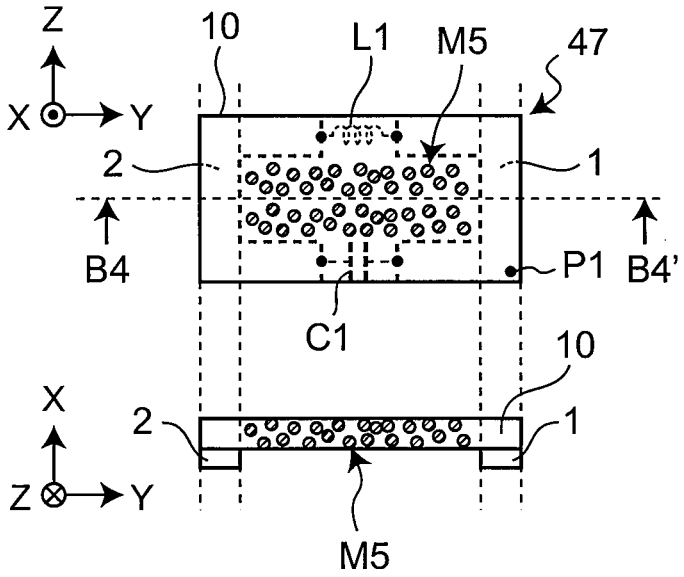
FIG. 11 is a schematic diagram showing a radiator 47 of an antenna apparatus according to a seventh modified embodiment of the first embodiment.

FIG. 11 is a schematic diagram showing a radiator 47 of an antenna apparatus according to a seventh modified embodiment of the first embodiment. The upper part of FIG. 11 shows a plan view of the radiator 47 integrally formed with a housing 10 of the antenna apparatus, and the lower part shows a cross-sectional view along line B4-B4' of the upper-part drawing. In the upper-part drawing of FIG. 11, radiation conductors 1 and 2, a capacitor C1, and an inductor L1 are shown in phantom seen from the top of the housing 10. In the radiator 47 of the antenna apparatus of FIG. 11, a magnetic block is formed by embedding magnetic material (e.g., magnetic powder M5) in a portion of the housing 10 close to the inner portion of a looped radiation conductor. A wireless terminal apparatus such as a mobile phone or a tablet terminal is usually provided with a housing made of resin such as ABS, within which an antenna apparatus is provided. In that case, by mixing the magnetic powder M5 into the material of the housing 10, it is possible to obtain the same effects as those obtained when using the magnetic block M1 of FIG. 1, etc. In this case, there is an advantageous effect of easily adjusting effective relative permeability by adjusting the concentration of magnetic powder upon manufacturing.

Instead of mixing the magnetic powder M5 into the material of the housing 10 as shown in FIG. 11, the magnetic powder M5 may be sprayed onto the housing 10, or a sheet magnetic material may be attached on the housing 10.

Second Embodiment

Figure 12:
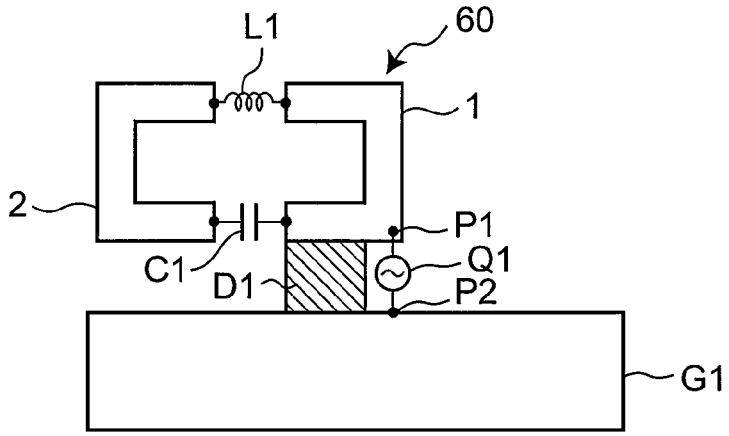
FIG. 12 is a schematic diagram showing an antenna apparatus according to a second embodiment.

FIG. 12 is a schematic diagram showing an antenna apparatus according to a second embodiment. The antenna apparatus of the present embodiment is characterized in that the antenna apparatus operates at dual bands, including low-band resonance frequency f1 and high-band resonance frequency f2, using a single radiator 60, and that the bandwidth of a high frequency operating band including the high-band resonance frequency f2 is increased due to a dielectric block D1.

Referring to FIG. 12, the radiator 60 is provided with radiation conductors 1 and 2, a capacitor C1, and an inductor L1, which are the same as those of a radiator 40 of FIG. 1. A looped radiation conductor has a width, and thus, has an inner perimeter close to a central hollow portion, and an outer perimeter remote from the central hollow portion. Further, the looped radiation conductor is provided with respect to a ground conductor G1 such that a part of the looped radiation conductor is close to and electromagnetically coupled to the ground conductor G1. A signal source Q1 generates a radio frequency signal of the low-band resonance frequency f1 and a radio frequency signal of the high-band resonance frequency f2, in a manner similar to that of the antenna apparatus of FIG. 1. The signal source Q1 is connected to a feed point P1 on the radiation conductor 1, and is connected to a connecting point P2 on the ground conductor G1 provided close to the radiator 60. The feed point P1 is provided at a position of the radiation conductor 1 close to the ground conductor G1. The radiator 60 is further provided with the dielectric block D1 between the radiation conductor 1 and the ground conductor G1, the dielectric block D1 being provided in a portion where the looped radiation conductor and the ground conductor G1 are close to each other, and the dielectric block D1 provided along at least a part of a portion of the radiation conductor 1 between the feed point P1 and the capacitor C1. In the radiator 60, a current path for the case where the radiator 60 is excited at the low-band resonance frequency f1 is different from a current path for the case where the radiator 60 is excited at the high-band resonance frequency f2, and thus, it is possible to effectively achieve dual-band operation.

Figure 13:
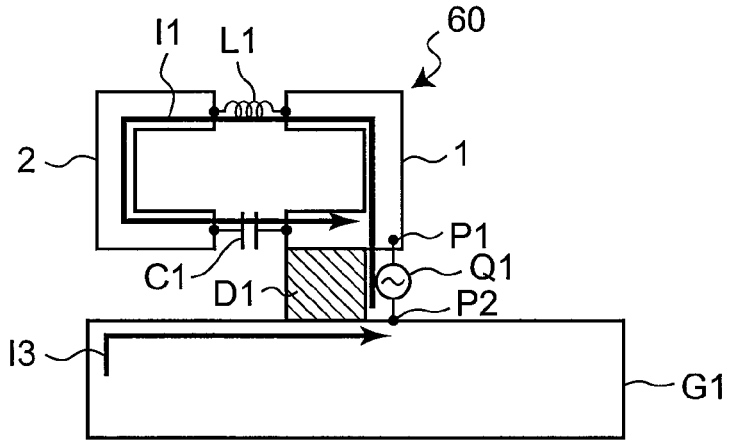
FIG. 13 is a diagram showing a current path for the case where the antenna apparatus of FIG. 12 operates at the low-band resonance frequency f1.

FIG. 13 is a diagram showing a current path for the case where the antenna apparatus of FIG. 12 operates at the low-band resonance frequency f1. As described with reference to FIG. 3, a current I1, for the case where the antenna apparatus operates at the low-band resonance frequency f1, flows along a path including the inductor L1 and extending along the inner perimeter of the looped radiation conductor. The radiator 60 is configured such that when the antenna apparatus operates at the low-band resonance frequency f1, the current I1 flows along a current path as shown in FIG. 13, and the looped radiation conductor, the inductor L1, and the capacitor C1 resonate at the low-band resonance frequency f1. Specifically, the radiator 60 is configured such that the sum of an electrical length of a portion of the radiation conductor 1 from the feed point P1 to a point connected to the inductor L1, an electrical length of a portion of the radiation conductor 1 from the feed point P1 to a point connected to the capacitor C1, an electrical length of the inductor L1, an electrical length of the capacitor C1, and an electrical length of a portion of the radiation conductor 2 from a point connected to the inductor L1, to a point connected to the capacitor C1 is equal to an electrical length at which the antenna apparatus resonates at the low-band resonance frequency f1. The electrical length at which the antenna apparatus resonates is, for example, 0.2 to 0.25 times of the operating wavelength λ1 of the low-band resonance frequency f1. When the antenna apparatus operates at the low-band resonance frequency f1, the current I1 flows along a current path as shown in FIG. 13, and accordingly, the radiator 60 operates in a loop antenna mode, i.e., a magnetic current mode.

Figure 14:
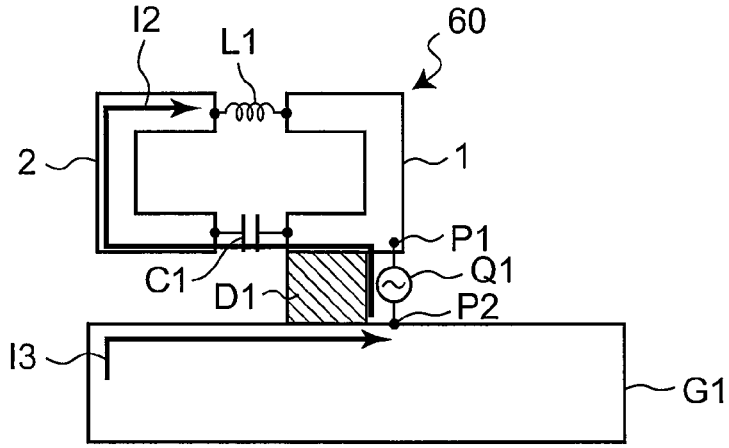
FIG. 14 is a diagram showing a current path for the case where the antenna apparatus of FIG. 12 operates at the high-band resonance frequency f2.
Figure 15:
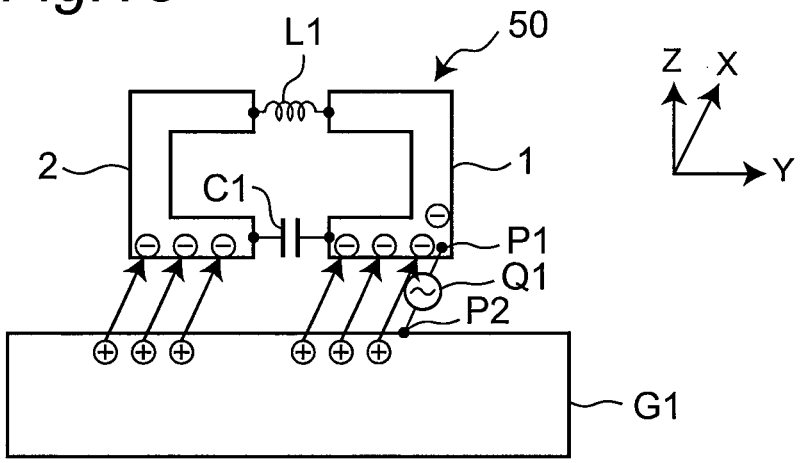
FIG. 15 is a perspective view showing a charge distribution for the case where the antenna apparatus of FIG. 2 operates at the high-band resonance frequency f2.
Figure 16:
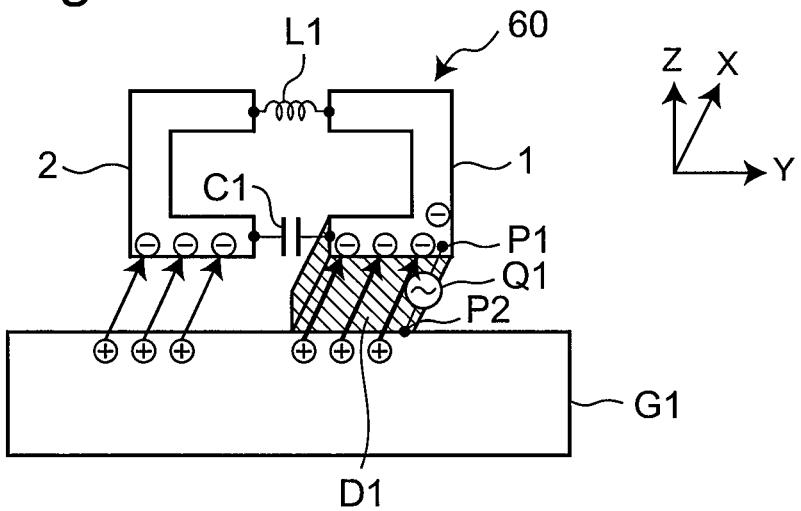
FIG. 16 is a perspective view showing a charge distribution for the case where the antenna apparatus of FIG. 12 operates at the high-band resonance frequency f2.

FIG. 14 is a diagram showing a current path for the case where the antenna apparatus of FIG. 12 operates at the high-band resonance frequency f2. As described with reference to FIG. 4, a current I2, for the case where the antenna apparatus operates at the high-band resonance frequency f2, flows along a path including a section, the section including the capacitor C1 but not including the inductor L1, and the section extending along the outer perimeter of the looped radiation conductor, and extending between the feed point P1 and the inductor L1. At this time, a current I3 flows through a portion of the ground conductor G1, the portion close to the radiator 60, and flows toward the connecting point P2 (i.e., in the opposite direction to that of the current I2). Therefore, the currents I2 and I3 of opposite phases flow through the portion where the looped radiation conductor and the ground conductor G1 are close to each other. FIG. 15 is a perspective view showing a charge distribution for the case where the antenna apparatus of FIG. 2 operates at the high-band resonance frequency f2. The antenna apparatus of FIG. 2 corresponds to one obtained by removing the dielectric block D1 from the antenna apparatus of FIG. 12. As the currents I2 and I3 flow, positive and negative charges are distributed over a portion where a looped radiation conductor and a ground conductor G1 are close to each other, as shown in FIG. 15, and electric flux is produced between the looped radiation conductor and the ground conductor G1. Thus, parallel capacitors is equivalently configured so as to be continuously distributed between the looped radiation conductor and the ground conductor G1. FIG. 16 is a perspective view showing a charge distribution for the case where the antenna apparatus of FIG. 12 operates at the high-band resonance frequency f2. As described above, the dielectric block D1 is provided between the radiation conductor 1 and the ground conductor G1, in a portion where the looped radiation conductor and the ground conductor G1 are close to each other, along at least a part of the portion of the radiation conductor 1 between the feed point P1 and the capacitor C1. The density of electric flux near the feed point P1 increases due to the dielectric block D1, and thus, the capacitance of capacitors between the looped radiation conductor and the ground conductor G1 substantially increases. A parallel resonant circuit is formed from: the capacitance between the radiation conductor 1 and the ground conductor G1 which are close to each other and between which the dielectric block D1 is provided; and the inductances of the radiation conductors 1 and 2. The radiator 60 is matched by the parallel resonant circuit.

Figure 17:
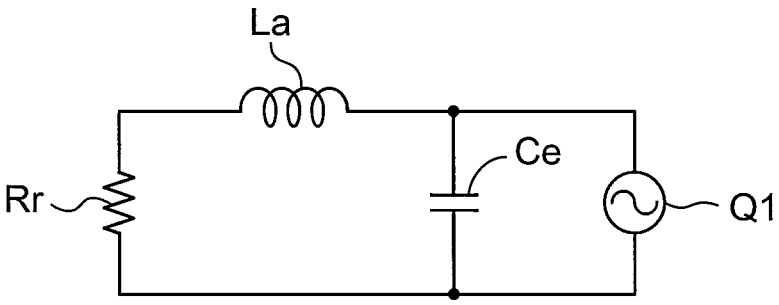
FIG. 17 is a diagram showing an equivalent circuit for the case where the antenna apparatus of FIG. 12 operates at the high-band resonance frequency f2.

FIG. 17 is a diagram showing an equivalent circuit for the case where the antenna apparatus of FIG. 12 operates at the high-band resonance frequency f2. When the antenna apparatus operates at the high-band resonance frequency f2, the current I2 flows as shown in FIG. 14. Therefore, the input impedance of the antenna apparatus can be represented by a radiation resistance Rr and an inductance La connected in series, and an equivalent capacitance Ce connected in parallel to the radiation resistance Rr and the inductance La. Consequently, the parallel resonant circuit is formed by the inductance La and the equivalent capacitance Ce, and thus, it is possible to increase the bandwidth of the high frequency operating band including the high-band resonance frequency f2.

The radiator 60 is configured such that when the antenna apparatus operates at the high-band resonance frequency f2, the current I2 flows along the current path as shown in FIG. 14, and a portion of the looped radiation conductor through which the current I2 flows, the capacitor C1, and the parallel resonant circuit resonate at the high-band resonance frequency f2. Specifically, the radiator 60 is configured such that, taking into account the above-described matching due to the parallel resonant circuit, the sum of an electrical length of a portion of the radiation conductor 1 from the feed point P1 to a point connected to the capacitor C1, an electrical length of the capacitor C1, and an electrical length of a portion of the radiation conductor 2 through which the current I2 flows (e.g., an electrical length of a portion of the radiation conductor 2 from a point connected to the capacitor C1, to a point connected to the inductor L1) is equal to an electrical length at which the antenna apparatus resonates at the high-band resonance frequency f2. The electrical length at which the antenna apparatus resonates is, for example, 0.25 times of the operating wavelength λ2 of the high-band resonance frequency f2. When the antenna apparatus operates at the high-band resonance frequency f2, the current I2 flows along the current path as shown in FIG. 14, and accordingly, the radiator 60 operates in a monopole antenna mode, i.e., an electric current mode.

In the antenna apparatus of FIG. 12, the dielectric block D1 is provided only along at least a part of the portion of the radiation conductor 1 between the feed point P1 and the capacitor C1, and is not provided at a portion remote from the feed point P1. It is possible to avoid reduction in radiation resistance, because the dielectric block is not provided at a portion close to an open end for the case where the radiator 60 operates in a monopole antenna mode.

It is possible to adjust the bandwidth of the antenna apparatus by changing the thickness and dielectric constant of the dielectric block D1 provided between the radiation conductor 1 and the ground conductor G1 of the antenna apparatus of FIG. 12, in a stepwise manner, according to its position.

As described above, the antenna apparatus of the present embodiment forms a current path passing through the inductor L1, when operating at the low-band resonance frequency f1, and forms a current path passing through the capacitor C1, when operating at the high-band resonance frequency f2, and thus, the antenna apparatus effectively achieves dual-band operation. The radiator 60 forms a looped current path, and thus, the radiator 60 operates in a magnetic current mode, and resonates at the low-band resonance frequency f1. On the other hand, the radiator 60 forms a non-looped current path (monopole antenna mode), and thus, the radiator 60 operates in an electric current mode, and resonates at the high-band resonance frequency f2. Further, since the antenna apparatus of the present embodiment is provided with the dielectric block D1, it is possible to increase the bandwidth of only the high frequency operating band including the high-band resonance frequency f2.

Figure 18:
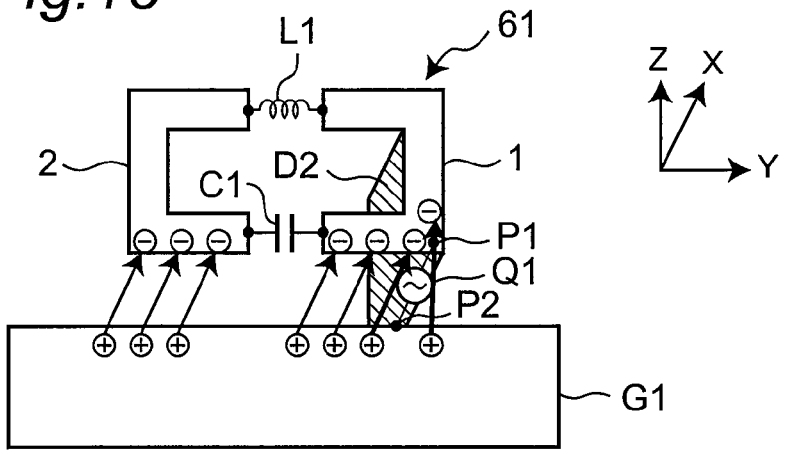
FIG. 18 is a perspective view showing an antenna apparatus according to a first modified embodiment of the second embodiment, and showing a charge distribution for the case where the antenna apparatus operates at the high-band resonance frequency f2.
Figure 19:
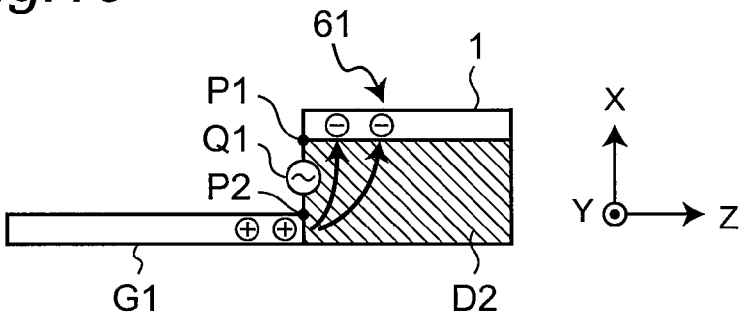
FIG. 19 is a side view showing a charge distribution for the case where the antenna apparatus of FIG. 18 operates at the high-band resonance frequency f2.

FIG. 18 is a perspective view showing an antenna apparatus according to a first modified embodiment of the second embodiment, and showing a charge distribution for the case where the antenna apparatus operates at the high-band resonance frequency f2. FIG. 19 is a side view showing a charge distribution for the case where the antenna apparatus of FIG. 18 operates at the high-band resonance frequency f2. According to the antenna apparatus of FIG. 12, the dielectric block D1 is provided over the entire portion of the radiation conductor 1 between the feed point P1 and the capacitor C1. However, a dielectric block may be provided between the radiation conductor 1 and the ground conductor G1, in a portion where the looped radiation conductor and the ground conductor G1 are close to each other, and along at least a part of a portion of the radiation conductor 1 between the feed point P1 and the capacitor C1. A radiator 61 of the antenna apparatus of FIGS. 18 and 19 is provided with a dielectric block D2, which is provided along only a small portion of a radiation conductor 1 between a feed point P1 and a capacitor C1. The antenna apparatus of FIGS. 18 and 19 can also increase the bandwidth of only the high frequency operating band including the high-band resonance frequency f2, by forming a parallel resonant circuit from: the capacitance between the radiation conductor 1 and a ground conductor G1 which are close to each other and between which the dielectric block D2 is provided; and the inductances of the radiation conductors 1 and 2, in a manner similar to that of the antenna apparatus of FIG. 12.

Figure 20:
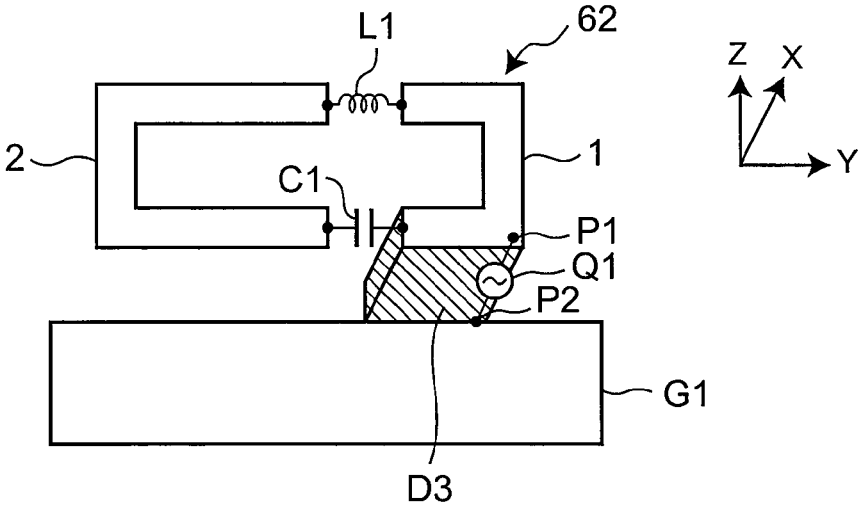
FIG. 20 is a perspective view showing an antenna apparatus according to a second modified embodiment of the second embodiment.
Figure 21:
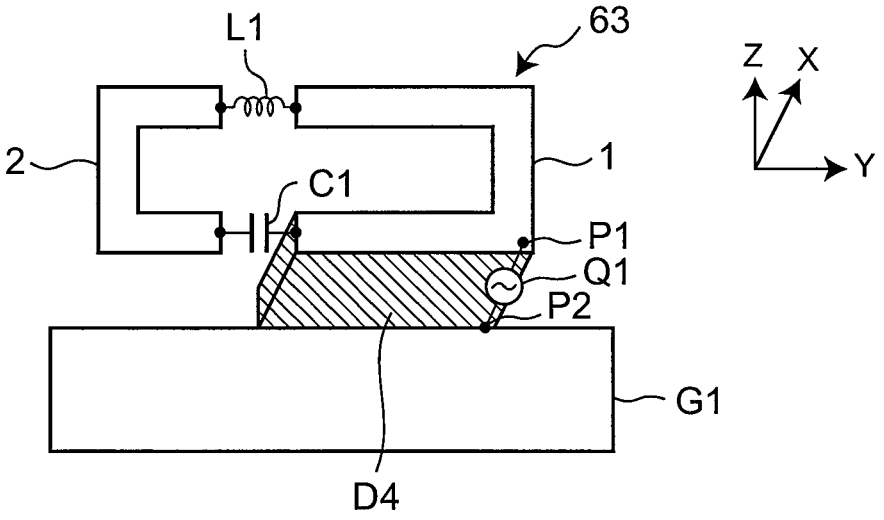
FIG. 21 is a perspective view showing an antenna apparatus according to a third modified embodiment of the second embodiment.
Figure 22:
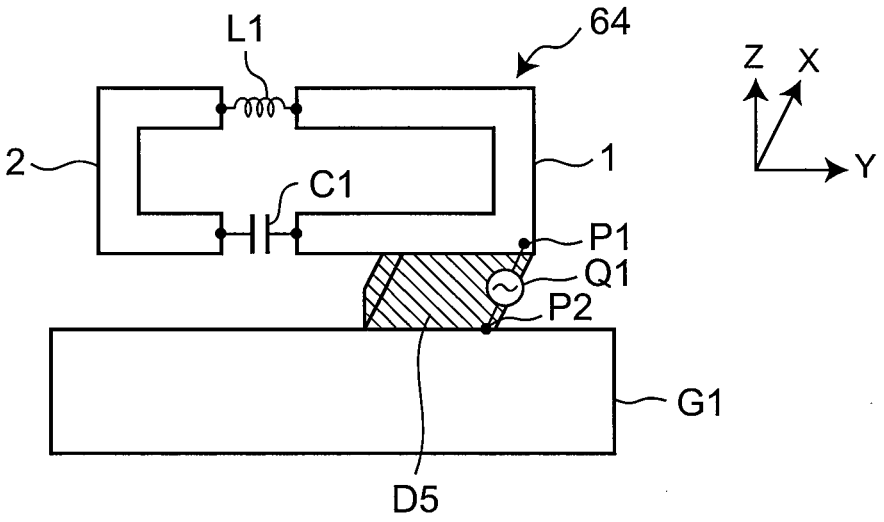
FIG. 22 is a perspective view showing an antenna apparatus according to a fourth modified embodiment of the second embodiment.

FIGS. 20 to 22 are perspective views showing antenna apparatuses according to second to fourth modified embodiments of the second embodiment. A radiator 62 of the antenna apparatus of FIG. 20 is provided with a dielectric block D3, a radiator 63 of the antenna apparatus of FIG. 21 is provided with a dielectric block D4, and a radiator 64 of the antenna apparatus of FIG. 22 is provided with a dielectric block D5. The dielectric block only needs to be provided between the radiation conductor 1 and the ground conductor G1, in a portion where the looped radiation conductor and the ground conductor G1 are close to each other, and along at least a part of a portion of the radiation conductor 1 between the feed point P1 and the capacitor C1. It is possible to use a dielectric block having a desired size according to capacitance between the radiation conductor 1 and the ground conductor G1 which are close to each other and between which the dielectric block D2 is provided, etc. The antenna apparatuses of FIGS. 20 to 22 can also increase the bandwidth of only the high frequency operating band including the high-band resonance frequency f2, by forming a parallel resonant circuit from: the capacitance between the radiation conductor 1 and the ground conductor G1 which are close to each other and between which the dielectric block D3, D4, or D5 is provided; and the inductances of the radiation conductors 1 and 2, in a manner similar to that of the antenna apparatus of FIG. 12.

Figure 23:
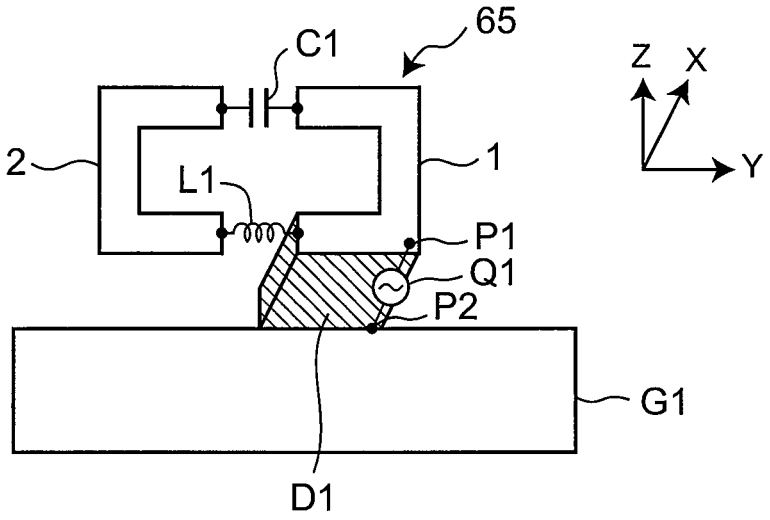
FIG. 23 is a perspective view showing an antenna apparatus according to a fifth modified embodiment of the second embodiment.
Figure 24:
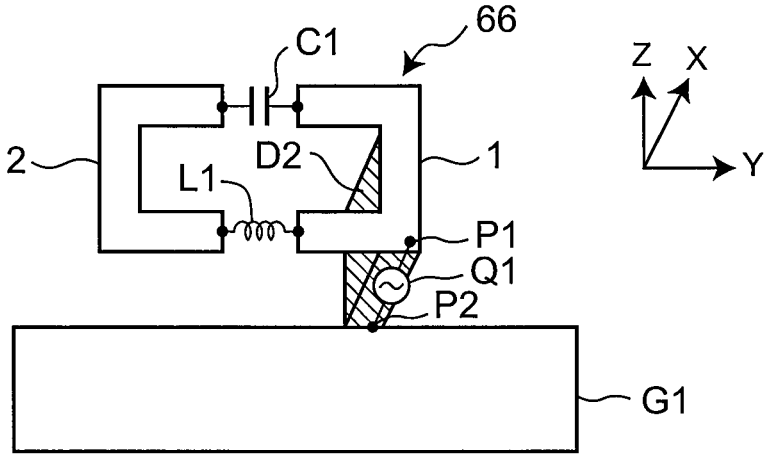
FIG. 24 is a perspective view showing an antenna apparatus according to a sixth modified embodiment of the second embodiment.

FIG. 23 is a perspective view showing an antenna apparatus according to a fifth modified embodiment of the second embodiment. FIG. 24 is a perspective view showing an antenna apparatus according to a sixth modified embodiment of the second embodiment. A radiator 65 of the antenna apparatus of FIG. 23 is provided with a dielectric block D1, and a radiator 66 of the antenna apparatus of FIG. 24 is provided with a dielectric block D2. According to the antenna apparatus of FIG. 12, the capacitor C1 is closer to the feed point P1 than the inductor L1. On the other hand, according to the antenna apparatuses of FIGS. 23 and 24, an inductor L1 is provided closer to a feed point P1 than a capacitor C1. Since the antenna apparatuses of FIGS. 23 and 24 is also provided with the radiators 65 and 66 operable in one of a loop antenna mode and a monopole antenna mode according to the operating frequency, it is possible to effectively achieve dual-band operation, and achieve the size reduction of the antenna apparatus. Further, since the antenna apparatuses of FIGS. 23 and 24 is provided with the dielectric blocks D1 and D2, it is possible to increase the bandwidth of only the high frequency operating band including the high-band resonance frequency f2.

The dielectric block only needs to be provided between the radiation conductor 1 and the ground conductor G1, in a portion where the looped radiation conductor and the ground conductor G1 are close to each other, and along at least a part of a portion of the radiation conductor 1 between the feed point P1 and the capacitor C1. Thus, there is an advantageous effect of reducing the usage of dielectric. In addition, the dielectric block may be partially provided along a portion of the radiation conductor 1 between the feed point P1 and the inductor L1, as long as the dielectric block is provided along at least a part of a portion of the radiation conductor 1 between the feed point P1 and the capacitor C1.

Figure 25:
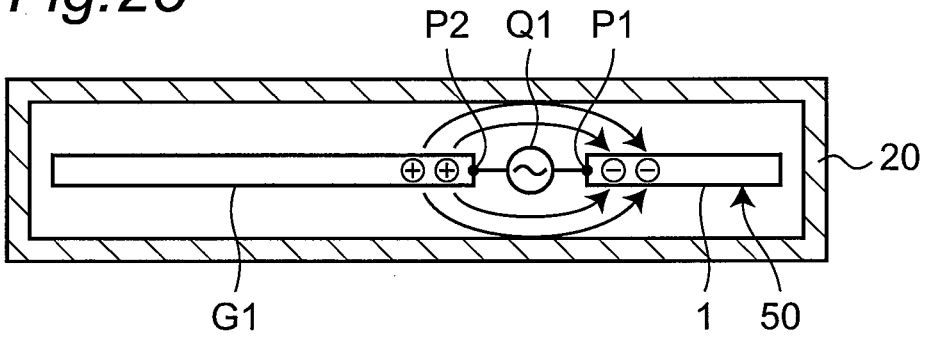
FIG. 25 is a side cross-sectional view showing an antenna apparatus according to a comparison example of the second embodiment.

Next, with reference to FIGS. 25 to 27, modified embodiments will be described in which a radiator and a ground conductor G1 are provided on the same plane. FIG. 25 is a side cross-sectional view showing an antenna apparatus according to a comparison example of the second embodiment. In the antenna apparatus of FIG. 25, a radiation conductor of a radiator 50 (only a radiation conductor 1 is shown) and a ground conductor G1 of an antenna apparatus of FIG. 2 are provided on the same plane, and further, the antenna apparatus is provided within a housing 20. As shown in FIG. 25, positive and negative charges are distributed at a portion where the radiation conductor of the radiator 50 and the ground conductor G1 are close to each other, and electric flux is produced between the radiation conductor of the radiator 50 and the ground conductor G1.

Figure 26:
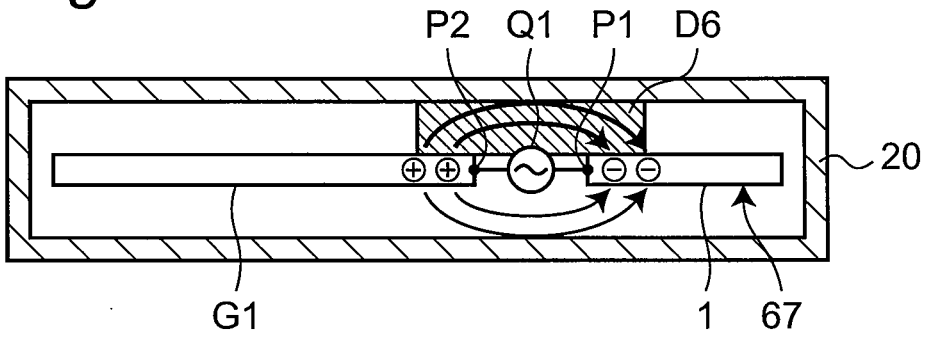
FIG. 26 is a side cross-sectional view showing an antenna apparatus according to a seventh modified embodiment of the second embodiment.

FIG. 26 is a side cross-sectional view showing an antenna apparatus according to a seventh modified embodiment of the second embodiment. A radiation conductor of a radiator 67 (only a radiation conductor 1 is shown) and a ground conductor G1 of the antenna apparatus of FIG. 26 are provided on the same plane. The radiator 67 is provided with a dielectric block D6 on one side of the plane, in a portion where the radiation conductor 1 and the ground conductor G1 are close to each other, and along at least a part of a portion of the radiation conductor 1 between a feed point P1 and a capacitor C1 (not shown). According to the antenna apparatus of FIG. 26, the density of electric flux near the feed point P1 increases due to the dielectric block D6, and thus, the capacitance of a capacitor between the radiation conductor 1 and the ground conductor G1 substantially increases, in a manner similar to that of the antenna apparatus of FIG. 12. A parallel resonant circuit is formed from: the capacitance between the radiation conductor 1 and the ground conductor G1 which are close to each other and between which the dielectric block D6 is provided; and the inductances of the radiation conductors 1 and 2.

Figure 27:
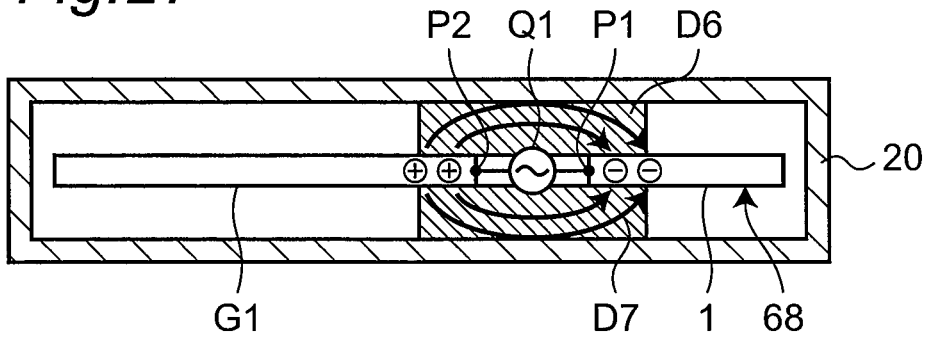
FIG. 27 is a side cross-sectional view showing an antenna apparatus according to an eighth modified embodiment of the second embodiment.

FIG. 27 is a side cross-sectional view showing an antenna apparatus according to an eighth modified embodiment of the second embodiment. A radiation conductor of a radiator 68 (only a radiation conductor 1 is shown) and a ground conductor G1 of the antenna apparatus of FIG. 27 are provided on the same plane. The radiator 68 is provided with a dielectric block D6 on one side of the plane and a dielectric block D7 provided on the other side of the plane, in a portion where the radiation conductor 1 and the ground conductor G1 are close to each other, and along at least a part of a portion of the radiation conductor 1 between a feed point P1 and a capacitor C1 (not shown). By using the two dielectric blocks D6 and D7, it is possible to more effectively increase the bandwidth of the high frequency operating band including the high-band resonance frequency f2, compared to the case of using one dielectric block D6. The dielectric constants of the dielectric blocks D6 and D7 may be the same, or may be different from each other. By using the dielectric blocks D6 and D7 with different dielectric constants, it is possible to improve flexibility in design.

A wireless terminal apparatus such as a mobile phone or a tablet terminal usually has a housing made of resin such as ABS. In the antenna apparatuses of FIGS. 26 and 27, a housing 20 made of dielectric with a certain dielectric constant may be used such that the housing 20 contributes to increased bandwidth in combination with a dielectric block(s).

In the antenna apparatuses of FIGS. 26 and 27, the dielectric blocks D6 and D7 may be attached to the housing 20. In this case, by attaching sheet dielectric blocks D6 and D7 to the housing 20, there is an advantageous effect of simplifying the assembly process of the antenna apparatus.

Third Embodiment

Figure 28:
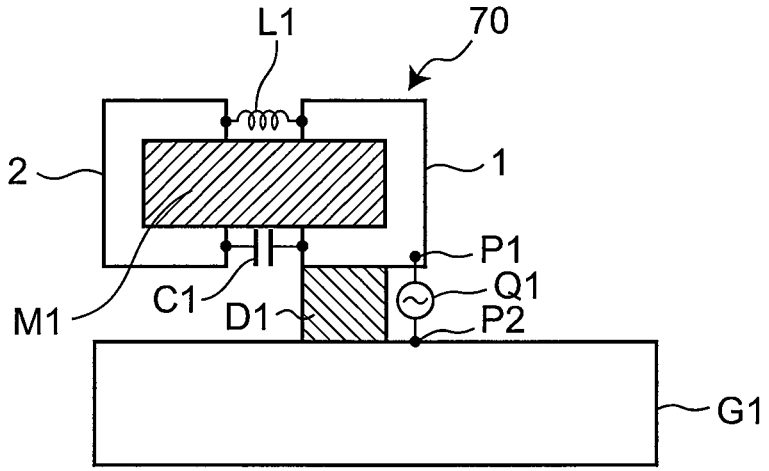
FIG. 28 is a schematic diagram showing an antenna apparatus according to a third embodiment.

FIG. 28 is a schematic diagram showing an antenna apparatus according to a third embodiment. A radiator 70 of the antenna apparatus of the present embodiment is characterized by both a magnetic block M1 of the first embodiment and a dielectric block D1 of the second embodiment. Since the antenna apparatus of the present embodiment is provided with the radiator 70 operable in one of a loop antenna mode and a monopole antenna mode according to the operating frequency, it is possible to effectively achieve dual-band operation, and achieve the size reduction of the antenna apparatus. Further, since the antenna apparatus of the present embodiment is provided the magnetic block M1, it is possible to easily adjust only the low-band resonance frequency so as to be shifted to the lower frequency. Further, since the antenna apparatus of the present embodiment is provided with the dielectric block D1, it is possible to increase the bandwidth of only the high frequency operating band including a high-band resonance frequency f2.

As to a capacitor C1 and an inductor L1, for example, it is possible to use discrete circuit elements, but the capacitor C1 and the inductor L1 are not limited thereto. With reference to FIGS. 29 to 35, modified embodiments of the capacitor C1 and the inductor L1 will be described below.

Figure 29:
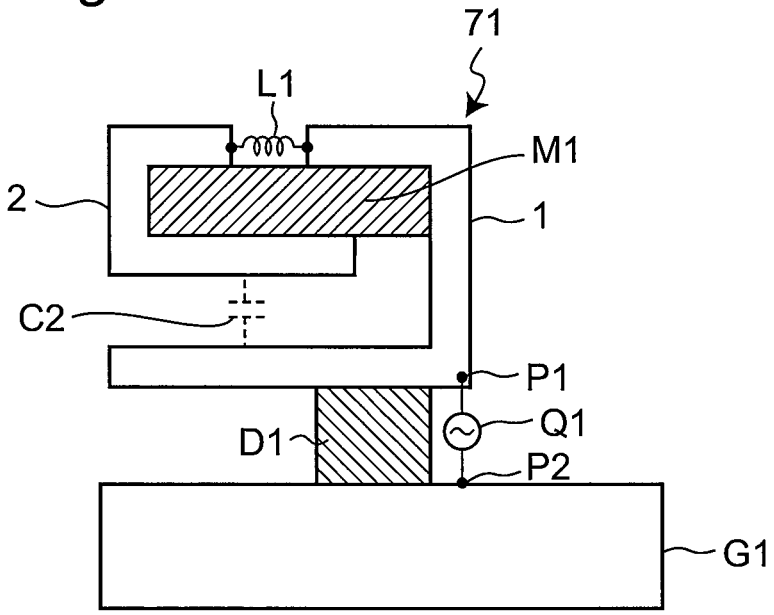
FIG. 29 is a schematic diagram showing an antenna apparatus according to a first modified embodiment of the third embodiment.
Figure 30:
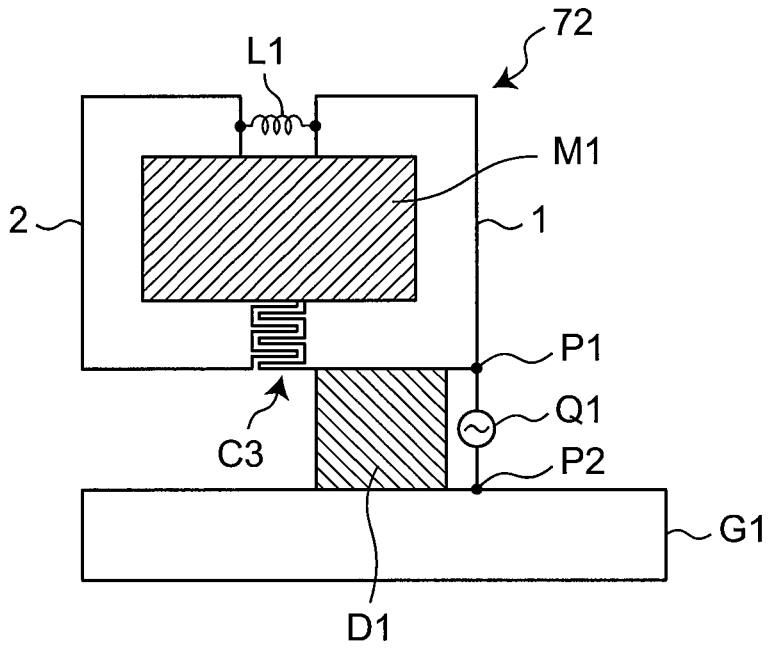
FIG. 30 is a schematic diagram showing an antenna apparatus according to a second modified embodiment of the third embodiment.

FIG. 29 is a schematic diagram showing an antenna apparatus according to a first modified embodiment of the third embodiment. A radiator 71 of the antenna apparatus of FIG. 29 includes pa capacitor C2 formed by portions of radiation conductors 1 and 2 close to each other. As shown in FIG. 29, a virtual capacitor C2 may be formed between the radiation conductors 1 and 2, by arranging the radiation conductors 1 and 2 close to each other to produce a certain capacitance between the radiation conductors 1 and 2. The closer the radiation conductors 1 and 2 approach to each other, or the wider the area where the radiation conductors 1 and 2 are close to each other increases, the more the capacitance of the virtual capacitor C2 increases. Further, FIG. 30 is a schematic diagram showing an antenna apparatus according to a second modified embodiment of the third embodiment. A radiator 72 of the antenna apparatus of FIG. 30 includes a capacitor C3 formed at portions of radiation conductors 1 and 2 close to each other. As shown in FIG. 30, when forming a virtual capacitor C3 by a capacitance between the radiation conductors 1 and 2, an interdigital conductive portion (a configuration in which fingered conductors are engaged alternately) may be formed. The capacitor C3 of FIG. 30 can have an increased capacitance than the capacitor C2 of FIG. 29. A capacitor formed by portions of the radiation conductors 1 and 2 close to each other is not limited to a linear conductive portion as shown in FIG. 29, or an interdigital conductive portion as shown in FIG. 30, and may be formed by conductive portions of other shapes. For example, the distance between the radiation conductors 1 and 2 of the antenna apparatus of FIG. 29 may be changed according to their positions, such that the capacitance between the radiation conductors 1 and 2 varies depending on the positions on the radiation conductors 1 and 2.

Figure 31:
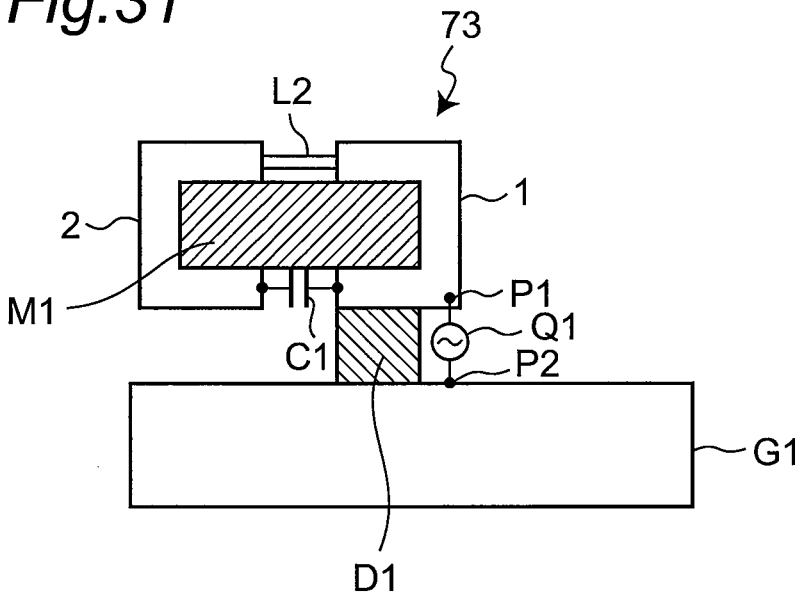
FIG. 31 is a schematic diagram showing an antenna apparatus according to a third modified embodiment of the third embodiment.
Figure 32:
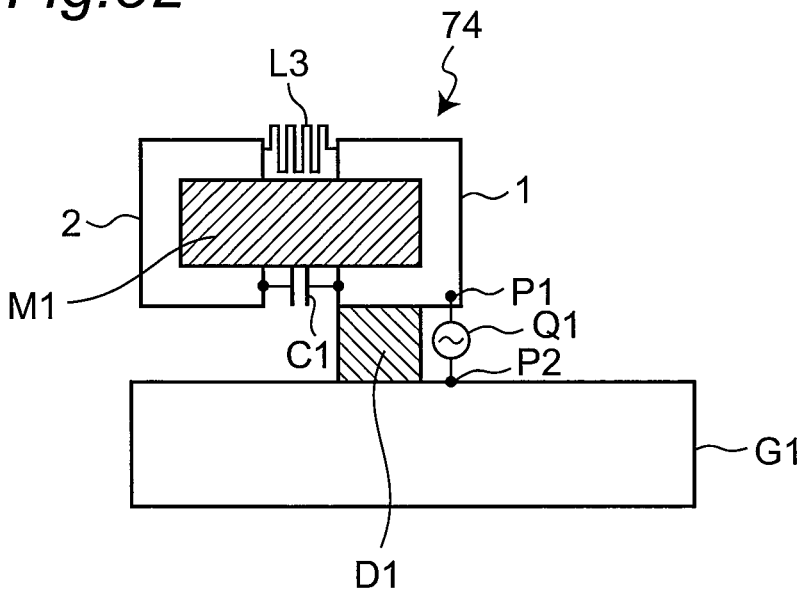
FIG. 32 is a schematic diagram showing an antenna apparatus according to a fourth modified embodiment of the third embodiment.

FIG. 31 is a schematic diagram showing an antenna apparatus according to a third modified embodiment of the third embodiment. A radiator 73 of the antenna apparatus of FIG. 31 includes an inductor L2 formed as a strip conductor. FIG. 32 is a schematic diagram showing an antenna apparatus according to a fourth modified embodiment of the third embodiment. A radiator 74 of the antenna apparatus of FIG. 32 includes an inductor L3 formed as a meander conductor. The thinner the widths of conductors forming the inductors L2 and L3 are, and the longer the lengths of the conductors are, the more the inductances of the inductors L2 and L3 increase.

The capacitors C2 and C3 and the inductors L2 and L3 shown in FIGS. 29 to 32 may be combined with each other.

For example, a radiator may be configured to include the capacitor C2 of FIG. 29 and the inductor L2 of FIG. 31, instead of the capacitor C1 and the inductor L1 of FIG. 28.

Figure 33:
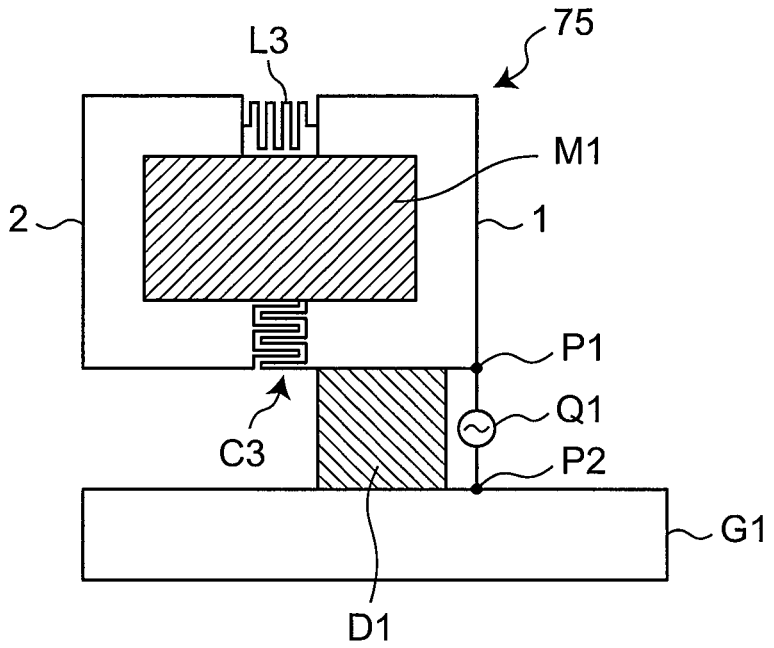
FIG. 33 is a schematic diagram showing an antenna apparatus according to a fifth modified embodiment of the third embodiment.

FIG. 33 is a schematic diagram showing an antenna apparatus according to a fifth modified embodiment of the third embodiment. A radiator 75 of the antenna apparatus of FIG. 33 includes a capacitor C3 formed at portions of radiation conductors 1 and 2 close to each other, and an inductor L3 formed as a meander conductor. According to the antenna apparatus of FIG. 33, since both the capacitor and the inductor can be formed as conductive patterns on a dielectric substrate, there are advantageous effects such as cost reduction and reduction in manufacturing variations.

Figure 34:
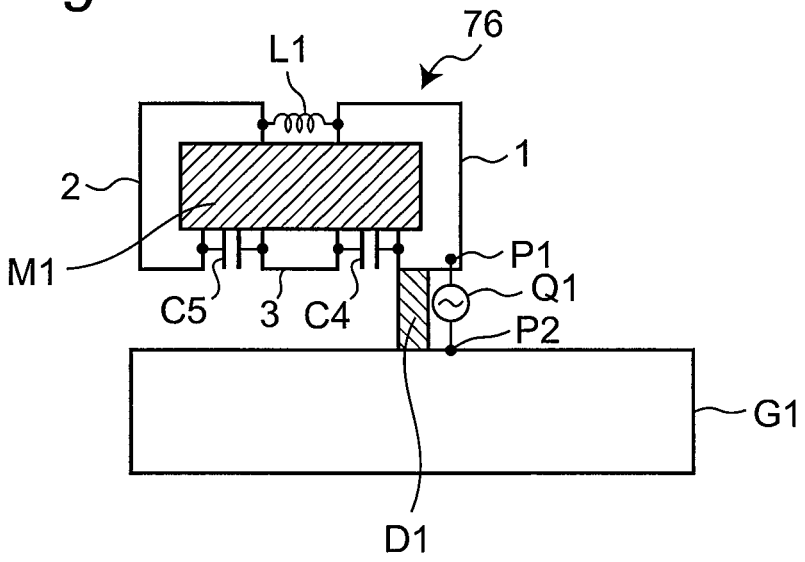
FIG. 34 is a schematic diagram showing an antenna apparatus according to a sixth modified embodiment of the third embodiment.
Figure 35:
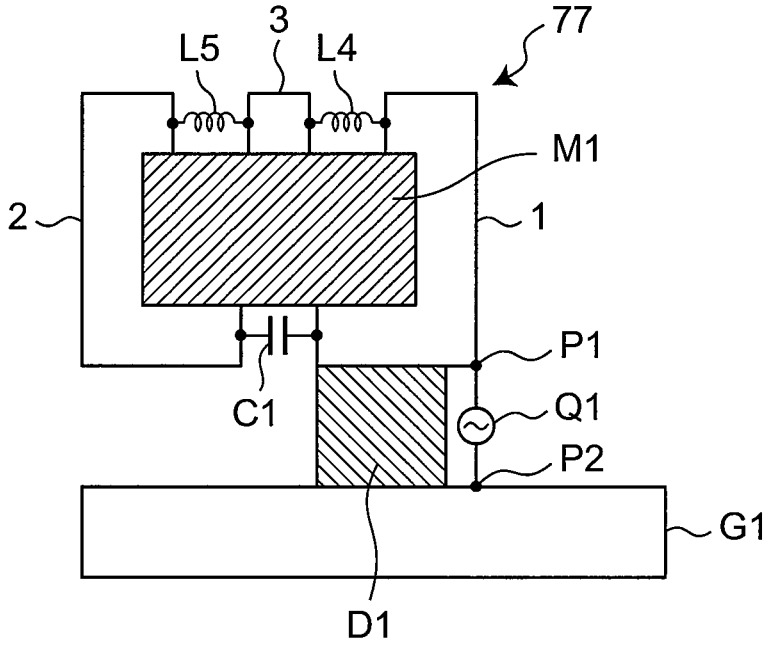
FIG. 35 is a schematic diagram showing an antenna apparatus according to a seventh modified embodiment of the third embodiment.

FIG. 34 is a schematic diagram showing an antenna apparatus according to a sixth modified embodiment of the third embodiment. A radiator 76 of the antenna apparatus of FIG. 34 includes a plurality of capacitors C4 and C5. An antenna apparatus of the present embodiment is not limited to one provided with a single capacitor and a single inductor, and may be provided with concatenated capacitors, including two or more capacitors, and/or provided with concatenated inductors, including two or more inductors. Referring to FIG. 34, the capacitors C4 and C5 connected to each other by a third radiation conductor 3 having a certain electrical length are inserted, instead of the capacitor C1 of FIG. 28. In other words, the capacitors C4 and C5 are inserted at different positions along a looped radiation conductor. Also in the case of including a plurality of inductors, the antenna apparatus is configured in a manner similar to that of the modified embodiment shown in FIG. 34. FIG. 35 is a schematic diagram showing an antenna apparatus according to a seventh modified embodiment of the third embodiment. A radiator 77 of the antenna apparatus of FIG. 35 includes a plurality of inductors L4 and L5. Referring to FIG. 35, the inductors L4 and L5 connected to each other by a third radiation conductor 3 having a certain electrical length are inserted, instead of the inductor L1 of FIG. 28. In other words, the inductors L4 and L5 are inserted at different positions along a looped radiation conductor. In a manner similar to that of the antenna apparatuses of FIGS. 34 and 35, a plurality of capacitors and a plurality of inductors may be inserted at different positions along the looped radiation conductor. According to the antenna apparatuses of FIGS. 34 and 35, since capacitors and inductors can be inserted at three or more different positions in consideration of the current distribution on the radiator, there is an advantageous effect that when designing the antenna apparatus, it is possible to easily achieve fine adjustments of the low-band resonance frequency f1 and the high-band resonance frequency f2.

Figure 36:
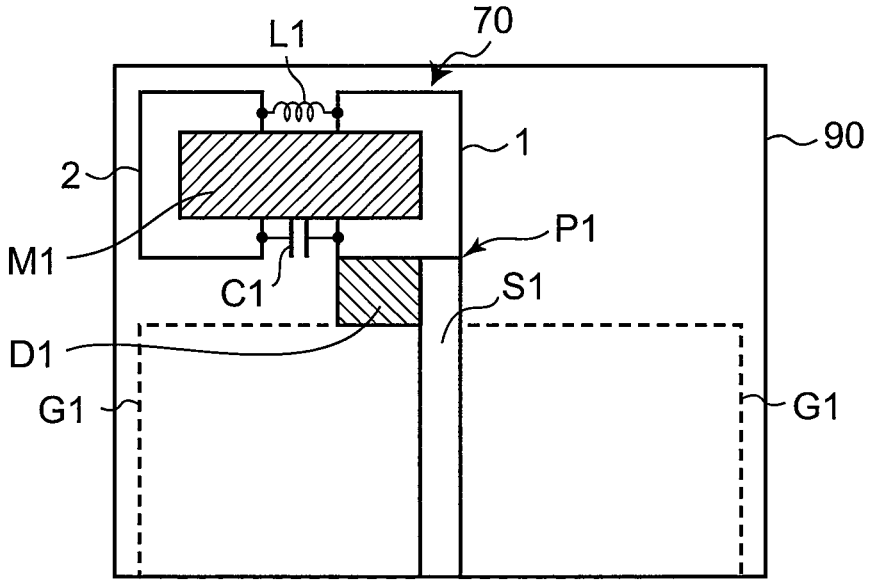
FIG. 36 is a schematic diagram showing an antenna apparatus according to an eighth modified embodiment of the third embodiment.

FIG. 36 is a schematic diagram showing an antenna apparatus according to an eighth modified embodiment of the third embodiment. FIG. 36 shows an antenna apparatus provided with a feed line as a microstrip line. The antenna apparatus of the present modified embodiment is provided with a feed line as a microstrip line, including a ground conductor G1, and a strip conductor S1 provided on the ground conductor G1 with a dielectric substrate 90 therebetween. The antenna apparatus of the present modified embodiment may have a planar configuration for reducing the profile of the antenna apparatus, in other words, the ground conductor G1 may be formed on the back side of a printed circuit board, and the strip conductor S1 and a radiator 70 may be integrally formed on the front side of the printed circuit board. The feed line is not limited to a microstrip line, and may be a coplanar line, a coaxial line, etc.

Figure 37:
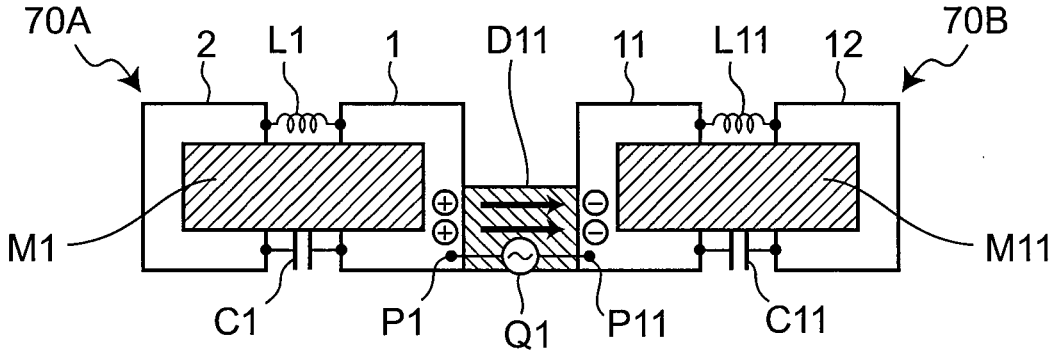
FIG. 37 is a schematic diagram showing an antenna apparatus according to a ninth modified embodiment of the third embodiment.

FIG. 37 is a schematic diagram showing an antenna apparatus according to a ninth modified embodiment of the third embodiment. FIG. 37 shows an antenna apparatus configured as a dipole antenna. A left radiator 70A of FIG. 37 is configured in the similar manner as that of the radiator 70 of FIG. 28, except for the dielectric block D1. A right radiator 70B of FIG. 37 is also configured in the similar manner as that of the radiator 70 of FIG. 28, except for the dielectric block D1, and the radiator 70B is provided with a first radiation conductor 11, a second radiation conductor 12, a capacitor C11, and an inductor L11. The radiators 70A and 70B are provided adjacent to each other so as to have portions close to each other and electromagnetically coupled to each other. A feed point P1 of the radiator 70A and a feed point P11 of the radiator 70B are provided close to each other. A signal source Q1 is connected to the feed point P1 of the radiator 70A and to the feed point P11 of the radiator 70B, respectively. The antenna apparatus is further provide with a dielectric block D11 provided between a radiation conductor 1 of the radiator 70A and the radiation conductor 11 of the radiator 70B, in a portion where the radiation conductor 1 of the radiator 70A and the radiation conductor 11 of the radiator 70B are close to each other, and along at least a part of a portion of the radiation conductor 1 between the feed point P1 and a capacitor C1, and along at least a part of a portion of the radiation conductor 11 between the feed point P11 and the capacitor C11. When the antenna apparatus operates at the high-band resonance frequency f2, a parallel resonant circuit is formed from: the capacitance between the radiation conductors 1 and 11 which are close to each other and between which the dielectric block D11 is provided; and the inductances of the radiation conductors 1, 2, 11, and 12, in a manner similar to that of the antenna apparatus of FIG. 12. Therefore, the antenna apparatus of FIG. 37 is substantially configured to include the radiator 70B instead of the ground conductor G1 of FIG. 28. The antenna apparatus of the present modified embodiment has a dipole configuration, and accordingly, is operable in a balance mode, thus suppressing unwanted radiation.

Figure 38:
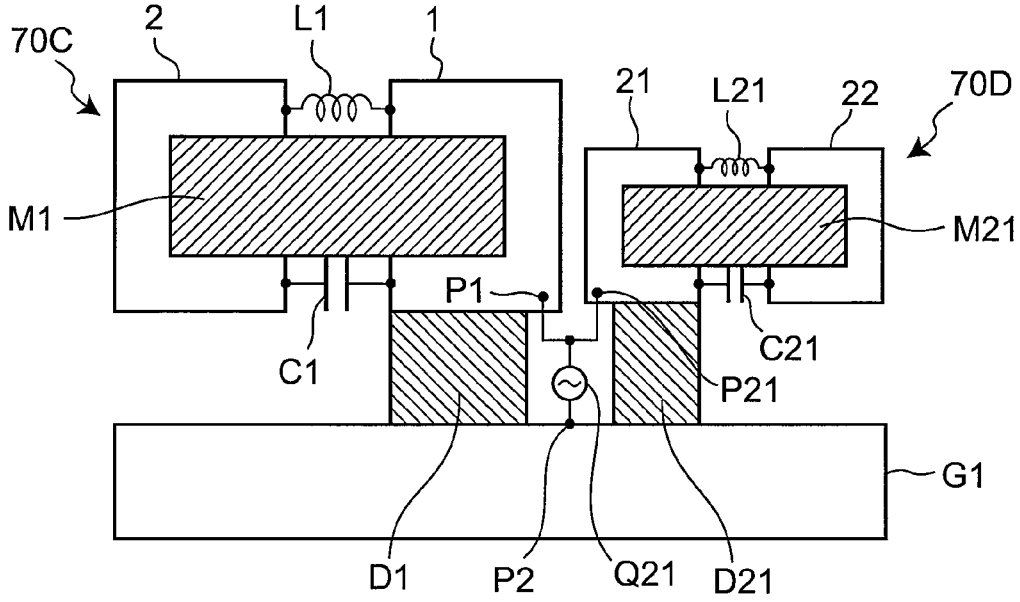
FIG. 38 is a schematic diagram showing an antenna apparatus according to a tenth modified embodiment of the third embodiment.

FIG. 38 is a schematic diagram showing an antenna apparatus according to a tenth modified embodiment of the third embodiment. FIG. 38 shows a multiband antenna apparatus operable in four bands. A left radiator 70C of FIG. 38 is configured in the similar manner as that of the radiator 70 of FIG. 28. A right radiator 70D of FIG. 38 is also configured in the similar manner as that of the radiator 70 of FIG. 28, and the radiator 70D is provided with a first radiation conductor 21, a second radiation conductor 22, a capacitor C21, and an inductor L21, and further is provided with a magnetic block M21 and a dielectric block D21. However, an electrical length of a loop formed by the radiation conductors 21 and 22, the capacitor C21, and the inductor L21 of the radiator 70D is different from an electrical length of a loop formed by radiation conductors 1 and 2, a capacitor C1, and an inductor L1 of the radiator 70C. A signal source Q21 is connected to a feed point P1 on the radiation conductor 1, a feed point P21 on the radiation conductor 21, and a connecting point P2 on a ground conductor G1. The signal source Q21 generates a radio frequency signal of the low-band resonance frequency f1 and a radio frequency signal of the high-band resonance frequency f2, and generates a radio frequency signal of another low-band resonance frequency f21 different from the low-band resonance frequency f1, and a radio frequency signal of another high-band resonance frequency f22 different from the high-band resonance frequency f2. The radiator 70C operates in a loop antenna mode at the low-band resonance frequency f1, and operates in a monopole antenna mode at the high-band resonance frequency f2. On the other hand, the radiator 70D operates in a loop antenna mode at the low-band resonance frequency f21, and operates in a monopole antenna mode at the high-band resonance frequency f22. Thus, the antenna apparatus of the present modified embodiment is capable of multiband operation in four bands. The antenna apparatus of the present modified embodiment can achieve further multiband operation by further providing a radiator.

Further, as another modified embodiment, an antenna apparatus according to the present embodiment can be configured as an inverted-F antenna apparatus, for example, by providing a radiator including planar or linear radiation conductors in parallel with a ground conductor, and short-circuiting a part of the radiator to the ground conductor (not shown). Short-circuiting a part of the radiator to the ground conductor results in an increased radiation resistance, and it does not impair the basic operating principle of the antenna apparatus according to the present embodiment.

The antenna apparatuses according to the modified embodiments of the third embodiment described with reference to FIGS. 29 to 38 may be provided with only one of a magnetic block and a dielectric block. In the case of having only a magnetic block, it is possible to easily adjust only the low-band resonance frequency so as to be shifted to the lower frequency, in a manner similar to that of the first embodiment. In the case of having only the dielectric blocks, it is possible to increase the bandwidth of only the high frequency operating band including the high-band resonance frequency f2, in a manner similar to that of the second embodiment.

Fourth Embodiment

Figure 39:
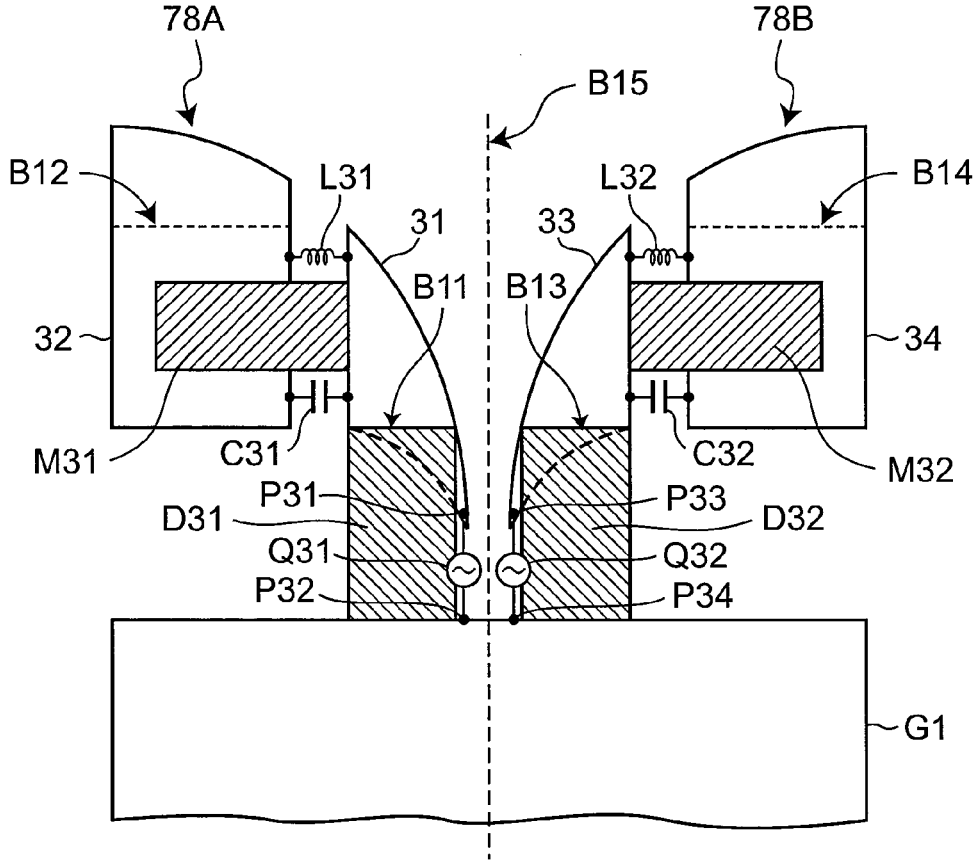
FIG. 39 is a schematic diagram showing an antenna apparatus according to a fourth embodiment.

FIG. 39 is a schematic diagram showing an antenna apparatus according to a fourth embodiment. The antenna apparatus of the present embodiment is characterized in that the antenna apparatus includes two radiators 78A and 78B configured according to the similar principle as that of a radiator 70 of FIG. 28, and the radiators 78A and 78B are independently excited by different signal sources Q31 and Q32.

Referring to FIG. 39, the radiator 78A is provided with: a first radiation conductor 31 having a certain electrical length; a second radiation conductor 32 having a certain electrical length; a capacitor C31 connecting the radiation conductors 31 and 32 to each other at a certain position; and an inductor L31 connecting the radiation conductors 31 and 32 to each other at a position different from that of the capacitor C31. In the radiator 78A, the radiation conductors 31 and 32, the capacitor C31, and the inductor L31 form a loop surrounding a central portion. In other words, the capacitor C31 is inserted at a position along the looped radiation conductor, and the inductor L31 is inserted at another position along the looped radiation conductor different from the position where the capacitor C31 is inserted. The signal source Q31 is connected to a feed point P31 on the radiation conductor 31, and is connected to a connecting point P32 on a ground conductor G1 provided close to the radiator 78A. In the antenna apparatus of FIG. 39, the capacitor C31 is provided closer to the feed point P31 than the inductor L31. The radiator 78A is further provided with a magnetic block M31 and a dielectric block D31, in a manner similar to that of a magnetic block M1 and a dielectric block D1 of an antenna apparatus of FIG. 28. The radiator 78B is configured in the similar manner as that of the radiator 78A, and is provided with a first radiation conductor 33, a second radiation conductor 34, a capacitor C32, and an inductor L32. In the radiator 78B, the radiation conductors 33 and 34, the capacitor C32, and the inductor L32 form a loop surrounding a central portion. The signal source Q32 is connected to a feed point P33 on the radiation conductor 33, and is connected to a connecting point P34 on the ground conductor G1 provided close to the radiator 78B. In the antenna apparatus of FIG. 39, the capacitor C32 is provided closer to the feed point P33 than the inductor L32. The radiator 78B is further provided with a magnetic block M32 and a dielectric block D32, in a manner similar to that of the radiator 78A. The signal sources Q31 and Q32 generate, for example, radio frequency signals as transmitting signals of MIMO communication scheme, and generate radio frequency signals of the same low-band resonance frequency f1, and generate radio frequency signals of the same high-band resonance frequency f2.

The looped radiation conductors of the radiators 78A and 78B are formed, for example, symmetrically with respect to a reference axis B15. The radiation conductors 31 and 33 and feed portions (the feed points P31 and P33 and the connecting points P32 and P34) are provided close to the reference axis B15, and the radiation conductors 32 and 34 are provided remote from the reference axis B15. The feed points P31 and P33 are provided at positions symmetrical with respect to the reference axis B15. It is possible to reduce the electromagnetic coupling between the radiators 78A and 78B by shaping radiators 78A and 78B such that a distance between the radiators 78A and 78B gradually increases as a distance from the feed points P31 and P33 along the reference axis B15 increases. Further, since the distance between the two feed points P31 and P33 is small, it is possible to minimize an area for placing traces of feed lines from a wireless communication circuit (not shown).

Figure 40:
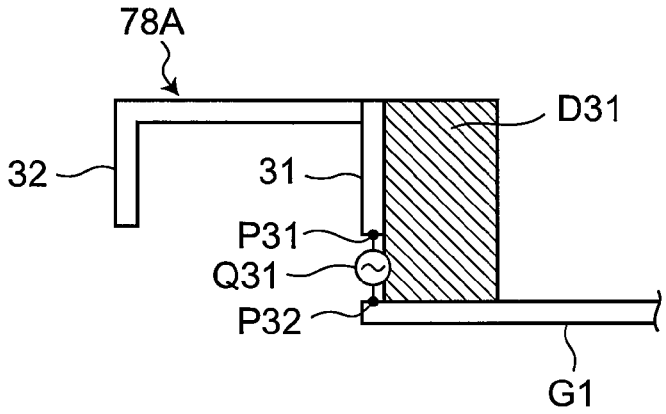
FIG. 40 is a side view showing an antenna apparatus according to a first modified embodiment of the fourth embodiment.

FIG. 40 is a side view showing an antenna apparatus according to a first modified embodiment of the fourth embodiment. In order to reduce the size of the antenna apparatus, any of the radiation conductors 31 to 34 may be bent at at least one position. For example, as shown in FIG. 40, the radiation conductors 31 and 32 may be bent at the positions of lines B11 to B14 on the radiation conductors 31 and 32 of FIG. 39. The positions and numbers of bends of the radiation conductors are not limited to those shown in FIG. 40, and the size of the antenna apparatus can be reduced by bending the radiation conductors at at least one position. In addition, when the antenna apparatus operates at the high-band resonance frequency f2, a current may flow to the tip (top end) of the radiation conductor 32 or to a certain position on the radiation conductor 32, e.g., a position at which the radiation conductor is bent, depending on the frequency, instead of flowing to the position of the inductor L31.

Figure 41:
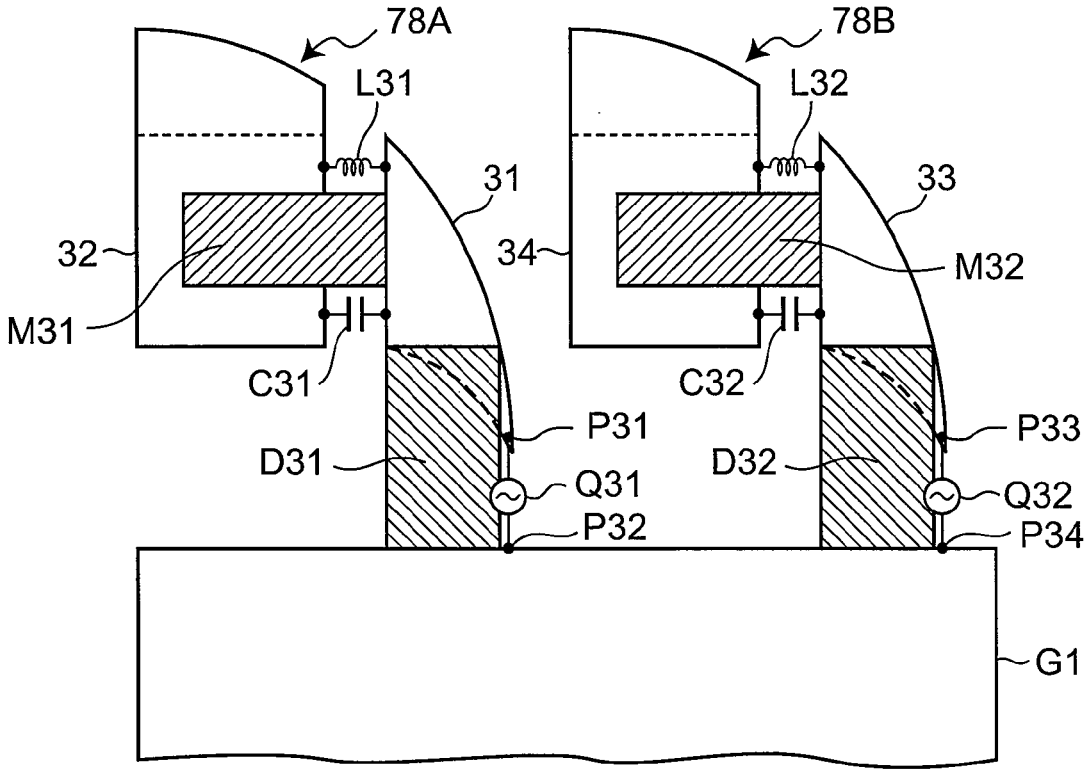
FIG. 41 is a schematic diagram showing an antenna apparatus according to a second modified embodiment of the fourth embodiment.

FIG. 41 is a schematic diagram showing an antenna apparatus according to a second modified embodiment of the fourth embodiment. In the antenna apparatus of the present modified embodiment, radiators 78A and 78B are not disposed symmetrically, but disposed in the same direction (i.e., asymmetrically). Asymmetric disposition of the radiators 78A and 78B results in their asymmetric radiation patterns, thus providing the advantageous effect of reduced correlation between signals transmitted or received through the radiators 78A and 78B. However, since a difference occurs between powers of transmitting signals and powers of received signals, it is not possible to maximize the transmitting or receiving performance for a MIMO communication scheme. Further, three or more radiators may be disposed in a manner similar to that of the antenna apparatus of this modified embodiment.

Figure 42:
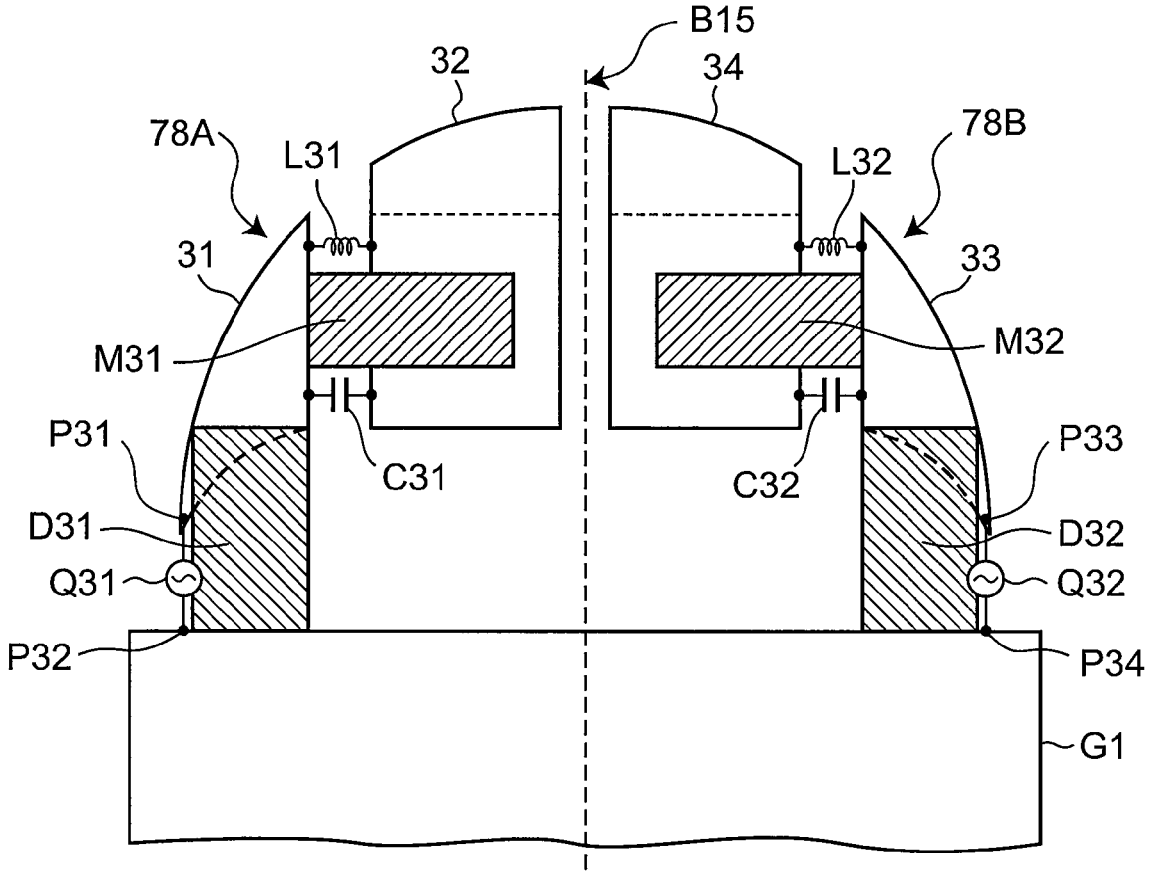
FIG. 42 is a schematic diagram showing an antenna apparatus according to a comparison example of the fourth embodiment.

FIG. 42 is a schematic diagram showing an antenna apparatus according to a comparison example of the fourth embodiment. In the antenna apparatus of FIG. 42, radiation conductors 32 and 34 not having a feed point are disposed close to each other. By separating feed points P31 and P33 from each other, it is possible to reduce the correlation between signals transmitted or received through radiators 78A and 78B. However, since the open ends of the respective radiators 78A and 78B (i.e., the edges of the radiation conductors 32 and 34) are opposed to each other, the electromagnetic coupling between the radiators 78A and 78B is large.

Figure 43:
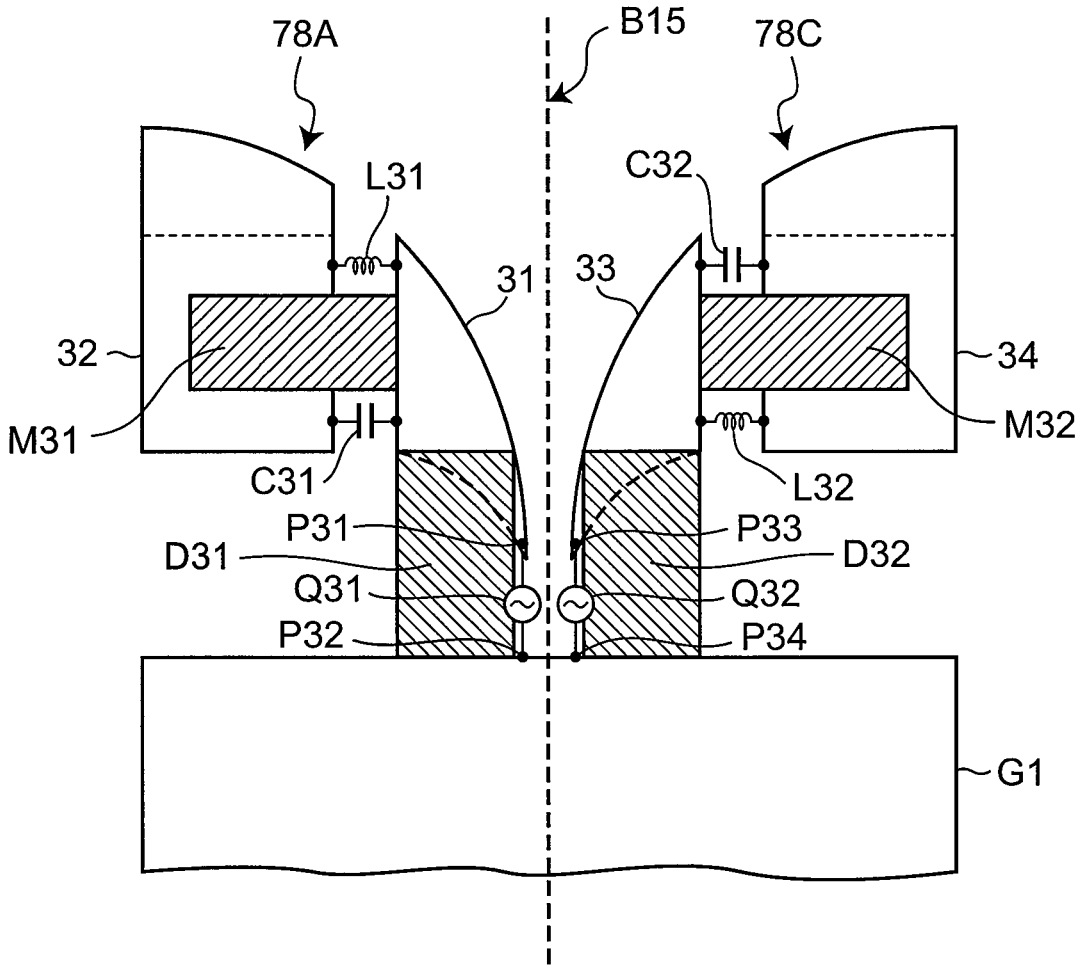
FIG. 43 is a schematic diagram showing an antenna apparatus according to a third modified embodiment of the fourth embodiment.

FIG. 43 is a schematic diagram showing an antenna apparatus according to a third modified embodiment of the fourth embodiment. The antenna apparatus of the present modified embodiment is characterized by a radiator 78C, instead of the radiator 78B of FIG. 39, and the radiator 78C is configured such that the positions of a capacitor C32 and an inductor L32 are asymmetrical with respect to the positions of a capacitor C31 and an inductor L31 of a radiator 78A, in order to reduce electromagnetic coupling between the two radiators for the case where the antenna apparatus operates at the low-band resonance frequency f1.

For comparison, at first, the case is considered in which when the antenna apparatus of FIG. 39 operates at the low-band resonance frequency f1, for example, only one signal source Q31 operates. When the radiator 78A operates in a loop antenna mode due to a current inputted from the signal source Q31, a magnetic field produced by the radiator 78A induces a current in the radiator 78B of FIG. 39, the current flowing in the same direction as a current on the radiator 78A, and flowing to the signal source Q32. Since the large induced current flows through the radiator 78B, large electromagnetic coupling between the radiators 78A and 78B occurs. On the other hand, when the antenna apparatus of FIG. 39 operates at the high-band resonance frequency f2, in the radiator 78A, a current inputted from the signal source Q31 flows in a direction remote from the radiator 78B. Therefore, electromagnetic coupling between the radiators 78A and 78B is small, and an induced current flowing through the radiator 78B and the signal source Q32 is also small.

Referring to the antenna apparatus of the present modified embodiment of FIG. 43 again, when proceeding along the symmetric loops of the radiation conductors of the radiators 78A and 78C in corresponding directions starting from respective feed points P31 and P33 (e.g., when proceeding counterclockwise in the radiator 78A and proceeding clockwise in the radiator 78C), the radiator 78A is configured such that the feed point P31, the inductor L31, and the capacitor C31 are located in this order, and the radiator 78C is configured such that the feed point P33, the capacitor C32, and the inductor L32 are located in this order. In addition, while the radiator 78A is configured such that the capacitor C31 is provided closer to the feed point P31 than the inductor L31, the radiator 78C is configured such that the inductor L32 is provided closer to the feed point P33 than the capacitor C32. Thus, the capacitors and the inductors are asymmetrically arranged between the radiators 78A and 78C, electromagnetic coupling between the radiators 78A and 78C is reduced.

As described above, by nature, a current having a low frequency component can pass through an inductor, but is difficult to pass through a capacitor. Therefore, when the antenna apparatus of FIG. 43 operates at the low-band resonance frequency f1, even if the radiator 78A operates in a loop antenna mode due to a current inputted from a signal source Q31, an induced current on the radiator 78C is small, and a current flowing from the radiator 78C to a signal source Q32 is also small. Thus, electromagnetic coupling between the radiators 78A and 78C for the case where the antenna apparatus of FIG. 43 operates at the low-band resonance frequency f1 is small. When the antenna apparatus of FIG. 43 operates at the high-band resonance frequency f2, electromagnetic coupling between the radiators 78A and 78C is small.

The above-described antenna apparatus according to the fourth embodiment may be provided with only one of a magnetic block and a dielectric block. In the case of having only a magnetic block, it is possible to easily adjust only the low-band resonance frequency so as to be shifted to the lower frequency, in a manner similar to that of the first embodiment. In the case of having only the dielectric blocks, it is possible to increase the bandwidth of only the high frequency operating band including the high-band resonance frequency f2, in a manner similar to that of the second embodiment.

Fifth Embodiment

Figure 61:
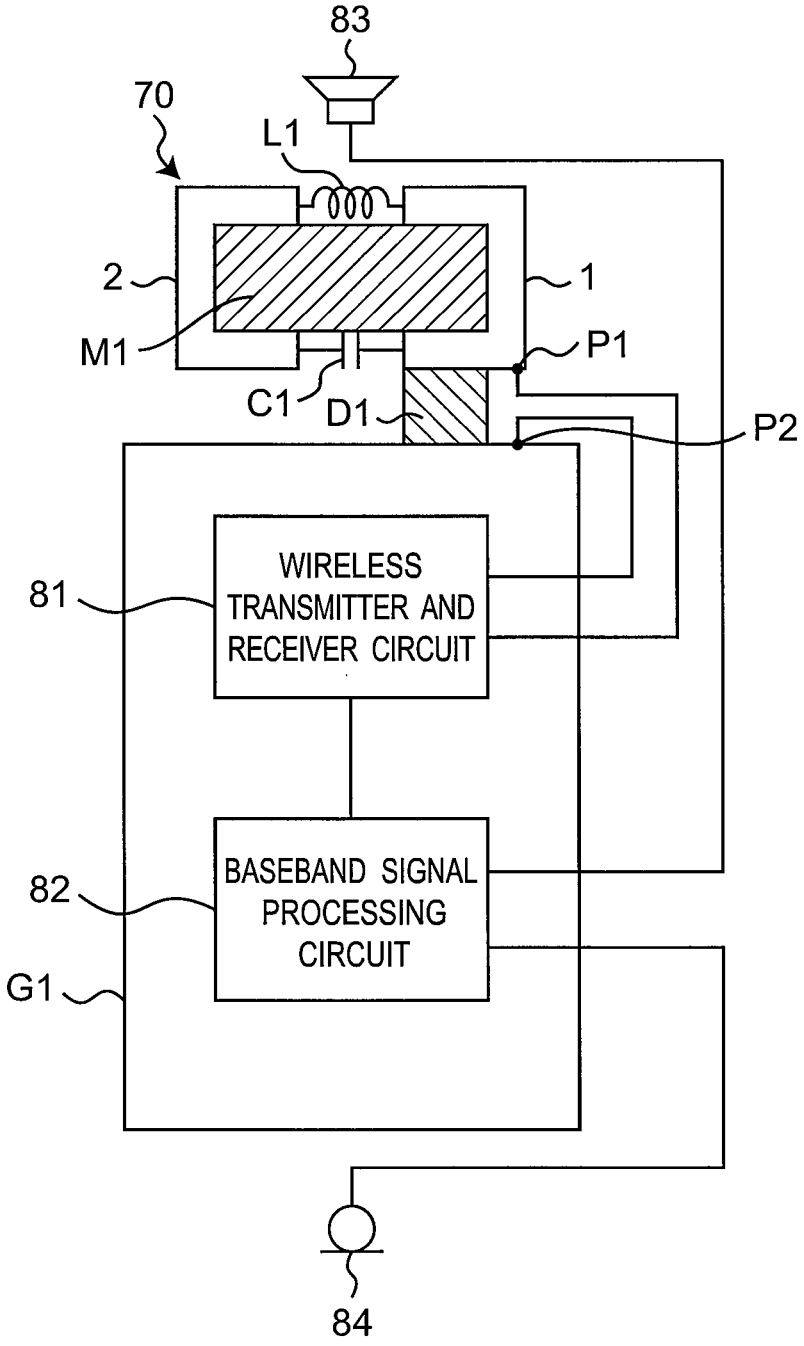
FIG. 61 is a block diagram showing a configuration of a wireless communication apparatus according to a fifth embodiment, provided with the antenna apparatus of FIG. 28.

FIG. 61 is a block diagram showing a configuration of a wireless communication apparatus according to a fifth embodiment, provided with an antenna apparatus of FIG. 28. A wireless communication apparatus according to the present embodiment may be configured as, for example, a mobile phone as shown in FIG. 61. The wireless communication apparatus of FIG. 61 is provided with an antenna apparatus of FIG. 28, a wireless transmitter and receiver circuit 81, a baseband signal processing circuit 82 connected to the wireless transmitter and receiver circuit 81, and a speaker 83 and a microphone 84 which are connected to the baseband signal processing circuit 82. A feed point P1 of a radiator 70 and a connecting point P2 of a ground conductor G1 of the antenna apparatus are connected to the wireless transmitter and receiver circuit 81, instead of a signal source Q1 of FIG. 28. When a wireless broadband router apparatus, a high-speed wireless communication apparatus for M2M (Machine-to-Machine), or the like, is implemented as the wireless communication apparatus, it is not necessary to have a speaker, a microphone, etc., and alternatively, an LED (Light-Emitting Diode), etc., may be used to check the communication status of the wireless communication apparatus. Wireless communication apparatuses to which the antenna apparatuses of FIG. 28, etc., are applicable are not limited to those exemplified above.

Since the wireless communication apparatus of the present embodiment is provided with the radiator 70 operable in one of a loop antenna mode and a monopole antenna mode according to the operating frequency, it is possible to effectively achieve dual-band operation, and achieve the size reduction of the antenna apparatus. Further, since the wireless communication apparatus of the present embodiment is provided with a magnetic block M1, it is possible to easily adjust only the low-band resonance frequency so as to be shifted to the lower frequency. Further, since the wireless communication apparatus of the present embodiment is provided with the dielectric block D1, it is possible to increase the bandwidth of only the high frequency operating band including the high-band resonance frequency f2.

The wireless communication apparatus of FIG. 61 can use any of the other antenna apparatuses disclosed here or its modifications, instead of the antenna apparatus of FIG. 28.

The embodiments and modified embodiments described above may be combined with each other.

Implementation Example 1

Simulation results for an antenna apparatus according to the first embodiment will be described below. In the simulations, a transient analysis was performed using the software, "CST Microwave Studio". A point at which reflection energy at the feed point is −40 dB or less with respect to input energy was used as a threshold value for determining convergence. A portion where a current flows strongly was finely modeled using the sub-mesh method.

Figure 44:
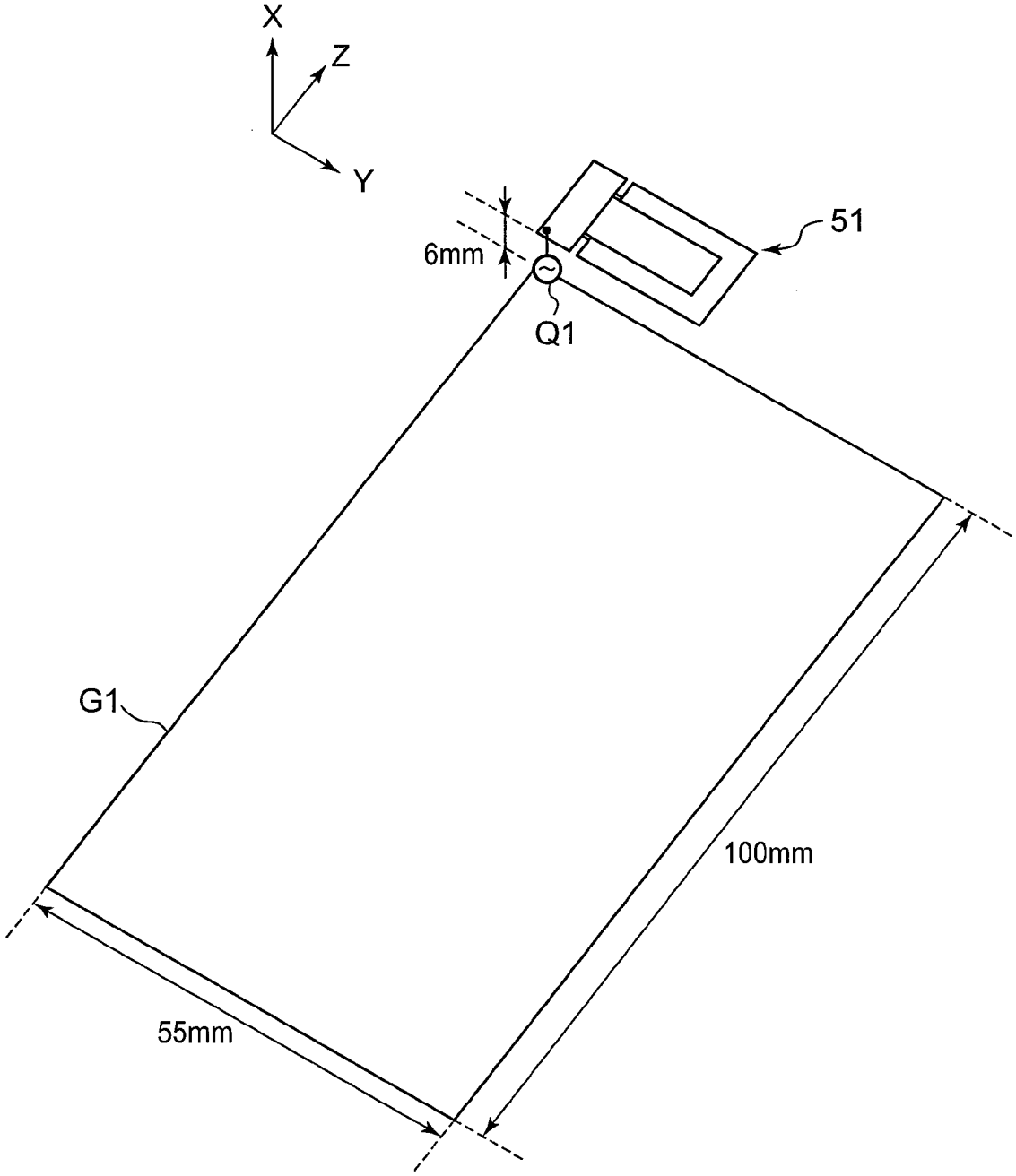
FIG. 44 is a perspective view showing an antenna apparatus according to a first comparison example used in a simulation.

FIG. 44 is a perspective view showing an antenna apparatus according to a first comparison example used in a simulation.

Figure 45:
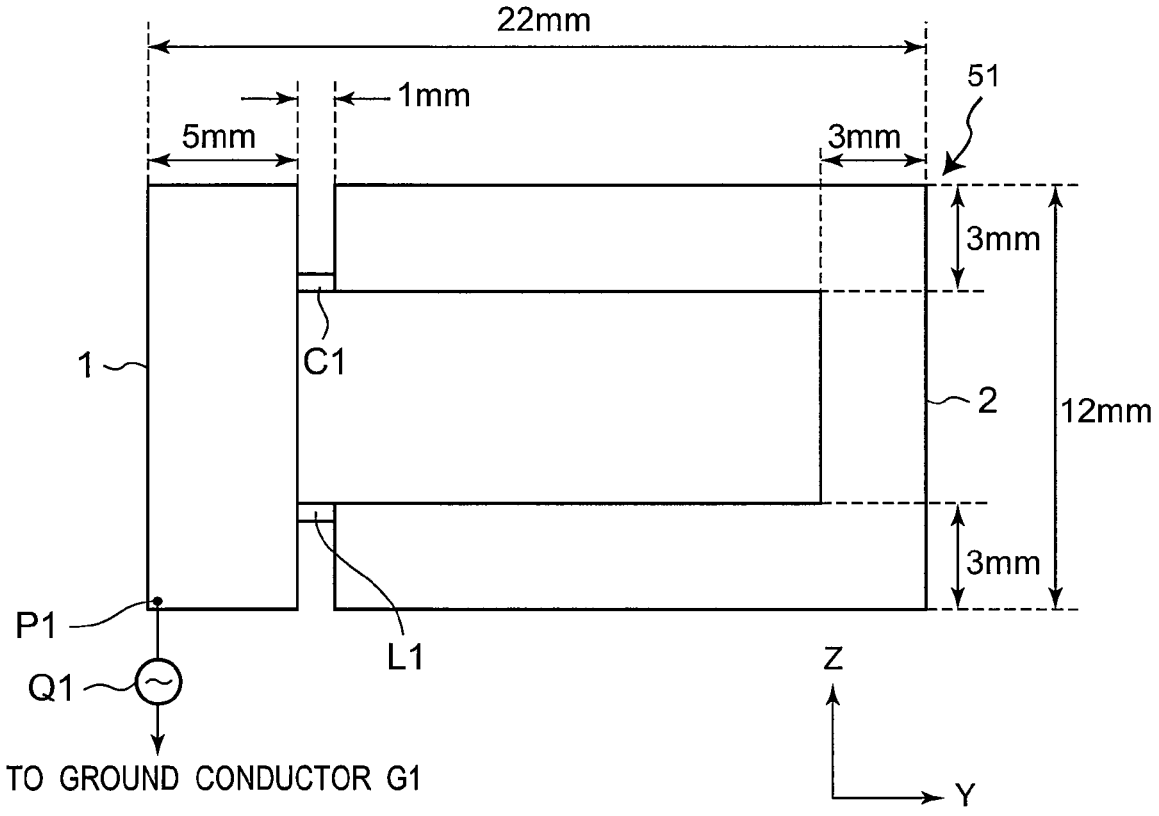
FIG. 45 is a top view showing a detailed configuration of a radiator 51 of the antenna apparatus of FIG. 44.
Figure 46:
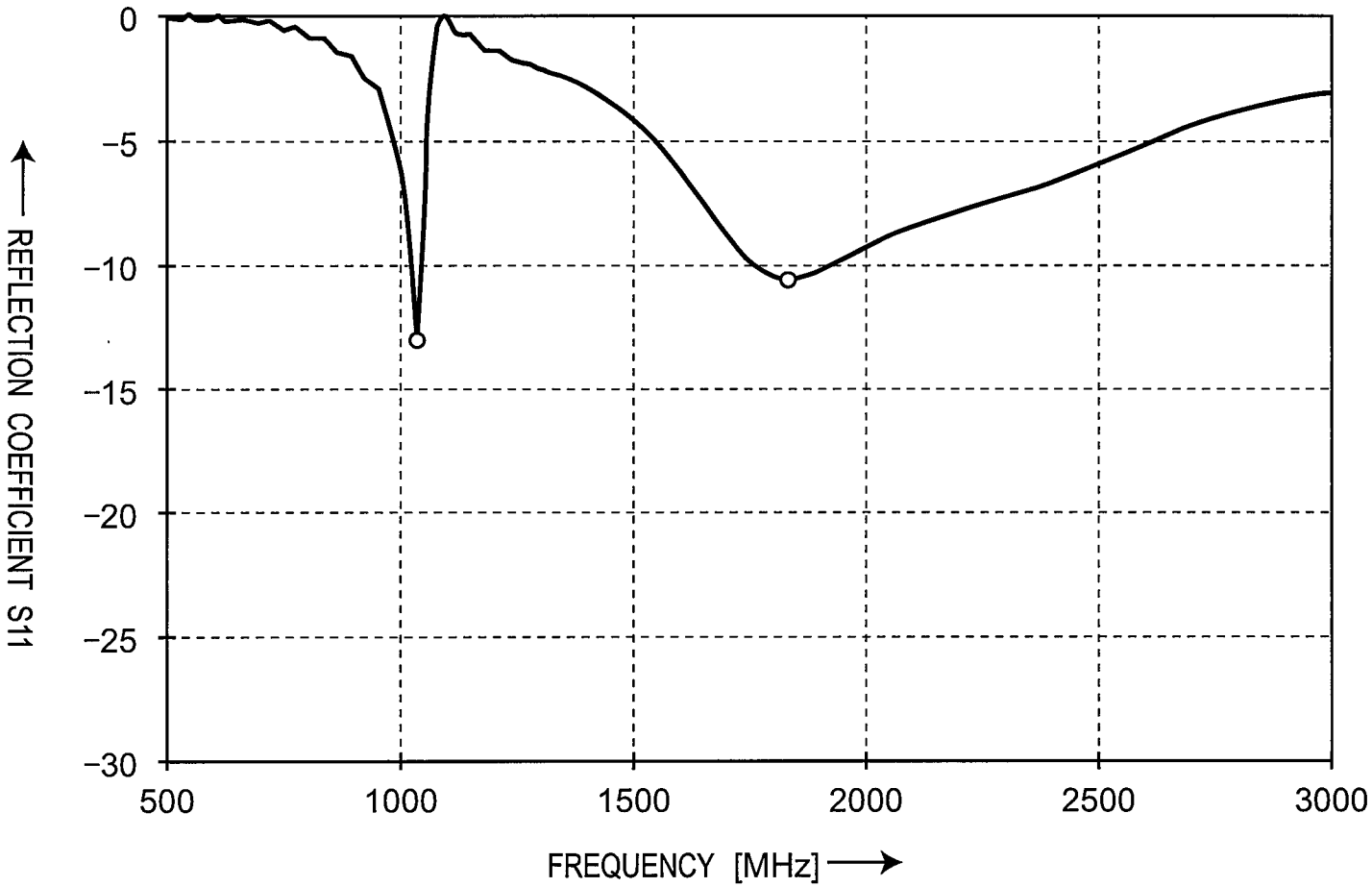
FIG. 46 is a graph showing a frequency characteristic of a reflection coefficient S11 of the antenna apparatus of FIG. 44.

FIG. 45 is a top view showing a detailed configuration of a radiator 51 of the antenna apparatus of FIG. 44. The antenna apparatus of the comparison example of FIGS. 44 and 45 does not have either a magnetic block or a dielectric block. A capacitor having a capacitance of 1 pF was used for a capacitor C1. An inductor having an inductance of 3 nH was used for an inductor L1. The same capacitance of the capacitor C1 and the same inductance of the inductor L1 were used for the other simulations. FIG. 46 is a graph showing a frequency characteristic of a reflection coefficient S11 of the antenna apparatus of FIG. 44. When the low-band resonance frequency f1=1035 MHz, the reflection coefficient S11=−13.1 dB, and when the high-band resonance frequency f2=1835 MHz, the reflection coefficient S11=−10.7 dB. Thus, it can be seen that dual-band operation was effectively achieved at two frequencies.

Figure 47:
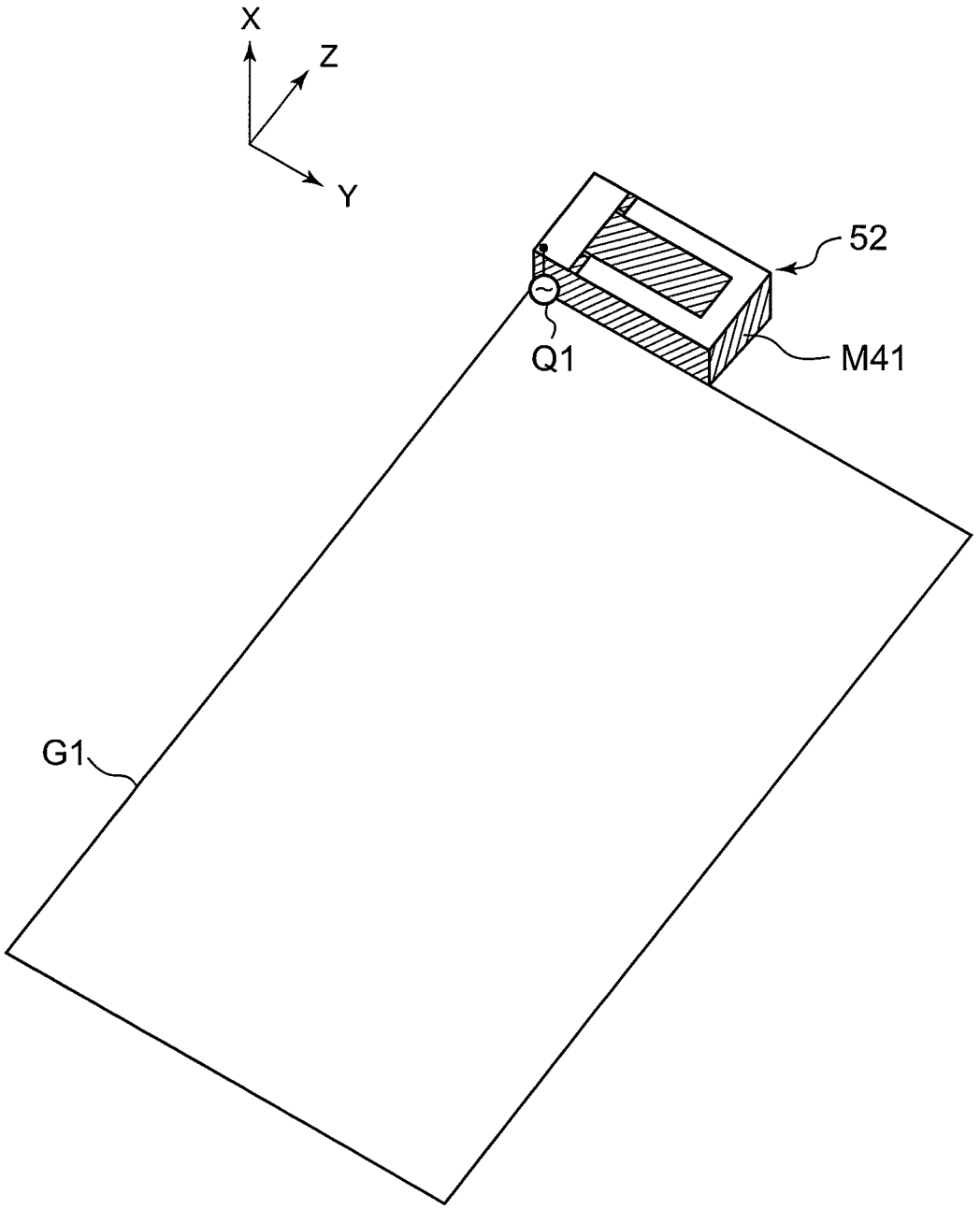
FIG. 47 is a perspective view showing an antenna apparatus according to a second comparison example used in a simulation.
Figure 48:
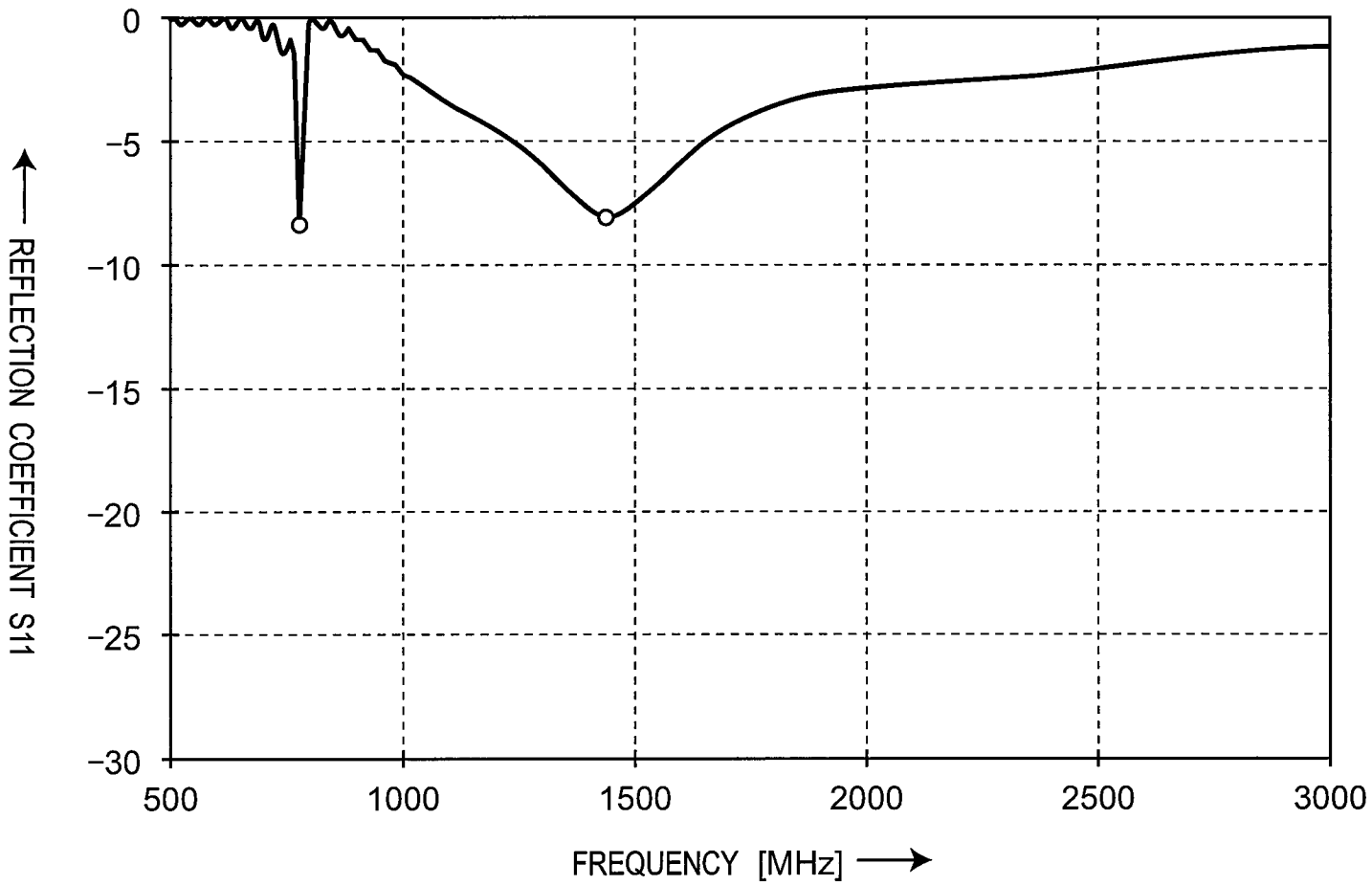
FIG. 48 is a graph showing a frequency characteristic of a reflection coefficient S11 of the antenna apparatus of FIG. 47.

FIG. 47 is a perspective view showing an antenna apparatus according to a second comparison example used in a simulation. A radiator 52 of FIG. 47 was configured such that a magnetic block M41 was provided on the entire underside (−X side) of the radiator 51 of FIG. 44. The magnetic block M41 had a relative permeability of 5. FIG. 48 is a graph showing a frequency characteristic of a reflection coefficient S11 of the antenna apparatus of FIG. 47. When the low-band resonance frequency f1=780 MHz, the reflection coefficient S11=−8.4 dB, and when the high-band resonance frequency f2=1440 MHz, the reflection coefficient S11=−8.1 dB. Comparing FIG. 48 with FIG. 46, it can be seen that the antenna apparatus of FIG. 47 achieved dual-band operation, and further reduced the low-band resonance frequency f1 to 780 MHz, but also reduced the high-band resonance frequency f2. Normally, the loss in magnetic material increases when frequency exceeds 1 GHz. Therefore, it is expected that the antenna characteristics degrades when the high-band resonance frequency f2 is affected by the magnetic material.

Figure 49:
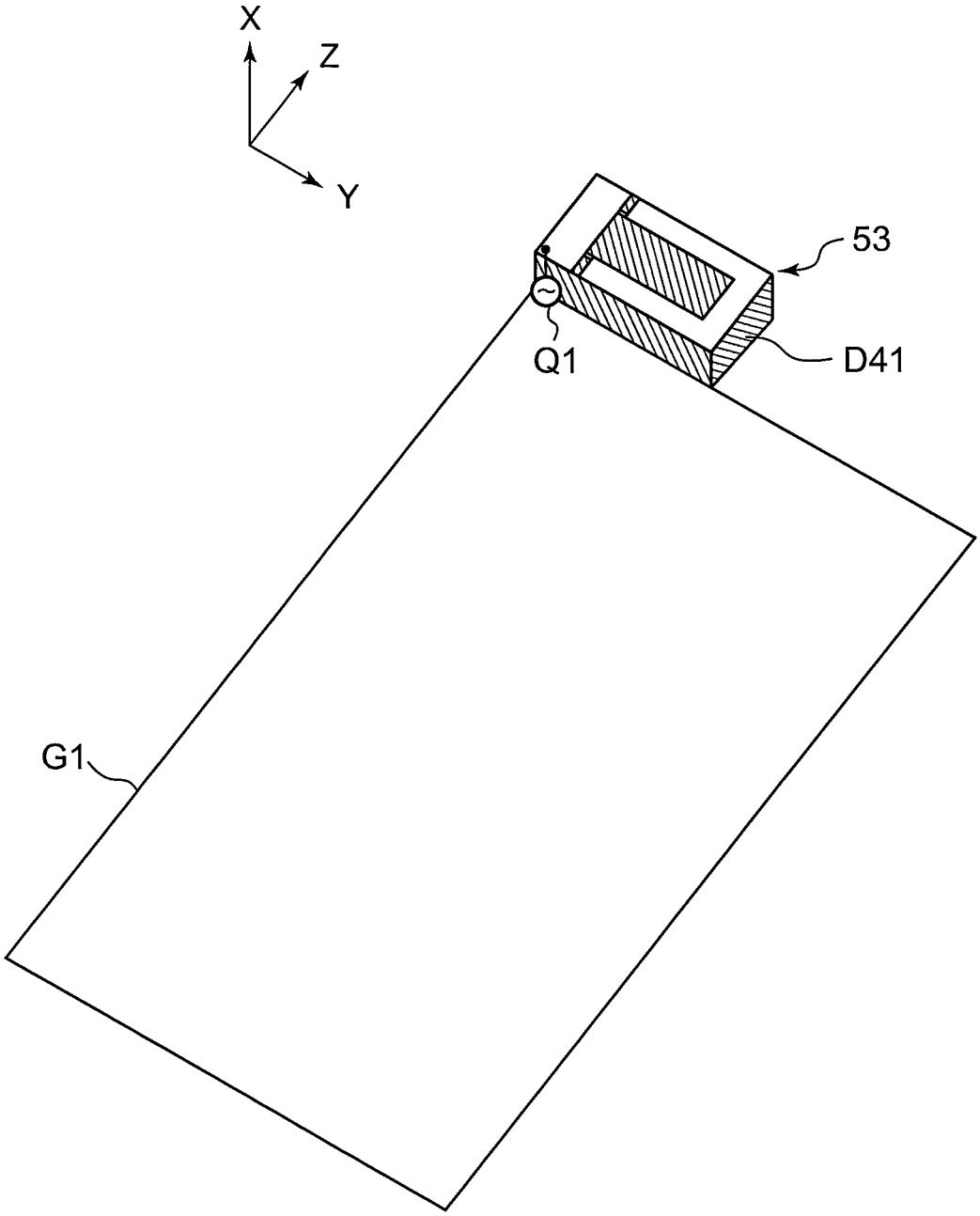
FIG. 49 is a perspective view showing an antenna apparatus according to a third comparison example used in a simulation.
Figure 50:
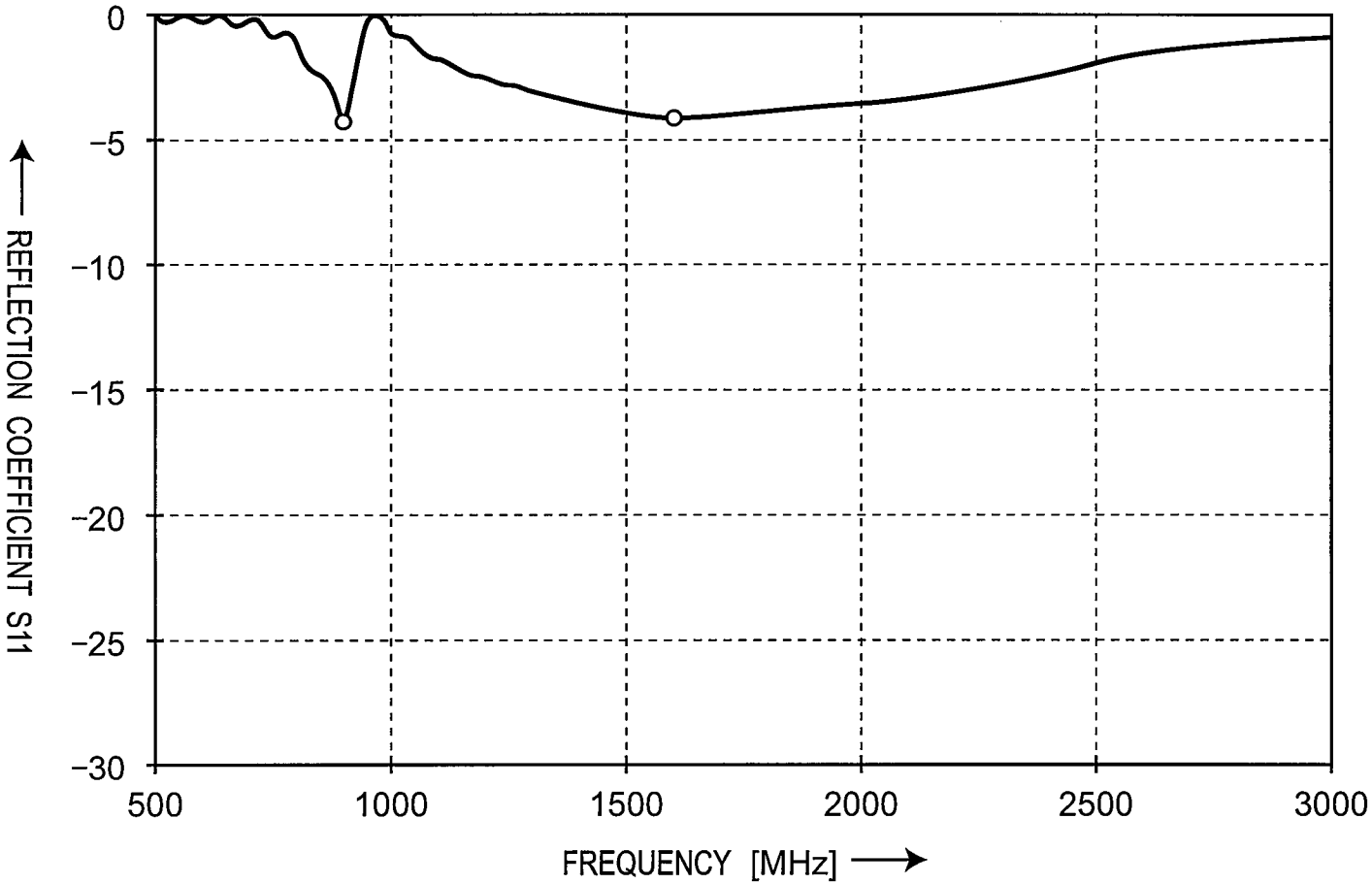
FIG. 50 is a graph showing a frequency characteristic of a reflection coefficient S11 of the antenna apparatus of FIG. 49.

FIG. 49 is a perspective view showing an antenna apparatus according to a third comparison example used in a simulation. A radiator 53 of FIG. 49 was configured such that a dielectric block D41 is provided on the entire underside (−X side) of the radiator 51 of FIG. 44. The dielectric block D41 had a relative dielectric constant of 5. FIG. 50 is a graph showing a frequency characteristic of a reflection coefficient S11 of the antenna apparatus of FIG. 49. When the low-band resonance frequency f1=896 MHz, the reflection coefficient S11=−4.3 dB, and when the high-band resonance frequency f2=1604 MHz, the reflection coefficient S11=−4.1 dB. Comparing FIG. 50 with FIG. 46, although the antenna apparatus of FIG. 49 achieved dual-band operation, the antenna radiation resistance decreased, since an electric field was concentrated between a radiation conductor and a ground conductor G1 due to the influence of the dielectric block D41. As a result, it can be seen that the reflection coefficient S11 degraded, compared to the antenna characteristics of FIG. 46.

According to FIGS. 48 and 50, it can be seen that it is not possible to achieve size reduction while maintaining antenna characteristics, using a magnetic block or a dielectric block provided on the entire underside of a radiator (see Patent Literature 2).

Figure 51:
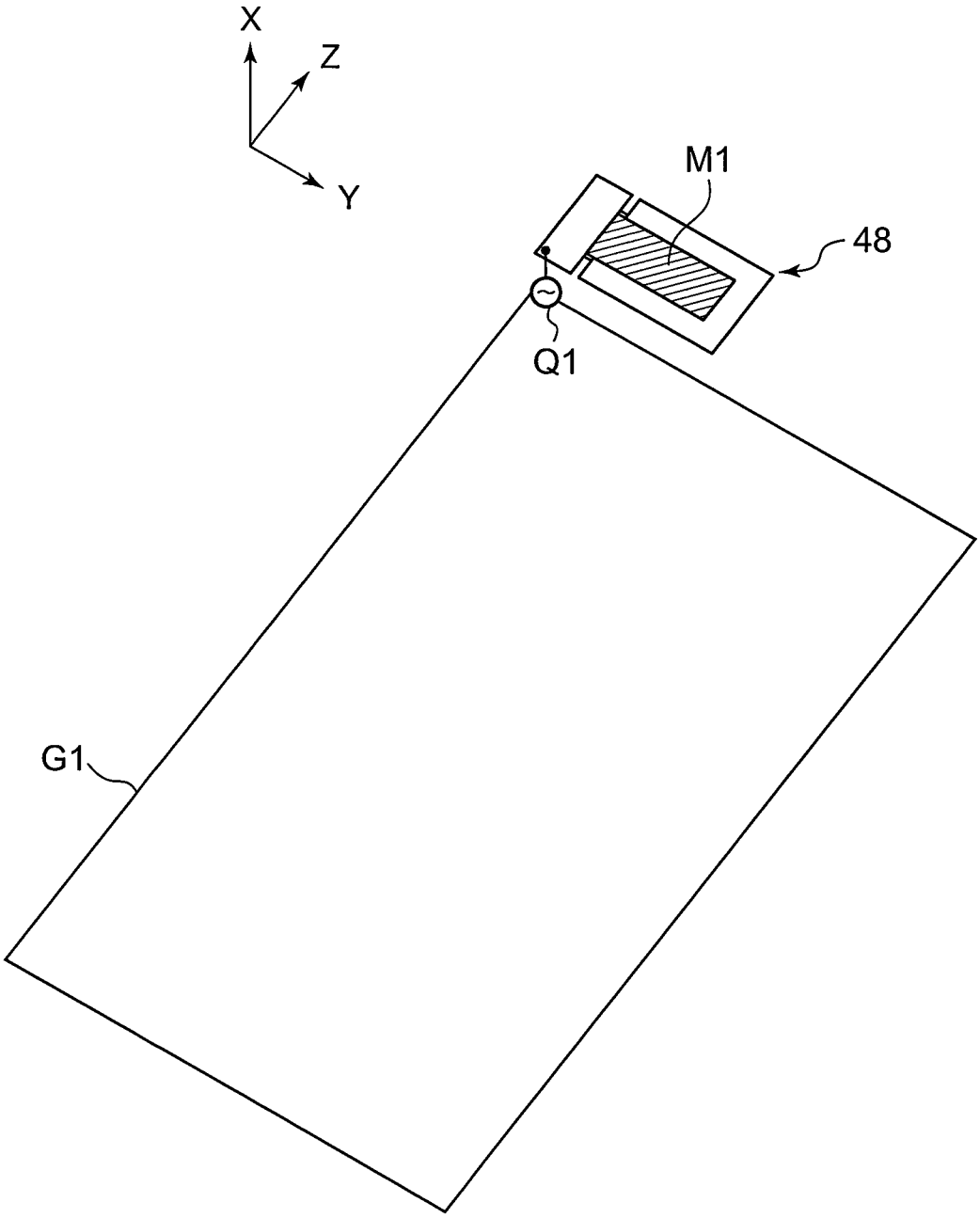
FIG. 51 is a perspective view showing an antenna apparatus according to an implementation example of the first embodiment used in a simulation.
Figure 52:
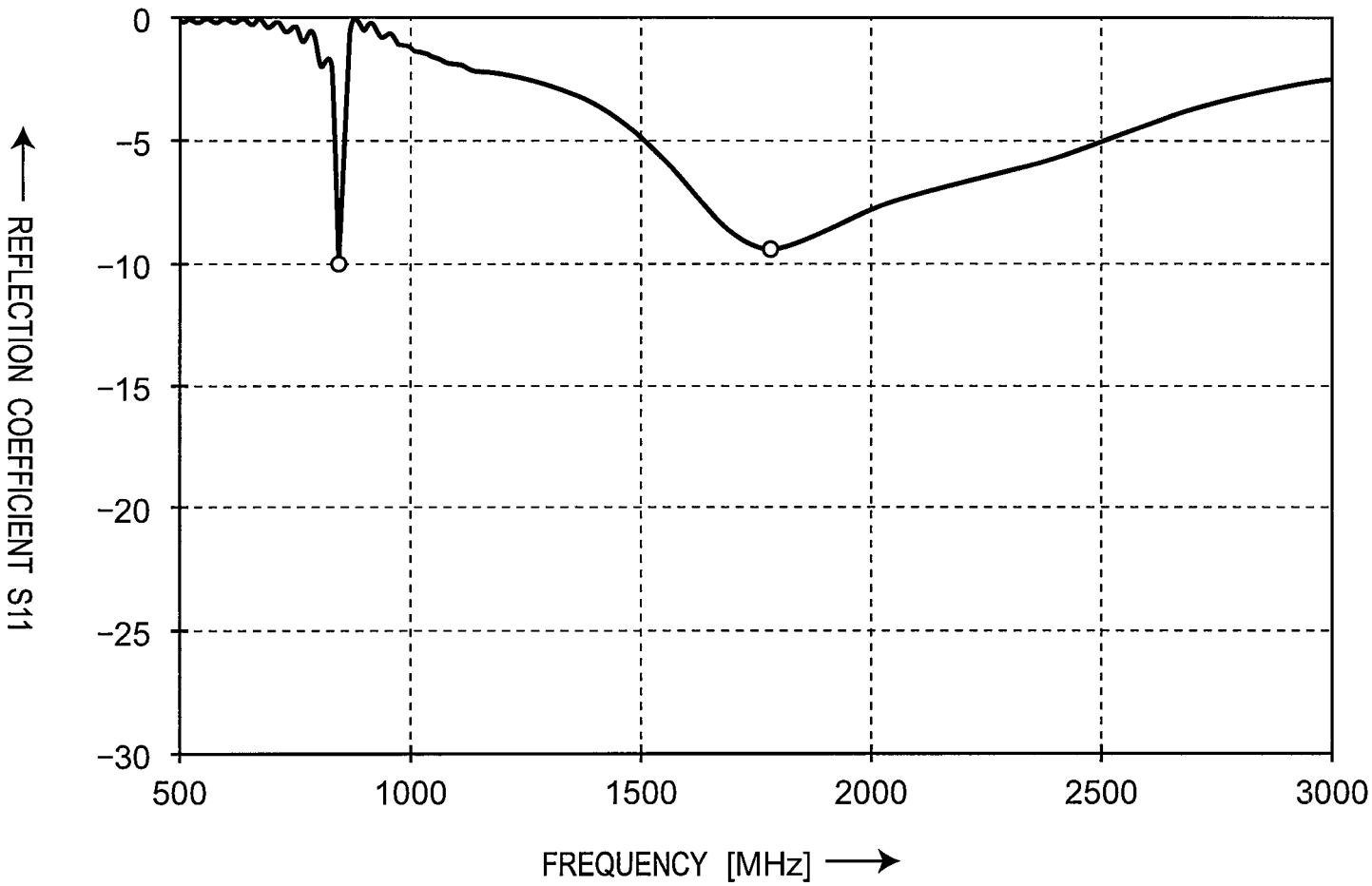
FIG. 52 is a graph showing a frequency characteristic of a reflection coefficient S11 of the antenna apparatus of FIG. 51.

FIG. 51 is a perspective view showing an antenna apparatus according to an implementation example of the first embodiment used in a simulation. A radiator 48 of FIG. 51 was configured such that a magnetic block M1 was provided in the entire inside of a looped radiation conductor of the radiator 51 of FIG. 44. The magnetic block M1 had a relative permeability of 5. The thickness in the X direction of the magnetic block M1 was 0.5 mm. FIG. 52 is a graph showing a frequency characteristic of a reflection coefficient S11 of the antenna apparatus of FIG. 51. When the low-band resonance frequency f1=850 MHz, the reflection coefficient S11=−10.1 dB, and when the high-band resonance frequency f2=1785 MHz, the reflection coefficient S11=−9.5 dB. According to FIG. 52, it can be seen that dual-band operation was effectively achieved at two frequencies. Comparing with FIG. 46 as to the antenna apparatus of FIG. 44, it can be seen that when the antenna apparatus of FIG. 51 operated at the high-band resonance frequency f2, the high-band resonance frequency f2 was not shifted since the high-band resonance frequency f2 was not affected by the magnetic block M1, and on the other hand, only the low-band resonance frequency f1 was effectively shifted to the lower frequency. As a result, it was numerically shown that there is a special advantageous effect of substantially reducing the size of the antenna apparatus without impairing antenna characteristics.

Figure 53:
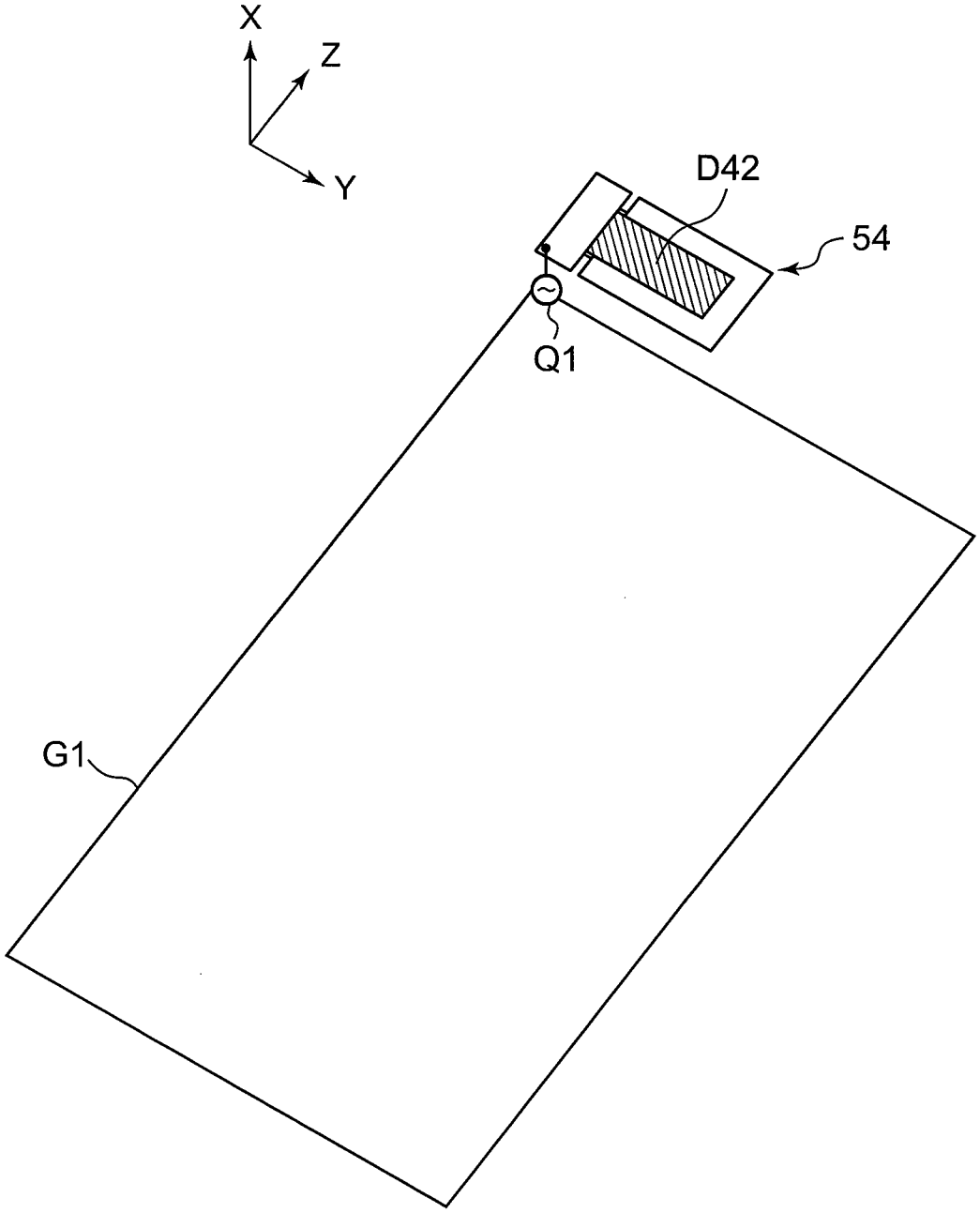
FIG. 53 is a perspective view showing an antenna apparatus according to a fourth comparison example used in a simulation.
Figure 54:
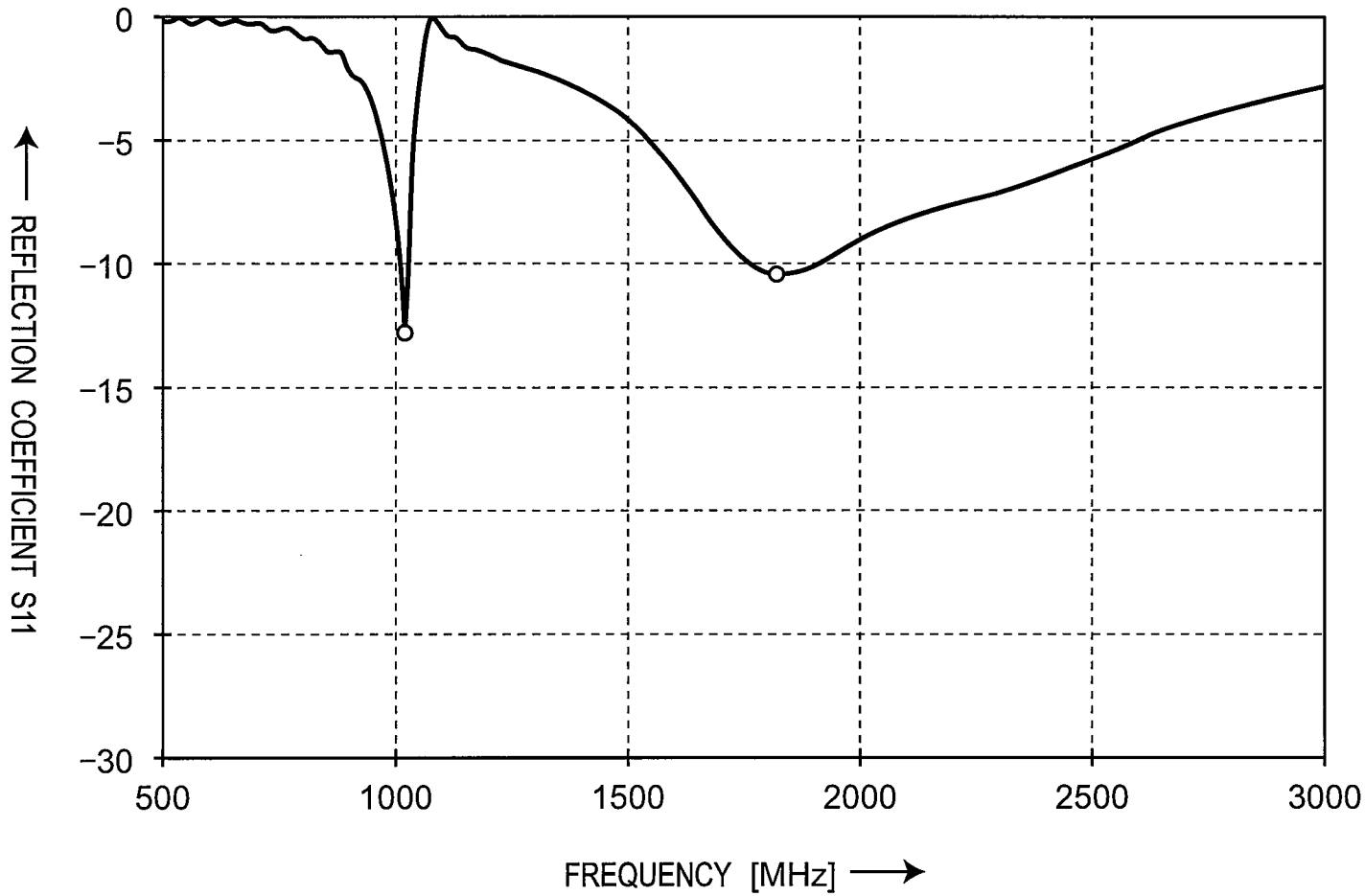
FIG. 54 is a graph showing a frequency characteristic of a reflection coefficient S11 of the antenna apparatus of FIG. 53.

FIG. 53 is a perspective view showing an antenna apparatus according to a fourth comparison example used in a simulation. A radiator 54 of FIG. 53 corresponds to a configuration in which a dielectric block D42 is provided in the entire inside of a looped radiation conductor of the radiator 51 of FIG. 44. The dielectric block D42 had a relative dielectric constant of 5. The thickness in the X direction of the dielectric block D42 was 0.5 mm. FIG. 54 is a graph showing a frequency characteristic of a reflection coefficient S11 of the antenna apparatus of FIG. 53. When the low-band resonance frequency f1=1025 MHz, the reflection coefficient S11=−12.9 dB, and when the high-band resonance frequency f2=1823 MHz, the reflection coefficient S11=−10.5 dB. According to FIG. 54, it can be seen that dual-band operation was achieved. However, comparing with the results of FIG. 46, there is no significant difference. This is because the antenna apparatus has a characteristic that when the antenna apparatus operates at the low-band resonance frequency f1, the antenna apparatus is less likely to be affected by the dielectric block D42, since the antenna apparatus operates in a loop antenna mode, i.e., a magnetic current mode.

Implementation Example 2

Figure 55:
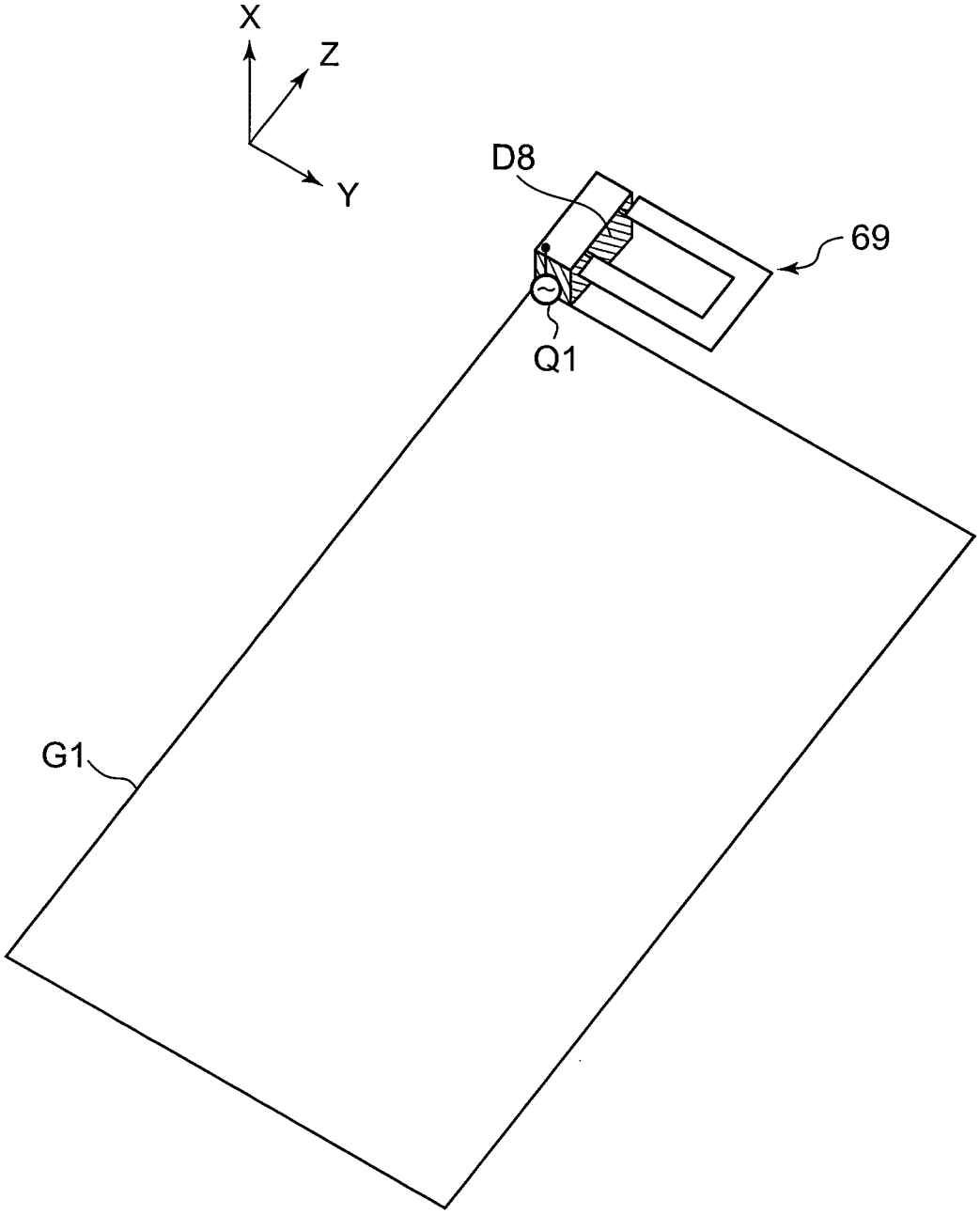
FIG. 55 is a perspective view showing an antenna apparatus according to a first implementation example of the second embodiment used in a simulation.
Figure 56:
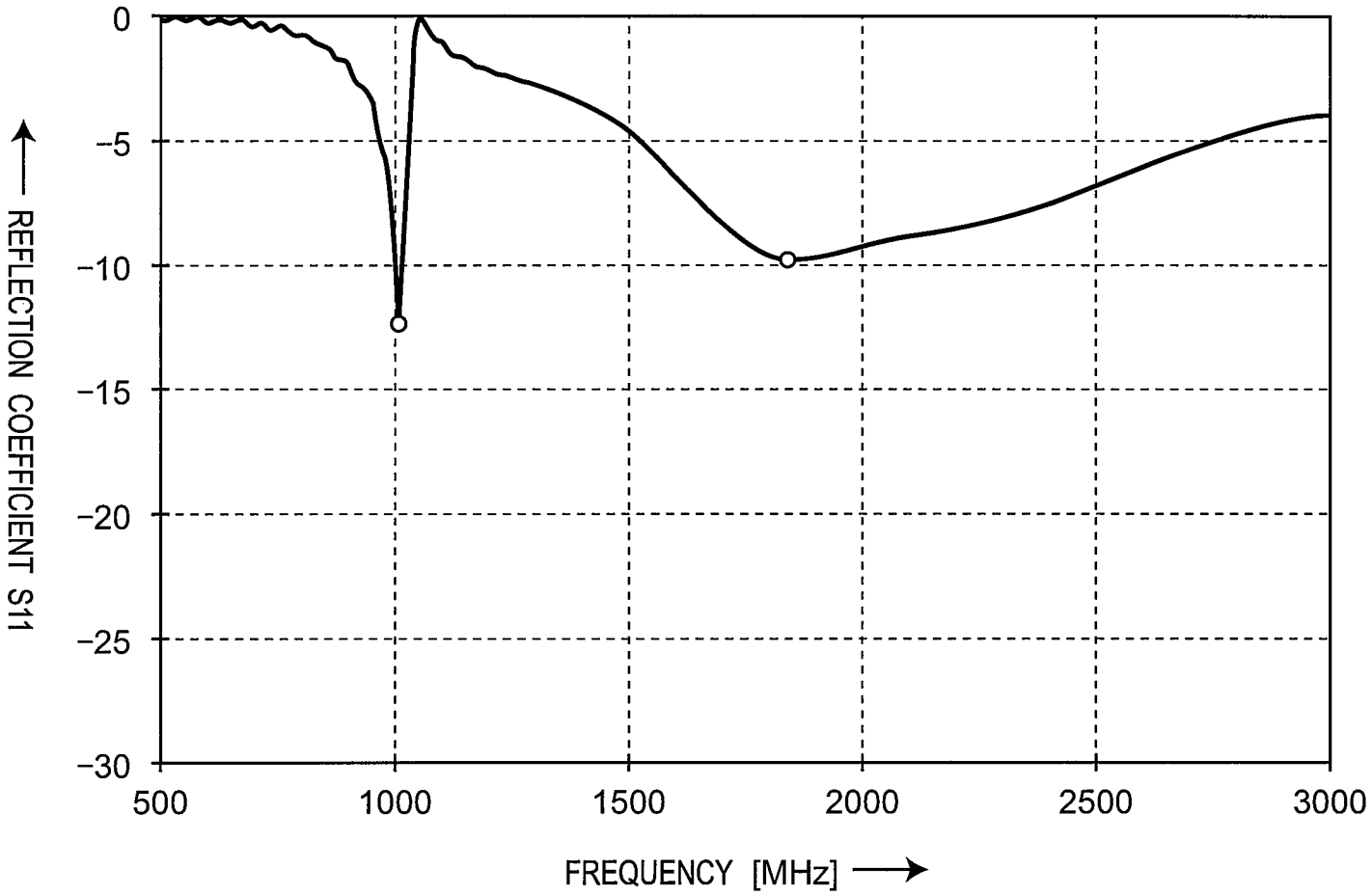
FIG. 56 is a graph showing a frequency characteristic of a reflection coefficient S11 of the antenna apparatus of FIG. 55.

Simulation results for an antenna apparatus according to the second embodiment will be described below. FIG. 55 is a perspective view showing an antenna apparatus according to a first implementation example of the second embodiment used in a simulation. A radiator 69 of FIG. 55 was configured such that a dielectric block D8 was provided on the entire underside (−X side) of a radiation conductor 1 of a radiator 51 of FIG. 44. The dielectric block D8 had a relative dielectric constant of 10. FIG. 56 is a graph showing a frequency characteristic of a reflection coefficient S11 of the antenna apparatus of FIG. 55. When the low-band resonance frequency f1=1013 MHz, the reflection coefficient S11=−12.4 dB, and when the high-band resonance frequency f2=1845 MHz, the reflection coefficient S11=−9.9 dB. Comparing with the results of FIG. 46 (no dielectric block), it can be seen that the bandwidth of the operating band including the high-band resonance frequency f2 was increased. Specifically, when a dielectric block was not provided, Bw=895 MHz, and when the dielectric block D8 was provided, Bw=1045 MHz, where Bw denotes the frequency bandwidth where the reflection coefficient S11 is −6 dB or less. Thus, it can be seen that that the bandwidth was increased by about 150 MHz.

Figure 57:
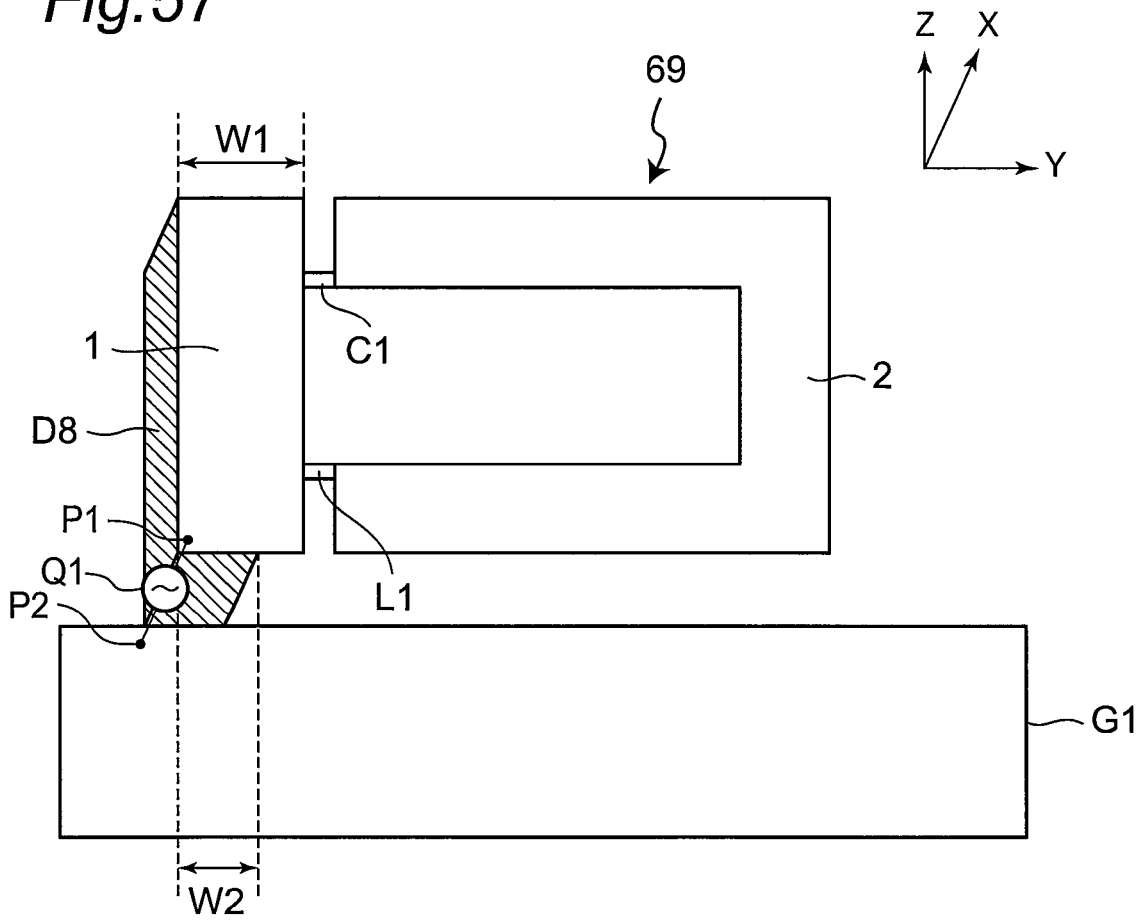
FIG. 57 is a perspective view showing an antenna apparatus according to a second implementation example of the second embodiment used in a simulation.
Figure 58:
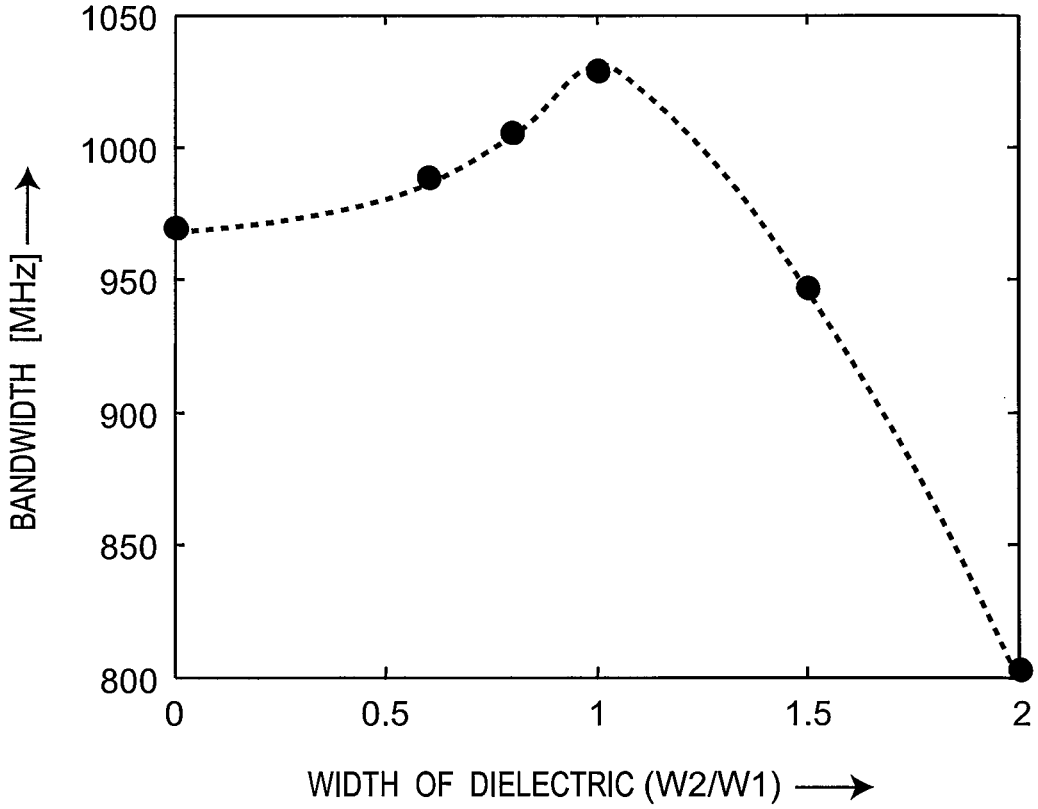
FIG. 58 is a graph showing the influence of the width of a dielectric block D8 of the antenna apparatus of FIG. 57, over the bandwidth.

FIG. 57 is a perspective view showing an antenna apparatus according to a second implementation example of the second embodiment used in a simulation. FIG. 58 is a graph showing the influence of the width of a dielectric block D8 of the antenna apparatus of FIG. 57, over the bandwidth. "W1" denotes the width in the Y direction of a radiation conductor 1, and "W2" denotes the width in the Y direction of the dielectric block D8. FIG. 58 shows computation results of variations of the bandwidth where the reflection coefficient S11 was −6 dB or less in the operating band including the high-band resonance frequency f2, when changing the width W2 of the dielectric block D8. According to the computation results, it can be seen that the maximum bandwidth is obtained when the dielectric block D8 was provided on the entire underside of the radiation conductor 1. Meanwhile, it can be seen that when the dielectric block D8 was also provided on the underside of a radiation conductor 2, the bandwidth decreased steeply. This is because the radiation conductor 2 is a portion that strongly contributes to radiation as an open end of the antenna apparatus. It can be seen that this portion should be configured to easily radiate energy into space as much as possible, without providing the dielectric block D8 to concentrate the density of electric flux and accumulate energy.

Implementation Example 3

Figure 59:
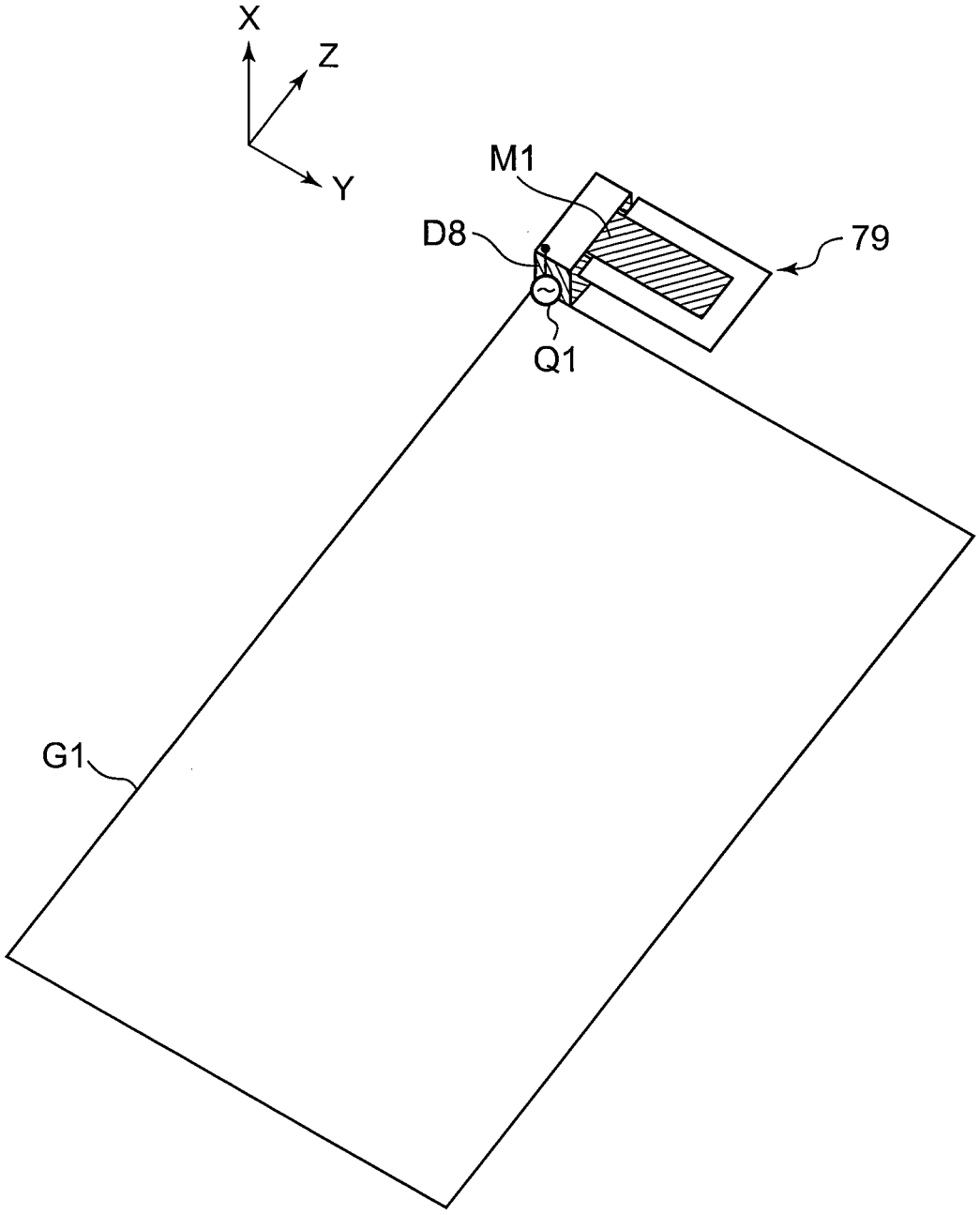
FIG. 59 is a perspective view showing an antenna apparatus according to an implementation example of the third embodiment used in a simulation.
Figure 60:
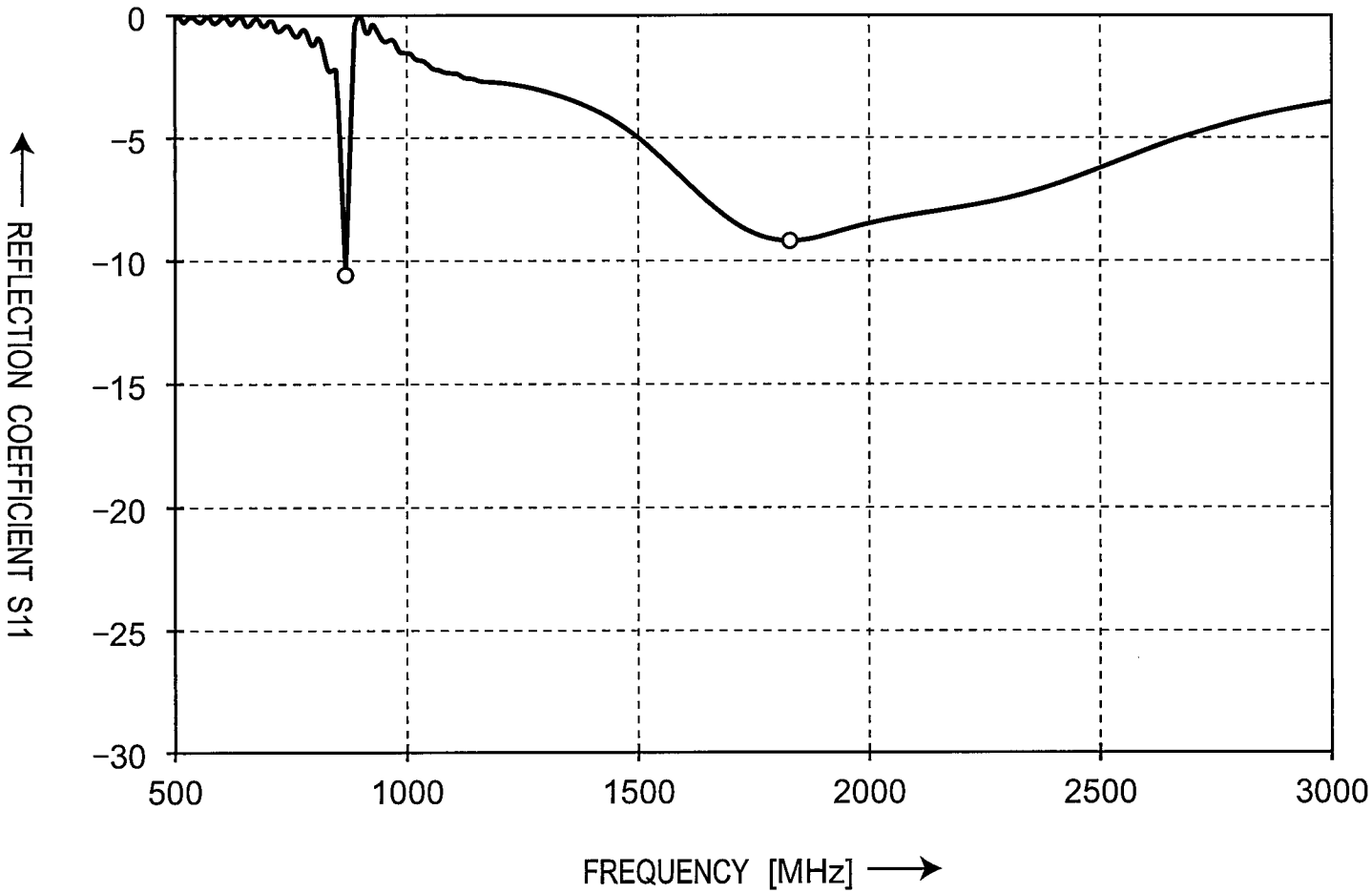
FIG. 60 is a graph showing a frequency characteristic of a reflection coefficient S11 of the antenna apparatus of FIG. 59.

Simulation results for an antenna apparatus according to the third embodiment will be described below. FIG. 59 is a perspective view showing an antenna apparatus according to an implementation example of the third embodiment used in a simulation. A radiator 79 of FIG. 59 was configured to be provided with both a magnetic block M1 of FIG. 51 and a dielectric block D8 of FIG. 55. The magnetic block M1 had a relative permeability of 5, and the dielectric block D8 had a relative dielectric constant of 10. FIG. 60 is a graph showing a frequency characteristic of a reflection coefficient S11 of the antenna apparatus of FIG. 59. When the low-band resonance frequency f1=868 MHz, the reflection coefficient S11=−10.6 dB, and when the high-band resonance frequency f2=1833 MHz, the reflection coefficient S11=−9.1 dB. It can be seen that the low-band resonance frequency f1 was shifted to the lower frequency in the similar manner as that of the antenna apparatus of FIG. 51, and further, the bandwidth the operating band including the high-band resonance frequency f2 was increased without impairing the characteristics of the low-band resonance frequency f1.

According to the above results, it is verified that it is possible to obtain a special advantageous effect of increasing the bandwidth of the operating band including the high-band resonance frequency f2 without impairing the characteristics of the low-band resonance frequency f1, by providing a dielectric block only on the underside of the radiation conductor 1, instead of filling the entire antenna apparatus with a dielectric block.

CONCLUSION

The antenna apparatuses and wireless communication apparatuses disclosed here are characterized by the following configurations.

According to an antenna apparatus of a first aspect of the present disclosure, the antenna apparatus is provided with at least one radiator and a ground conductor. Each radiator is provided with: a looped radiation conductor having an inner perimeter and an outer perimeter, the radiation conductor being provided with respect to a ground conductor such that a part of the radiation conductor is close to and electromagnetically coupled to the ground conductor; at least one capacitor inserted at a position along a loop of the radiation conductor; at least one inductor inserted at a position along the loop of the radiation conductor, the position of the inductor being different from the position of the capacitor; a feed point provided at a position on the radiation conductor, the position of the feed point being close to the ground conductor; and a dielectric block provided between the radiation conductor and the ground conductor, the dielectric block being provided in a portion where the radiation conductor and the ground conductor are close to each other, and the dielectric block provided along at least a part of the loop of the radiation conductor between the feed point and the capacitor. Each radiator is excited at a first frequency and at a second frequency higher than the first frequency. When each radiator is excited at the first frequency, a first current flows along a first path, the first path extending along the inner perimeter of the loop of the radiation conductor and including the inductor and the capacitor. When each radiator is excited at the second frequency, a second current flows through a second path including a section, the section extending along the outer perimeter of the loop of the radiation conductor, and the section including the capacitor but not including the inductor, and the section extending between the feed point and the inductor. When each radiator is excited at the second frequency, a parallel resonant circuit is formed from: a capacitance between the radiation conductor and the ground conductor which are close to each other and between which the dielectric block is provided; and an inductance of the radiation conductor. Each radiator is configured such that the loop of the radiation conductor, the inductor, and the capacitor resonate at the first frequency, and a portion of the loop of the radiation conductor included in the second path, the capacitor, and the parallel resonant circuit resonate at the second frequency.

According to an antenna apparatus of a second aspect of the present disclosure, in the antenna apparatus of the first aspect of the present disclosure, the radiation conductor and the ground conductor of each radiator are provided such that a plane of the radiation conductor is identical to a plane of the ground conductor. Each radiator is provided with a first dielectric block on one side of the plane and a second dielectric block provided on the other side of the plane, in a portion where the radiation conductor and the ground conductor are close to each other, and along at least a part of the loop of the radiation conductor between the feed point and the capacitor.

According to an antenna apparatus of a third aspect of the present disclosure, the antenna apparatus of the first or second aspect of the present disclosure is further provided with a magnetic block provided at at least a part of an inside of the loop of the radiation conductor. Magnetic flux produced by the first current passes through the magnetic block, thus increasing an inductance of the radiation conductor.

According to an antenna apparatus of a fourth aspect of the present disclosure, the antenna apparatus of the third aspect of the present disclosure is further provided with a housing. The magnetic block is formed by embedding magnetic material in a portion of the housing close to an inner portion of the loop of the radiation conductor.

According to an antenna apparatus of a fifth aspect of the present disclosure, in the antenna apparatus of one of the first to fourth aspects of the present disclosure, the radiation conductor includes a first radiation conductor and a second radiation conductor. The capacitor is formed by capacitance between the first and second radiation conductors.

According to an antenna apparatus of a sixth aspect of the present disclosure, in the antenna apparatus of one of the first to fifth aspects of the present disclosure, the inductor is formed as a strip conductor.

According to an antenna apparatus of a seventh aspect of the present disclosure, in the antenna apparatus of one of the first to fifth aspects of the present disclosure, the inductor is formed as a meander conductor.

According to an antenna apparatus of an eighth aspect of the present disclosure, the antenna apparatus of one of the first to seventh aspects of the present disclosure is provided with a printed circuit board provided with the ground conductor, and a feed line connected to the feed point. The radiator is formed on the printed circuit board.

According to an antenna apparatus of a ninth aspect of the present disclosure, in the antenna apparatus of one of the first to seventh aspects of the present disclosure, the antenna apparatus is a dipole antenna, including a first radiator, and including a second radiator in place of the ground conductor.

According to an antenna apparatus of a tenth aspect of the present disclosure, the antenna apparatus of one of the first to ninth aspects of the present disclosure is provided with a plurality of radiators. The plurality of radiators have a plurality of different first frequencies and a plurality of different second frequencies.

According to an antenna apparatus of an eleventh aspect of the present disclosure, in the antenna apparatus of one of the first to tenth aspects of the present disclosure, the radiation conductor is bent at at least one position.

According to an antenna apparatus of a twelfth aspect of the present disclosure, the antenna apparatus of one of the first to tenth aspects of the present disclosure is provided with a plurality of radiators connected to different signal sources.

According to an antenna apparatus of a thirteenth aspect of the present disclosure, the antenna apparatus of the twelfth aspect of the present disclosure is provided with a first radiator and a second radiator, the first and second radiators having respective radiation conductors formed symmetrically with respect to a reference axis. Respective feed points of the first and second radiators are provided at positions symmetrical with respect to the reference axis. The radiation conductors of the first and second radiators are shaped such that a distance between the first and second radiators gradually increases as a distance from the feed points of the first and second radiators along the reference axis increases.

According to an antenna apparatus of a fourteenth aspect of the present disclosure, the antenna apparatus of the twelfth or thirteenth aspect of the present disclosure is provided with a first radiator and a second radiator. Respective loops of radiation conductors of the first and second radiators are formed substantially symmetrically with respect to a reference axis. When proceeding along the respective symmetric loops of the radiation conductors of the first and second radiators in corresponding directions starting from the respective feed points, the first radiator is configured such that the feed point, the inductor, and the capacitor are located in this order, and the second radiator is configured such that the feed point, the capacitor, and the inductor are located in this order.

According to a wireless communication apparatus of a fourteenth aspect of the present disclosure, the wireless communication apparatus provided with the antenna apparatus of one of the first to fourteenth aspects of the present disclosure.

According to the antenna apparatus of the present disclosure, it is possible to provide an antenna apparatus operable in multiple bands, while having a simple and small configuration.

In addition, when the antenna apparatus of the present disclosure is provided with a plurality of radiators, the antenna apparatus has low coupling between antenna elements, and thus, is operable to simultaneously transmit or receive a plurality of radio signals.

In addition, according to the antenna apparatus of the present disclosure, it is possible to increase the bandwidth of the operating band including the high-band resonance frequency.

In addition, according to the antenna apparatus of the present disclosure, it is possible to easily adjust only the low-band operating frequency so as to shift to a lower frequency.

In addition, according to the wireless communication apparatus of the present disclosure, it is possible to provide a wireless communication apparatus provided with such antenna apparatuses.

INDUSTRIAL APPLICABILITY

As described above, an antenna apparatus of the present disclosure is operable in multiple bands, while having a simple and small configuration. In addition, when including a plurality of radiators, the antenna apparatus of the present disclosure has low coupling between antenna elements, and is operable to simultaneously transmit or receive a plurality of radio signals.

According to the antenna apparatus of the present disclosure and the wireless communication apparatus using the antenna apparatus, they can be implemented as, for example, mobile phones or can also be implemented as apparatuses for wireless LANs, PDAs, etc. The antenna apparatus can be mounted on, for example, wireless communication apparatuses for MIMO communication. In addition to MIMO, the antenna apparatus can also be mounted on (multi-application) array antenna apparatus capable of simultaneously performing communications for a plurality of applications, such as an adaptive array antenna, a maximal-ratio combining diversity antenna, and a phased-array antenna.

REFERENCE SIGNS LIST

1, 2, 3, 11, 12, 21, 22, 31 to 34, and 51 to 54: RADIATION CONDUCTOR,

10 and 20: HOUSING,

40 to 48, 50, 60 to 69, 70 to 78, 70A to 70D, 78A to 78C, and 79: RADIATOR,

81: WIRELESS TRANSMITTER AND RECEIVER CIRCUIT,

82: BASEBAND SIGNAL PROCESSING CIRCUIT,

83: SPEAKER,

84: MICROPHONE,

90: DIELECTRIC SUBSTRATE,

C1 to C5, C11, C21, C31, and C32: CAPACITOR,

Ce: EQUIVALENT CAPACITANCE,

D1 to D8, D11, D21, D31, D32, D41, and D42: DIELECTRIC BLOCK,

G1: GROUND CONDUCTOR,

L1 to L5, L11, L21, L31, and L32: INDUCTOR,

La: INDUCTANCE,

M1 to M4, M11, M21, M31, M32, and M41: MAGNETIC BLOCK,

M5: MAGNETIC POWDER,

P1, P11, P21, P31, and P33: FEED POINT,

P2, P32, and P34: CONNECTING POINT,

Q1, Q21, Q31, and Q32: SIGNAL SOURCE,

Rr: RADIATION RESISTANCE,

S1: STRIP CONDUCTOR.

The invention claimed is:

1. An antenna apparatus comprising at least one radiator and a ground conductor, wherein each radiator comprises:

a looped radiation conductor having an inner perimeter and an outer perimeter, the radiation conductor being provided with respect to the ground conductor such that a part of the radiation conductor is close to and electromagnetically coupled to the ground conductor;

at least one capacitor inserted at a position along a loop of the radiation conductor;

at least one inductor inserted at a position along the loop of the radiation conductor, the position of the inductor being different from the position of the capacitor;

a feed point provided at a position on the radiation conductor, the position of the feed point being close to the ground conductor; and a dielectric block provided between the radiation conductor and the ground conductor, the dielectric block being provided in a portion where the radiation conductor and the ground conductor are close to each other, and the dielectric block provided along at least a part of the loop of the radiation conductor between the feed point and the capacitor, wherein each radiator is excited at a first frequency and at a second frequency higher than the first frequency, wherein when each radiator is excited at the first frequency, a first current flows along a first path, the first path extending along the inner perimeter of the loop of the radiation conductor and including the inductor and the capacitor, wherein when each radiator is excited at the second frequency, a second current flows through a second path including a section, the section extending along the outer perimeter of the loop of the radiation conductor, and the section including the capacitor but not including the inductor, and the section extending between the feed point and the inductor, wherein when each radiator is excited at the second frequency, a parallel resonant circuit is formed from: a capacitance between the radiation conductor and the ground conductor which are close to each other and between which the dielectric block is provided; and an inductance of the radiation conductor, and wherein each radiator is configured such that the loop of the radiation conductor, the inductor, and the capacitor resonate at the first frequency, and a portion of the loop of the radiation conductor included in the second path, the capacitor, and the parallel resonant circuit resonate at the second frequency.

2. The antenna apparatus as claimed in claim 1, wherein the radiation conductor and the ground conductor of each radiator are provided such that a plane of the radiation conductor is identical to a plane of the ground conductor, wherein each radiator is provided with a first dielectric block on one side of the plane and a second dielectric block provided on the other side of the plane, in a portion where the radiation conductor and the ground conductor are close to each other, and along at least a part of the loop of the radiation conductor between the feed point and the capacitor.

3. The antenna apparatus as claimed in claim 1, further comprising a magnetic block provided at at least a part of an inside of the loop of the radiation conductor, wherein magnetic flux produced by the first current passes through the magnetic block, thus increasing an inductance of the radiation conductor.

4. The antenna apparatus as claimed in claim 3, further comprising a housing, wherein the magnetic block is formed by embedding magnetic material in a portion of the housing close to an inner portion of the loop of the radiation conductor.

5. The antenna apparatus as claimed in claim 1, wherein the radiation conductor includes a first radiation conductor and a second radiation conductor, and wherein the capacitor is formed by capacitance between the first and second radiation conductors.

6. The antenna apparatus as claimed in claim 1, wherein the inductor is formed as a strip conductor.

7. The antenna apparatus as claimed in claim 1, wherein the inductor is formed as a meander conductor.

8. The antenna apparatus as claimed in claim 1, comprising a printed circuit board comprising the ground conductor, and a feed line connected to the feed point, wherein the radiator is formed on the printed circuit board.

9. The antenna apparatus as claimed in claim 1, wherein the antenna apparatus is a dipole antenna, including a first radiator, and including a second radiator in place of the ground conductor.

10. The antenna apparatus as claimed in claim 1, comprising a plurality of radiators, wherein the plurality of radiators have a plurality of different first frequencies and a plurality of different second frequencies.

11. The antenna apparatus as claimed in claim 1, wherein the radiation conductor is bent at at least one position.

12. The antenna apparatus as claimed in claim 1, comprising a plurality of radiators connected to different signal sources.

13. The antenna apparatus as claimed in claim 12, comprising a first radiator and a second radiator, the first and second radiators having respective radiation conductors formed symmetrically with respect to a reference axis, wherein respective feed points of the first and second radiators are provided at positions symmetrical with respect to the reference axis, and wherein the radiation conductors of the first and second radiators are shaped such that a distance between the first and second radiators gradually increases as a distance from the feed points of the first and second radiators along the reference axis increases.

14. The antenna apparatus as claimed in claim 12, comprising a first radiator and a second radiator, wherein respective loops of radiation conductors of the first and second radiators are formed substantially symmetrically with respect to a reference axis, and wherein when proceeding along the respective symmetric loops of the radiation conductors of the first and second radiators in corresponding directions starting from the respective feed points, the first radiator is configured such that the feed point, the inductor, and the capacitor are located in this order, and the second radiator is configured such that the feed point, the capacitor, and the inductor are located in this order.

15. A wireless communication apparatus comprising an antenna apparatus, the antenna apparatus comprising at least one radiator and a ground conductor, wherein each radiator comprises:

a looped radiation conductor having an inner perimeter and an outer perimeter, the radiation conductor being provided with respect to the ground conductor such that a part of the radiation conductor is close to and electromagnetically coupled to the ground conductor;

at least one capacitor inserted at a position along a loop of the radiation conductor;

at least one inductor inserted at a position along the loop of the radiation conductor, the position of the inductor being different from the position of the capacitor;

a feed point provided at a position on the radiation conductor, the position of the feed point being close to the ground conductor; and a dielectric block provided between the radiation conductor and the ground conductor, the dielectric block being provided in a portion where the radiation conductor and the ground conductor are close to each other, and the dielectric block provided along at least a part of the loop of the radiation conductor between the feed point and the capacitor, wherein each radiator is excited at a first frequency and at a second frequency higher than the first frequency, wherein when each radiator is excited at the first frequency, a first current flows along a first path, the first path extending along the inner perimeter of the loop of the radiation conductor and including the inductor and the capacitor, wherein when each radiator is excited at the second frequency, a second current flows through a second path including a section, the section extending along the outer perimeter of the loop of the radiation conductor, and the section including the capacitor but not including the inductor, and the section extending between the feed point and the inductor, wherein when each radiator is excited at the second frequency, a parallel resonant circuit is formed from: a capacitance between the radiation conductor and the ground conductor which are close to each other and between which the dielectric block is provided; and an inductance of the radiation conductor, and wherein each radiator is configured such that the loop of the radiation conductor, the inductor, and the capacitor resonate at the first frequency, and a portion of the loop of the radiation conductor included in the second path, the capacitor, and the parallel resonant circuit resonate at the second frequency.

* * * * *